US009024920B2

(12) United States Patent
Kojima et al.

(10) Patent No.: US 9,024,920 B2
(45) Date of Patent: May 5, 2015

(54) DRIVE VOLTAGE GENERATOR

(75) Inventors: Hiroshi Kojima, Shiga (JP); Kazuyoshi Nishi, Kyoto (JP); Takashi Koizumi, Shiga (JP); Mika Nakamura, Osaka (JP); Yosuke Izawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 929 days.

(21) Appl. No.: 13/186,075

(22) Filed: Jul. 19, 2011

(65) Prior Publication Data

US 2011/0273425 A1 Nov. 10, 2011

Related U.S. Application Data

(63) Continuation of application No. PCT/JP2010/002926, filed on Apr. 22, 2010.

(30) Foreign Application Priority Data

Nov. 12, 2009 (JP) ..... 2009-259020

(51) Int. Cl.
*G09G 3/32* (2006.01)
*G09G 3/36* (2006.01)

(52) U.S. Cl.
CPC ..... *G09G 3/3291* (2013.01); *G09G 3/3688* (2013.01); *G09G 3/3696* (2013.01); *G09G 2310/027* (2013.01); *G09G 2310/0291* (2013.01); *G09G 2330/021* (2013.01); *G09G 2330/028* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 6,496,175 | B1 * | 12/2002 | Fukuo | 345/99 |
| 8,466,868 | B2 * | 6/2013 | Lee et al. | 345/100 |
| 2002/0153940 | A1 | 10/2002 | Wurcer et al. | |
| 2006/0284806 | A1 | 12/2006 | Maki | |

FOREIGN PATENT DOCUMENTS

| | | | |
|---|---|---|---|
| CN | 101452682 | A | 6/2009 |
| JP | 2004-520754 | | 7/2004 |
| JP | 2006-065148 | | 3/2006 |
| JP | 2006-065148 | A | 3/2006 |
| JP | 2006-140843 | | 6/2006 |
| JP | 2006-140843 | A | 6/2006 |
| JP | 2006-350082 | | 12/2006 |

* cited by examiner

*Primary Examiner* — Joseph Haley
(74) *Attorney, Agent, or Firm* — McDermott Will & Emery LLP

(57) ABSTRACT

N drivers convert n digital values into n voltages. N amplifiers amplify the n voltages, thereby generate n drive voltages. An amplifier voltage supply supplies an amplifier voltage for driving the n amplifiers. An amplifier voltage controller detects a maximum digital value among a plurality of digital values, and sets the amplifier voltage to a voltage value dependent on the maximum digital value.

3 Claims, 41 Drawing Sheets

Din
AMPLIFIER VOLTAGE CONTROLLER
15
SET
AMPLIFIER VOLTAGE SUPPLY
14
BUFFER
16
GRADATION VOLTAGE GENERATOR
13
VAMP
1
CLK
STR
LD
k
12
11
GATE DRIVER
GL1
GL2
GLm
10
101
111
D Q
Dn
D2
D1
102
121
LATCH
122
123
DAC
VSn
VS2
VS1
103
VDn
VD2
VD1
DLn
DL2
DL1
100

(A)

(B)

DRIVE VOLTAGE GENERATOR

CROSS-REFERENCE TO RELATED APPLICATION

This is a continuation of PCT International Application PCT/JP2010/002926 filed on Apr. 22, 2010, which claims priority to Japanese Patent Application No. 2009-259020 filed on Nov. 12, 2009. The disclosures of these applications including the specifications, the drawings, and the claims are hereby incorporated by reference in its entirety.

BACKGROUND

The technology disclosed in this specification relates to drive voltage generators each for generating a plurality of drive voltages corresponding to a plurality of digital values, and more particularly to technology for reducing power consumption.

Conventionally, in the field of display devices such as organic electroluminescent (OEL) display devices and liquid crystal display (LCD) devices, drive voltage generators (e.g., source drivers) have been known as circuits for driving display panels such as OEL panels and LCD panels. A drive voltage generator generates drive voltages for driving display elements (e.g., OEL elements, LCD elements, etc.) included in a display panel based on pixel values corresponding to brightness levels of the pixels. In such a display device, reduction in power consumption is also important. Japanese Patent Publication No. 2006-065148 (Patent Document 1) discloses a display device capable of reducing power consumption by controlling the cathode voltage of OEL elements based on a peak value of video data.

SUMMARY

In recent years, demands for reducing power consumption have been increasing, and reduction in the power consumption of drive voltage generators has also been increasingly important. For example, as the numbers of pixels and the definition of display devices increase, the power consumption of drive voltage generators has been increasing. However, conventionally, no steps have been taken to reduce the power consumption of drive voltage generators.

Thus, it is an object of the technology disclosed in this specification to provide a drive voltage generator capable of reducing the power consumption.

According to one aspect of the present invention, a drive voltage generator which periodically receives n (where $n \geq 2$) digital values, and generates n drive voltages corresponding to the n digital values includes n drivers corresponding to the n digital values, n amplifiers corresponding to the n drivers, an amplifier voltage supply, and an amplifier voltage controller, where each of the n drivers converts a digital value corresponding to that driver into a voltage; each of the n amplifiers amplifies a voltage obtained by a driver corresponding to that amplifier, thereby generates one of the drive voltages; the amplifier voltage supply supplies an amplifier voltage for driving the n amplifiers; and the amplifier voltage controller detects a maximum digital value among $n \cdot q$ (where $q \geq 1$) digital values supplied to the drive voltage generator, and sets the amplifier voltage supplied by the amplifier voltage supply to a voltage value dependent on the maximum digital value. The drive voltage generator controls the amplifier voltage based on the maximum digital value, thereby allowing the power consumption of the n amplifiers to be reduced depending on the maximum digital value. As a result, the power consumption of the drive voltage generator can be reduced.

The amplifier voltage supply may select, as controlled by the amplifier voltage controller, an analog voltage corresponding to the maximum digital value from i (where $i \geq 2$) analog voltages different from one another as the amplifier voltage. Alternatively, the amplifier voltage supply may generate, as controlled by the amplifier voltage controller, the amplifier voltage by raising an analog voltage at a rate of voltage increase corresponding to the maximum digital value.

According to another aspect of the present invention, a drive voltage generator which periodically receives n (where $n \geq 2$) digital values, and generates n drive voltages corresponding to the n digital values includes n drivers corresponding to the n digital values, n amplifiers corresponding to the n drivers, an amplifier voltage supply, and an amplifier voltage controller, where each of the n drivers converts a digital value corresponding to that driver into a voltage, and belongs to one of p (where $2 \leq p \leq n$) groups; each of the n amplifiers amplifies a voltage obtained by a driver corresponding to that amplifier, thereby generates one of the drive voltages, and belongs to a group to which the driver corresponding to that amplifier belongs among the p groups; the amplifier voltage supply supplies p amplifier voltages corresponding to the p groups; each of the p amplifier voltages is a voltage for driving one or more amplifiers belonging to a group corresponding to that amplifier voltage; and the amplifier voltage controller detects an X-th (where $1 \leq X \leq p$) maximum digital value among one or more digital values corresponding to an X-th group, of $n \cdot q$ (where $q \leq 1$) digital values supplied to the drive voltage generator, and sets an X-th amplifier voltage supplied by the amplifier voltage supply to a voltage value dependent on the X-th maximum digital value. The drive voltage generator individually controls the p amplifier voltages, thereby allowing the power consumption of the n amplifiers to be reduced on a per group basis. As a result, the power consumption of the drive voltage generator can be further reduced.

The amplifier voltage supply may include p supply sections configured to supply the p amplifier voltages, and the amplifier voltage controller may set the X-th amplifier voltage supplied by an X-th supply section to the voltage value dependent on the X-th maximum digital value. In addition, the X-th supply section may select, as controlled by the amplifier voltage controller, an analog voltage corresponding to the X-th maximum digital value from i (where $i \geq 2$) analog voltages different from one another as the X-th amplifier voltage. Alternatively, the X-th supply section may generate, as controlled by the amplifier voltage controller, the X-th amplifier voltage by raising an analog voltage at a rate of voltage increase corresponding to the X-th maximum digital value.

The amplifier voltage controller may include p control sections corresponding to the p groups, and an X-th control section may detect the X-th maximum digital value among one or more digital values corresponding to the X-th group, of $n \cdot q$ digital values supplied to the drive voltage generator, and set the X-th amplifier voltage supplied by the X-th supply section to a voltage value dependent on the X-th maximum digital value.

In addition, the X-th supply section may select, as controlled by the X-th control section, an analog voltage corresponding to the X-th maximum digital value from i (where $i \geq 2$) analog voltages different from one another as the X-th amplifier voltage. Alternatively, the X-th supply section may generate, as controlled by the X-th control section, the X-th amplifier voltage by raising an analog voltage at a rate of voltage increase corresponding to the X-th maximum digital value.

According to still another aspect of the present invention, a drive voltage generator which periodically receives n (where n≥2) digital values, and generates n drive voltages corresponding to the n digital values includes n drivers corresponding to the n digital values, n amplifiers corresponding to the n drivers, n supply sections corresponding to the n amplifiers, and n control sections corresponding to the n drivers, where each of the n drivers converts a digital value corresponding to that driver into a voltage; each of the n amplifiers amplifies a voltage obtained by a driver corresponding to that amplifier, thereby generates one of the drive voltages; an X-th (where 1≤X≤n) supply section supplies an X-th amplifier voltage for driving an X-th amplifier; and an X-th control section sets the X-th amplifier voltage supplied by the X-th supply section to a voltage value dependent on a digital value supplied to an X-th driver, of the n digital values supplied to the drive voltage generator. The drive voltage generator individually controls the n amplifier voltages, thereby allowing the power consumption of the n amplifiers to be reduced on a per amplifier basis. As a result, the power consumption of the drive voltage generator can be further reduced.

The X-th supply section may select, as controlled by the X-th control section, an analog voltage corresponding to a digital value supplied to the X-th driver from i (where i≥2) analog voltages different from one another as the X-th amplifier voltage.

The drive voltage generator may further include a reference voltage supply configured to supply a reference voltage, a gradation voltage generator configured to generate a plurality of gradation voltages different from one another based on the reference voltage supplied by the reference voltage supply, a reference voltage controller configured to detect a maximum digital value among n·r (where r≥1) digital values supplied to the drive voltage generator, and to set the reference voltage supplied by the reference voltage supply to a voltage value dependent on the maximum digital value, and a data processor configured to process the n·r digital values based on a ratio between a voltage value of the reference voltage set by the reference voltage controller and a predetermined reference voltage value, and to supply processed n·r digital values to the n drivers, where each of the n drivers may select one gradation voltage from the plurality of gradation voltages based on a digital value corresponding to that driver. The drive voltage generator can reduce the reference voltage depending on the maximum digital value, thereby allowing the power consumption of the gradation voltage generator to be reduced. As a result, the power consumption of the drive voltage generator can be reduced.

In addition, the drive voltage generator may further include a gain controller configured to detect a maximum digital value among n·s (where s≥1) digital values supplied to the drive voltage generator, and to set a gain value of each of the n amplifiers to a gain value dependent on the maximum digital value, and a data processor configured to process the n·s digital values based on a ratio between the gain value set by the gain controller and a predetermined reference gain value, and to supply processed n·s digital values to the n drivers. The drive voltage generator can reduce the gain values of the n amplifiers depending on the maximum digital value, thereby allowing the power consumption of the n amplifiers to be reduced. As a result, the power consumption of the drive voltage generator can be reduced.

Moreover, the drive voltage generator may further include an analog voltage supply configured to supply the i analog voltages, and an analog voltage controller configured to select i thresholds so that if n·v (where v≥1) digital values supplied to the drive voltage generator are distributed to i regions defined by the i thresholds, the numbers of digital values which fall within the respective i regions approach a same value, and to set the i analog voltages supplied by the analog voltage supply respectively to voltage values dependent on the i thresholds. The drive voltage generator sets the analog values based on the distribution of the digital values, thereby allowing the voltage difference between the amplifier voltage and the drive voltage to be reduced. Thus, the power consumption of the n amplifiers can be further reduced, and as a result, the power consumption of the drive voltage generator can be further reduced.

DETAILED DESCRIPTION

Figure 1:
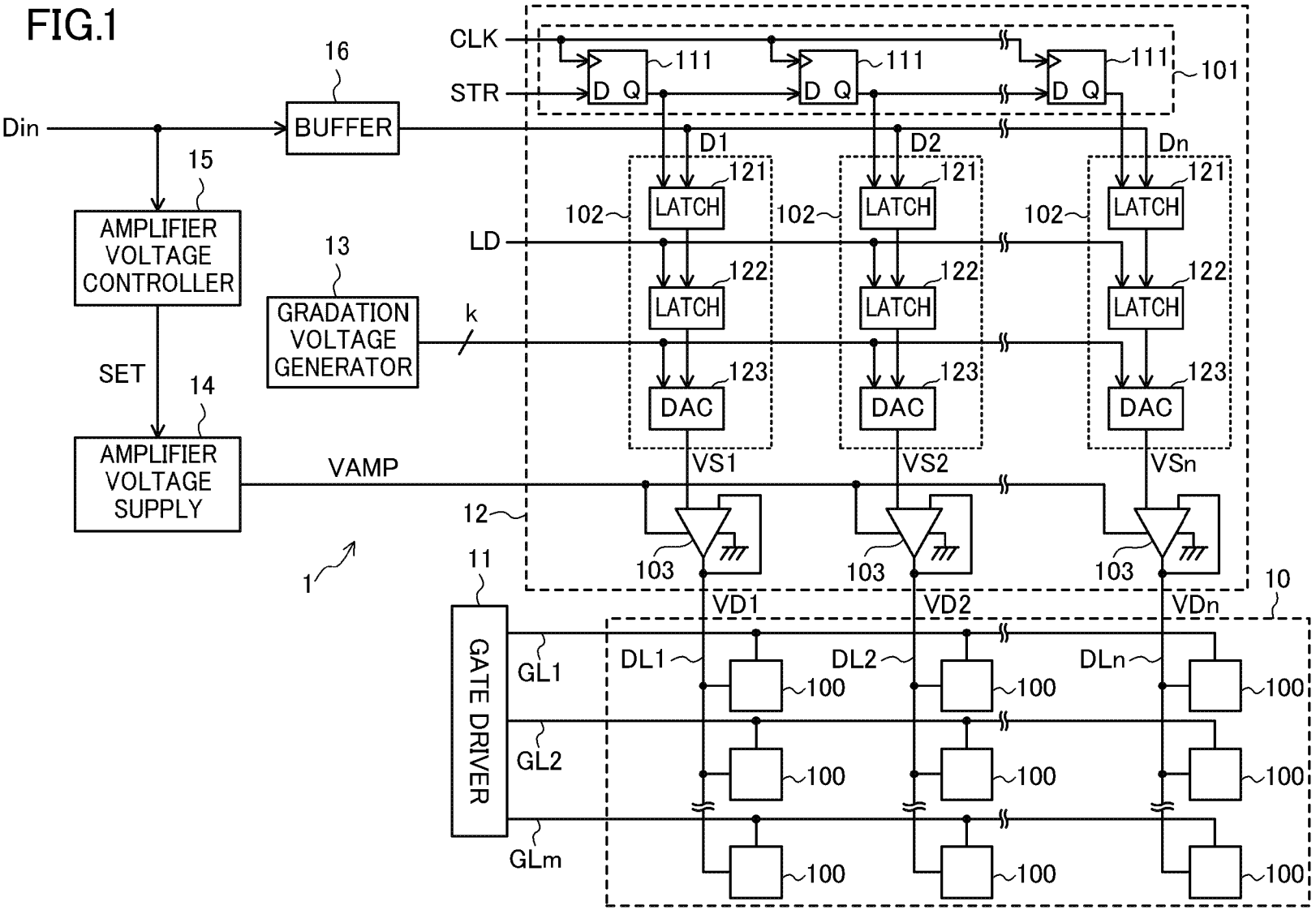
FIG. 1 is a diagram illustrating an example configuration of a drive voltage generator according to the first embodiment.

Example embodiments of the present invention will be described below in detail with reference to the drawings, in which like reference characters indicate the same or equivalent components, and the explanation thereof will not be repeated.

First Embodiment

FIG. 1 illustrates an example configuration of a drive voltage generator 1 according to the first embodiment. The drive voltage generator 1 forms an organic electroluminescent (OEL) display device together with an OEL panel 10 and a gate driver 11.

Figure 2:
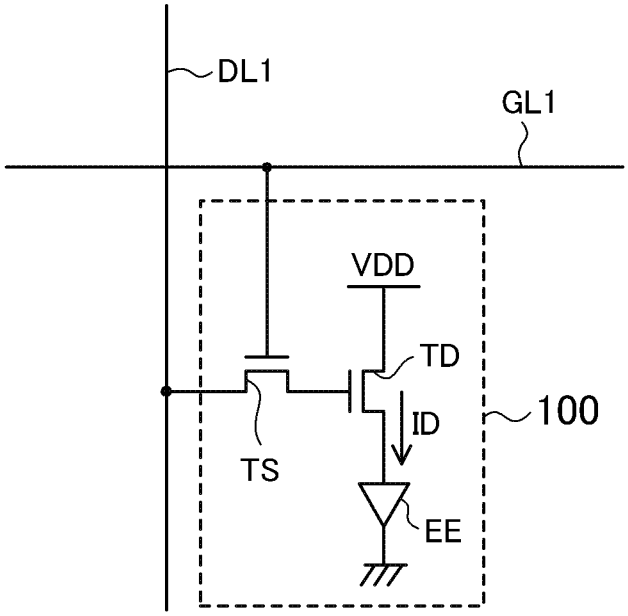
FIG. 2 is a diagram illustrating an example configuration of the pixel region shown in FIG. 1.

The OEL panel 10 includes n·m (where n≥2 and m≥2) pixel regions 100, 100, . . . , and 100 arranged in a matrix, n data lines DL1, DL2, . . . , and DLn respectively corresponding to n pixel columns of the pixel regions 100, 100, . . . , and 100, and m gate lines GL1, GL2, . . . , and GLm respectively corresponding to m pixel rows of the pixel regions 100, 100, . . . , and 100. As shown in FIG. 2, each of the pixel regions 100, 100, . . . , and 100 includes a switch transistor TS, a drive transistor TD, and an OEL element EE. When a voltage is supplied to the gate line (in FIG. 2, gate line GL1) corresponding to the pixel region 100, the switch transistor TS is turned on, and thus the gate of the drive transistor TD is coupled to the data line (in FIG. 2, data line DL1) corresponding to the pixel region 100. Then, a drive current ID dependent on the gate voltage of the drive transistor TD is supplied to the OEL element EE, thereby causing the OEL element EE to emit light.

The gate driver 11 sequentially supplies a voltage to the m gate lines GL1, GL2, . . . , and GLm, thereby selects pixel regions from the n·m pixel regions 100, 100, . . . , and 100 on a per row basis. The n pixel regions 100, 100, . . . , and 100 selected by the gate driver 11 are respectively supplied with drive voltages VD1, VD2, . . . , and VDn through the data lines DL1, DL2, . . . , and DLn.

The drive voltage generator 1 includes a source driver 12, a gradation voltage generator 13, an amplifier voltage supply 14, and an amplifier voltage controller 15. The drive voltage generator 1 periodically receives n pixel values (digital values) Din, Din, . . . , and Din contained in one horizontal line.

[Source Driver]

The source driver 12 includes a shift register 101, n data line drivers (drivers) 102, 102, . . . , and 102, and n amplifiers 103, 103, . . . , and 103.

The shift register 101 includes n flip-flops 111, 111, . . . , and 111 respectively corresponding to the data line drivers 102, 102, . . . , and 102. Each of the flip-flops 111, 111, . . . , and 111 receives a start pulse STR or an output of the immediately previous flip-flop in synchronism with a clock CLK. Thus, the start pulse STR is sequentially transferred in synchronism with the clock CLK. The start pulse STR defines a start timing to receive a pixel value.

The first, the second, . . . , and the n-th data line drivers 102, 102, . . . , and 102 respectively correspond to a first pixel value Din (D1), a second pixel value Din (D2), . . . , and an n-th pixel value Din (Dn) contained in one horizontal line. The data line drivers 102, 102, . . . , and 102 respectively convert the pixel values D1, D2, . . . , and Dn into selection voltages VS1, VS2, . . . , and VSn. For example, each of the data line drivers 102, 102, . . . , and 102 includes latches 121 and 122, and a digital-to-analog converter (DAC) 123. The latches 121, 121, . . . , and 121 respectively receive and hold the pixel values D1, D2, . . . , and Dn in response to the outputs of the flip-flops 111, 111, . . . , and 111. The latches 122, 122, . . . , and 122 respectively receive and hold the pixel values D1, D2, . . . , and Dn held in the latches 121, 121, . . . , and 121 in response to a load pulse LD. Thus, the pixel values D1, D2, . . . , and Dn are output at one time in response to the load pulse LD. The load pulse LD defines a timing when the n pixel values D1, D2, . . . , and Dn contained in one horizontal line are respectively converted into the n drive voltages VD1, VD2, . . . , and VDn. The DACs 123, 123, . . . , and 123 respectively select gradation voltages corresponding to the pixel values thereof from k (where k≥2) gradation voltages generated by the gradation voltage generator 13 based on the pixel values D1, D2, . . . , and Dn from the latches 122, 122, . . . , and 122, and respectively output the selected gradation voltages as the selection voltages VS1, VS2, . . . , and VSn.

The amplifiers 103, 103, . . . , and 103 respectively amplify the selection voltages VS1, VS2, . . . , and VSn from the data line drivers 102, 102, . . . , and 102, thereby generates the drive voltages VD1, VD2, . . . , and VDn. Here, the gain value of each of the amplifiers 103, 103, . . . , and 103 is set to "1." That is, the voltage values of the drive voltages VD1, VD2, . . . , and VDn are respectively the same as the voltage values of the selection voltages VS1, VS2, . . . , and VSn.

Thus, the pixel values D1, D2, . . . , and Dn are converted into the drive voltages VD1, VD2, . . . , and VDn in response to the load pulse LD, and the drive voltages VD1, VD2, . . . , and VDn start to be written to the data lines DL1, DL2, . . . , and DLn (that is, a display process for one horizontal line is started). Note that, for simplicity of illustration, the selection voltages VS1, VS2, . . . , and VSn may also be hereinafter collectively referred to as "selection voltage(s) VS," and the drive voltages VD1, VD2, . . . , and VDn may also be hereinafter collectively referred to as "drive voltage(s) VD."

[Gradation Voltage Generator]

Figure 3:
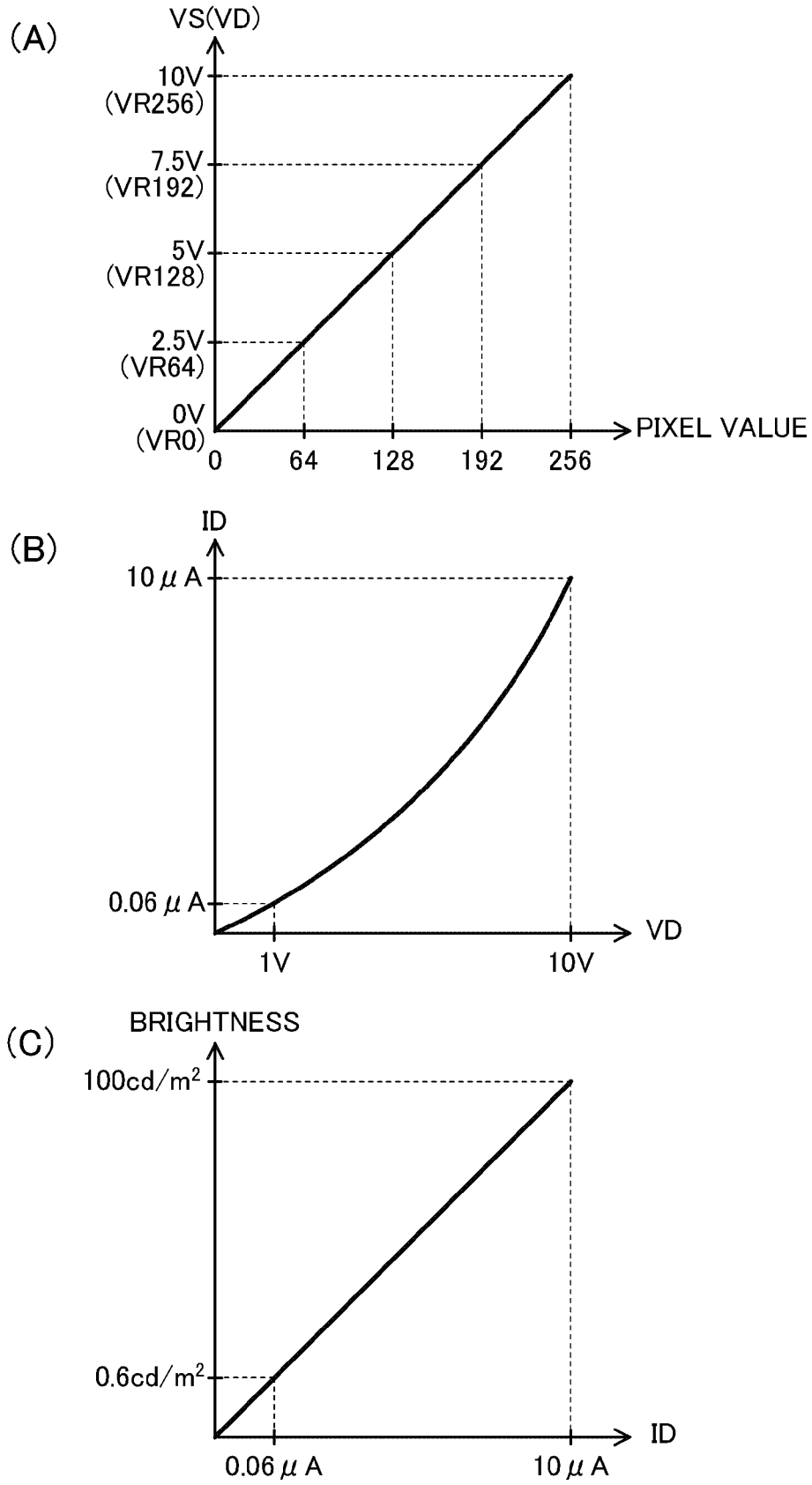
FIG. 3A is a diagram to explain a correspondence between the pixel value and the voltage value of the drive voltage.
FIG. 3B is a diagram to explain a correspondence between the drive voltage and the drive current.
FIG. 3C is a diagram to explain a correspondence between the drive current and the brightness.

The gradation voltage generator 13 generates k (where k≥2) gradation voltages different from one another. For example, the gradation voltage generator 13 includes a resistor ladder, which subjects a high-level reference voltage and a low-level reference voltage to resistance division. A t-th (where 0≤t≤k−1) gradation voltage corresponds to a t-th pixel value. For example, when k=257, as shown in FIG. 3A, 257 gradation voltages VR0, VR1, VR2, . . . , and VR256 correspond on a one-to-one basis to 257 pixel values 0, 1, 2, . . . , and 256. Note that, in FIG. 3A, the 256th gradation voltage VR256 is set to 10 V, and the voltage difference between the t-th and the (t+1)-th gradation voltages is set to approximately 0.04 V. FIG. 3A shows that a higher pixel value Din causes a higher drive voltage VD. FIG. 3B shows that a higher drive voltage VD causes a higher drive current ID (current supplied to an OEL element EE by a drive transistor TD). FIG. 3C shows that a higher drive current ID causes a higher brightness of an OEL element EE. For example, if the pixel value Din is "256," then the voltage value of the drive voltage VD is "10 V," the current value of the drive current ID is "10 μA," and the brightness of the OEL element EE is "100 cd/m$^2$."

[Amplifier Voltage Supply]

The amplifier voltage supply 14 supplies an amplifier voltage VAMP for driving the n amplifiers 103, 103, . . . , and 103. The voltage value of the amplifier voltage VAMP supplied by the amplifier voltage supply 14 can be changed by a setting signal SET from the amplifier voltage controller 15. The amplifier voltage VAMP is supplied to the amplifiers 103, 103, . . . , and 103 as a power supply voltage. The drive voltage VD generated by each of the amplifiers 103 is lower than the amplifier voltage VAMP. A more detailed description is as follows. When the amplifier voltage VAMP supplied to an amplifier 103 is higher than the drive voltage VD which will be generated by that amplifier 103, and the voltage difference between the amplifier voltage VAMP and the drive voltage VD is a predetermined amount α, the amplifier 103 can correctly generate the drive voltage VD. For example, if α=1 V and the amplifier voltage VAMP is "11 V," then the amplifier 103 supplied with this amplifier voltage VAMP can correctly generate a drive voltage VD equal to or less than "10 V."

[Amplifier Voltage Controller]

Figure 4:
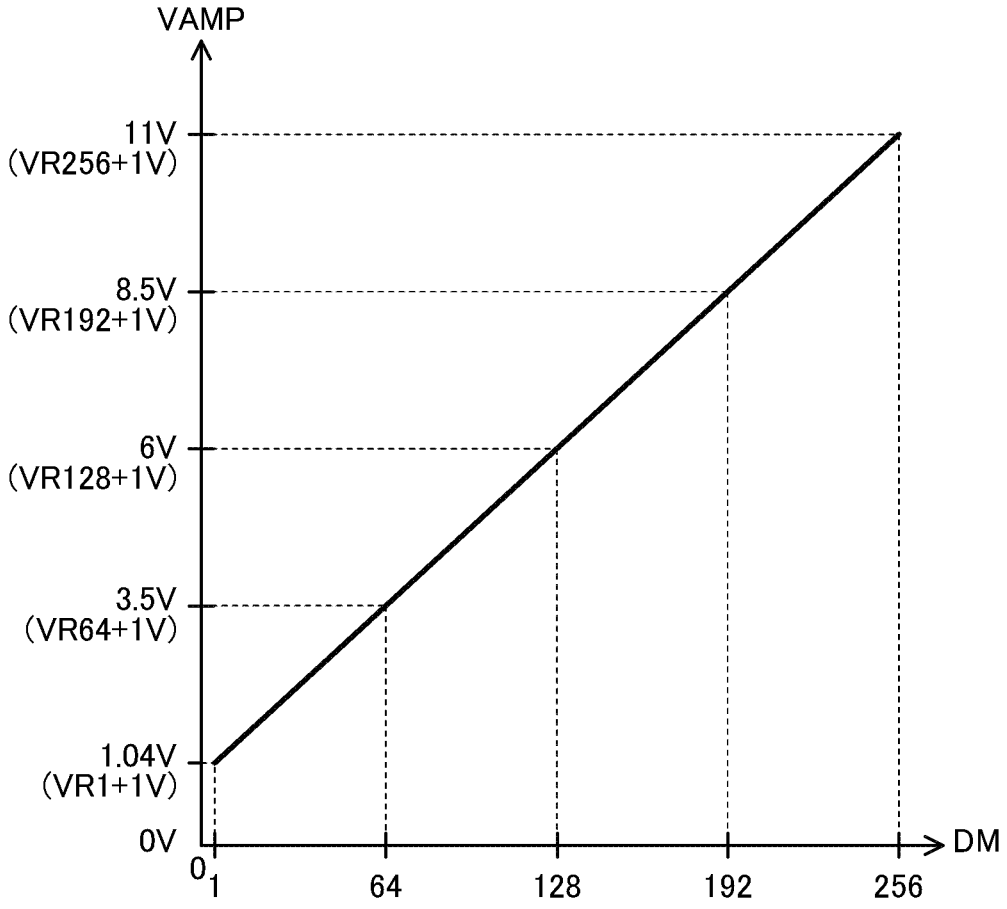
FIG. 4 is a diagram to explain a correspondence between the maximum pixel value and the voltage value of the amplifier voltage.

The amplifier voltage controller 15 detects a maximum pixel value DM (maximum digital value) among n·q (where q≥1) pixel values Din, Din, . . . , and Din supplied to the drive voltage generator 1. The amplifier voltage controller 15 includes a mapping table which shows a correspondence between the maximum pixel value DM and the voltage value of the amplifier voltage VAMP, and detects a voltage value mapped to the maximum pixel value DM from the mapping table. For example, if, under α=1 V, a correspondence as shown in FIG. 3A exists between the pixel value and the voltage value of the drive voltage VD (voltage value of the gradation voltage), and the voltage value of the amplifier voltage VAMP can be switched in k steps (257 steps), then the amplifier voltage controller 15 may include a mapping table which shows a correspondence as shown in FIG. 4. FIG. 4 shows that 257 voltage values correspond on a one-to-one basis to 257 maximum pixel values, and that a t-th (where 1≤t≤k−1) voltage value is higher than the voltage value of the drive voltage VD corresponding to the t-th pixel value (i.e., voltage value of the t-th gradation voltage) by the predetermined amount α (=1 V). However, the zeroth maximum pixel value "0" corresponds to a voltage value "0 V" (=VR0) of the drive voltage corresponding to the pixel value "0."

In addition, the amplifier voltage controller 15 controls the amplifier voltage supply 14 by means of the setting signal SET so that the amplifier voltage VAMP supplied by the amplifier voltage supply 14 is set to a voltage value dependent on the maximum pixel value DM. For example, if the amplifier voltage controller 15 detects a pixel value "128" as the maximum pixel value DM, the amplifier voltage controller 15 sets the amplifier voltage VAMP to "6 V" (=VR128+1 V). Note that a control instruction is written into the setting signal SET to set the amplifier voltage VAMP to a voltage value dependent on the maximum pixel value DM.

[Example Configuration of Amplifier Voltage Supply]

Figure 5:
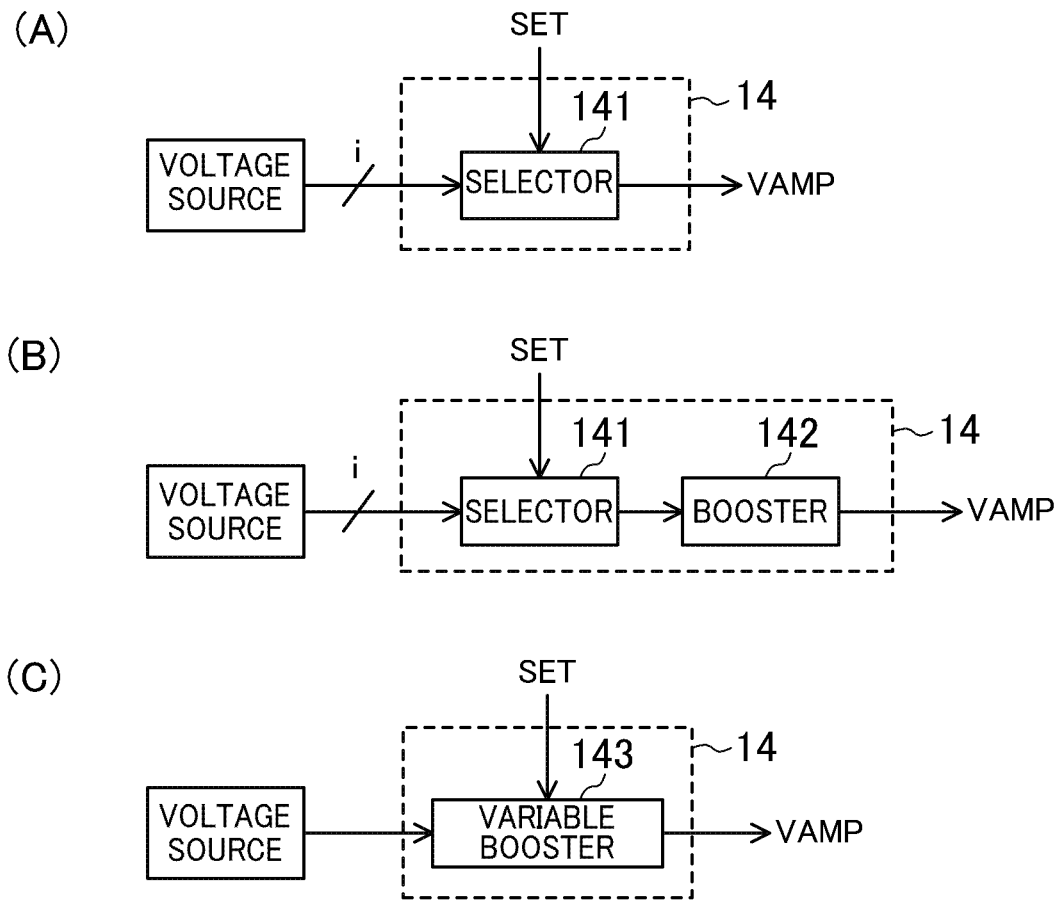
FIGS. 5A-5C are diagrams each illustrating an example configuration of the amplifier voltage supply shown in FIG. 1.

For example, as shown in FIG. 5A, the amplifier voltage supply 14 may include a selector 141, which selects an analog voltage corresponding to the maximum pixel value DM from i (where i≥2) analog voltages from a voltage source as the amplifier voltage VAMP based on the setting signal SET. In such a case, a control instruction is written into the setting signal SET to select an analog voltage having a voltage value dependent on the maximum pixel value DM. The voltage source may be formed by a highly efficient booster (e.g., charge pump circuit, switching regulator, etc.). Such a configuration allows the power consumption of the voltage source to be reduced. Alternatively, as shown in FIG. 5B, the amplifier voltage supply 14 may include a selector 141 and a booster 142, which generates the amplifier voltage VAMP by raising the analog voltage selected by the selector 141. Such a configuration allows the power consumption of the voltage source and the power consumption of the selector 141 to be reduced, thereby allowing the voltage resistance of the selector 141 to be reduced. Further alternatively, as shown in FIG. 5C, the amplifier voltage supply 14 may include a variable booster 143 (e.g., switching regulator) whose rate of voltage increase can be set by the setting signal SET. The variable booster 143 generates the amplifier voltage VAMP by raising the analog voltage from the voltage source at a rate of voltage increase corresponding to the maximum pixel value DM based on the setting signal SET. In such a case, a control instruction is written into the setting signal SET to set the rate of voltage increase of the variable booster 143 to a ratio of the voltage value dependent on the maximum pixel value DM with respect to the voltage value of the analog voltage. Such a configuration allows the power consumption of the voltage source to be reduced.

[Buffer]

A buffer 16 delays and provides the pixel values Din, Din, . . . , and Din supplied to the drive voltage generator 1 to the data line drivers 102, 102, . . . , and 102 so that the amplifier voltage VAMP is set based on an h-th set (where h is any integer) of the n·q pixel values during an interval from a completion of a display process (write process of the drive voltages VD1, VD2, . . . , and VDn) based on an (h−1)-th set of the n·q pixel values to a start of a display process based on the h-th set of the n·q pixel values. For example, if the amplifier voltage controller 15 sets the amplifier voltage VAMP based on one frame of pixel values (n·pixel values), the buffer 16 delays the pixel values Din, Din, . . . , and Din supplied to the drive voltage generator 1 for a delay time corresponding to one frame.

[Operation]

Figure 6:
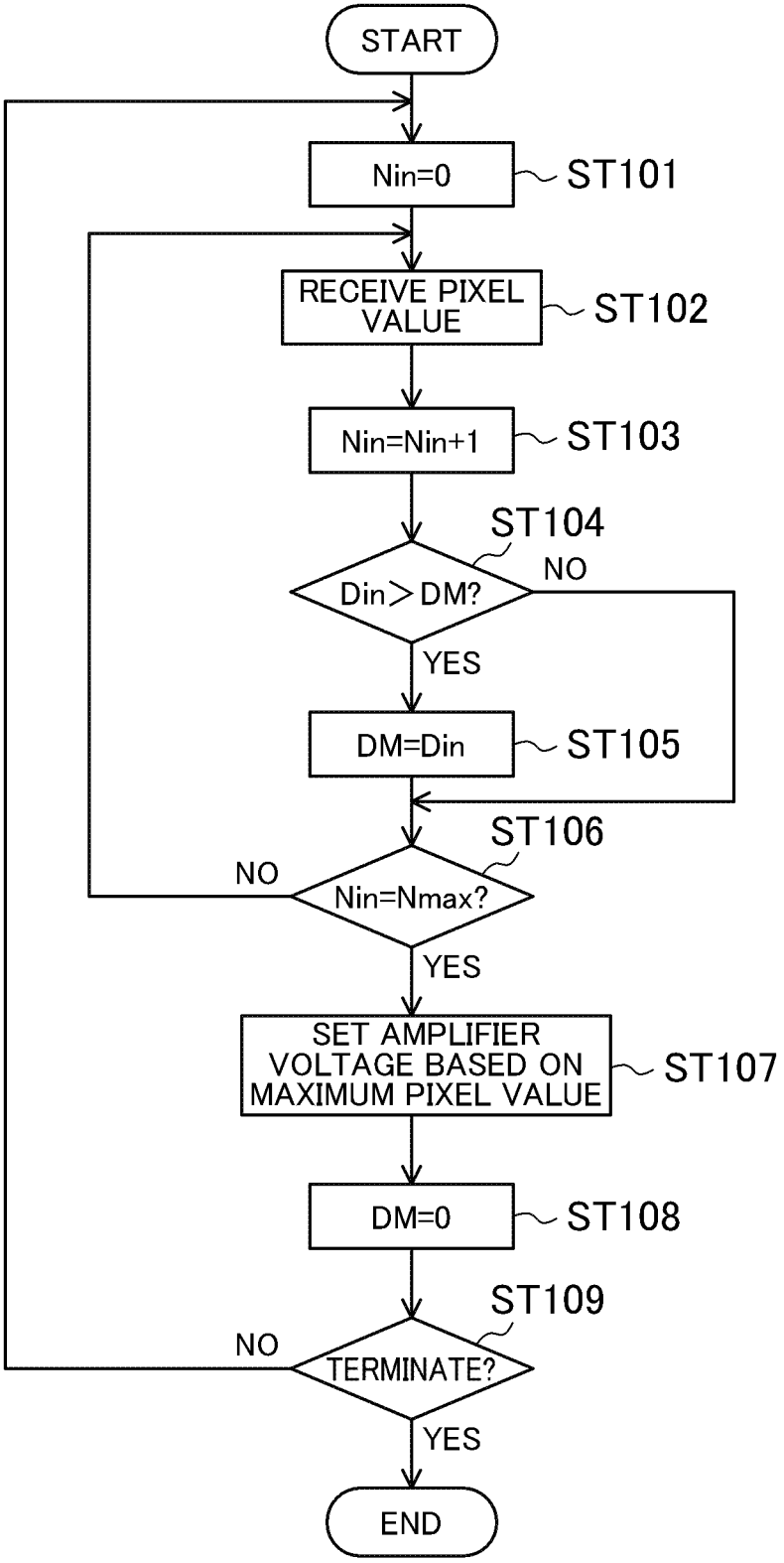
FIG. 6 is a diagram to explain an operation by the amplifier voltage controller shown in FIG. 1.

Next, referring to FIG. 6, the operation by the amplifier voltage controller 15 shown in FIG. 1 will be described. Here, it is assumed that the amplifier voltage controller 15 detects the maximum pixel value DM among one frame of pixel values (n·m pixel values) every frame, and sets the amplifier voltage VAMP. That is, it is assumed that q=m, and that the maximum pixel number Nmax is set to "n·m." It is also assumed that the maximum pixel value DM is set to an initial value (=0).

First, when pixel values of the h-th frame start to be supplied to the drive voltage generator 1, the amplifier voltage controller 15 sets the input pixel number Nin to an initial value (=0) (ST101), receives the pixel value Din (ST102), and adds "1" to the input pixel number Nin (ST103).

Next, the amplifier voltage controller 15 determines whether the pixel value Din received at step ST102 is greater than the maximum pixel value DM or not (ST104). If the pixel value Din is greater than the maximum pixel value DM, the amplifier voltage controller 15 overwrites the maximum pixel value DM with the pixel value Din (ST105). Meanwhile, if the pixel value Din is less than or equal to the maximum pixel value DM, the amplifier voltage controller 15 does not overwrite the maximum pixel value DM.

Next, the amplifier voltage controller 15 determines whether the input pixel number Nin has reached the maximum pixel number Nmax or not (ST106). If the input pixel number Nin has not yet reached the maximum pixel number Nmax, the amplifier voltage controller 15 receives the next pixel value Din (ST102). Thus, the maximum pixel value DM is detected among the n·m pixel values.

If the input pixel number Nin has reached the maximum pixel number Nmax, the amplifier voltage controller 15 sets the amplifier voltage VAMP to a voltage value dependent on the maximum pixel value DM during an interval from a completion of a display process of the (h−1)-th frame to a start of a display process of the h-th frame (e.g., in a vertical blanking interval of the (h−1)-th frame) (ST107).

Next, the amplifier voltage controller 15 sets the maximum pixel value DM to an initial value (=0) (ST108), and determines whether to terminate the process or not (ST109). If there still remain unprocessed pixel values, then the amplifier voltage controller 15 continues the maximum value detection process (ST101-ST106) and the amplifier voltage setting process (ST107). Meanwhile, if unprocessed pixel values no longer exist, then the amplifier voltage controller 15 terminates the process.

The amplifier voltage controller 15 may perform the maximum value detection process (ST101-ST106) in response to the h-th pulse of the vertical synchronization signal, and may perform steps ST102 and ST103 in synchronism with the clock CLK. The h-th pulse of the vertical synchronization signal defines a start timing to supply the pixel values of the h-th frame. In addition, the amplifier voltage controller 15 may perform the amplifier voltage setting process (ST107) and steps ST108 and ST109 in response to the (h+1)-th pulse of the vertical synchronization signal.

Specific Example

Figure 7:
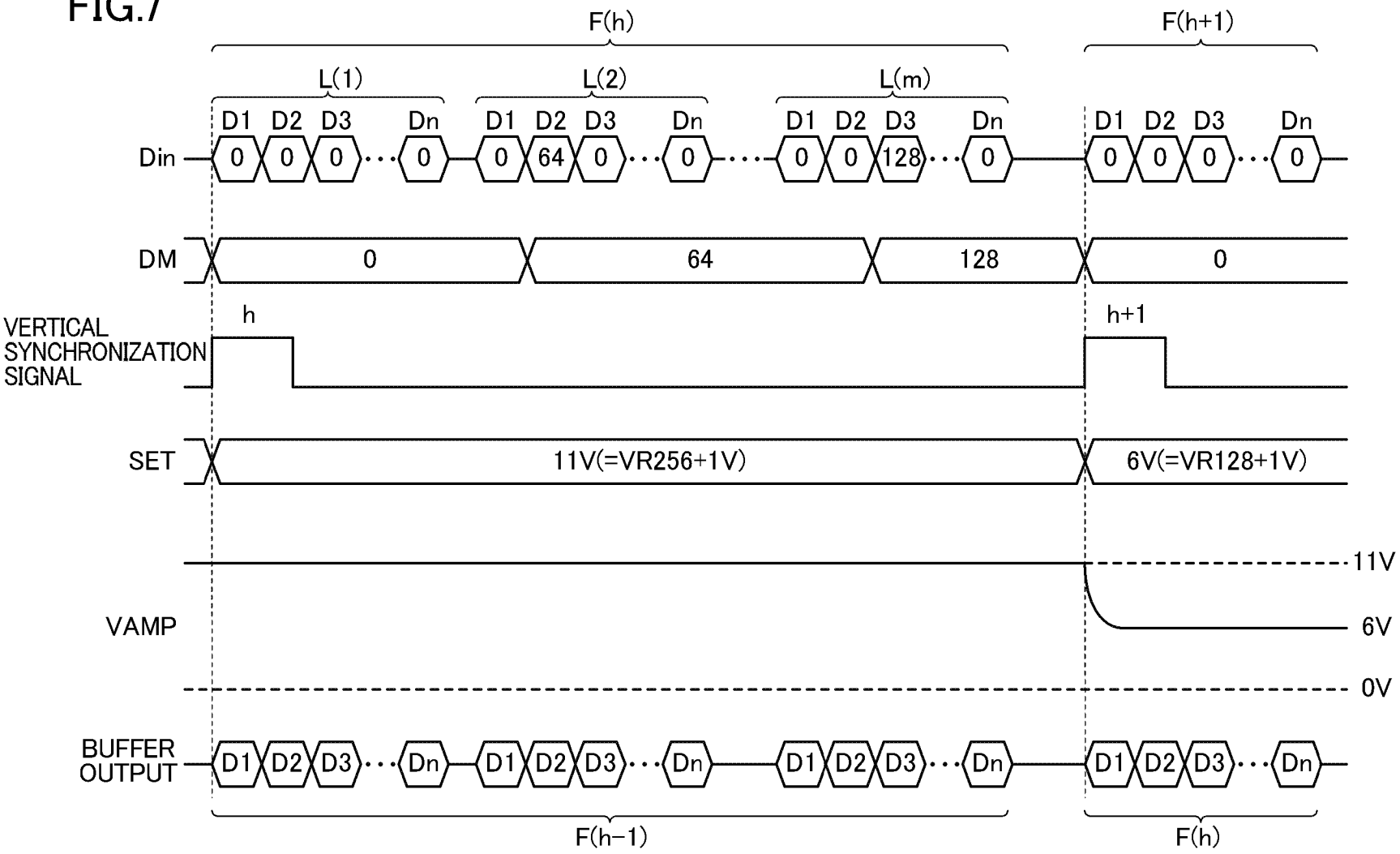
FIG. 7 is a diagram to explain a specific example of the operation by the amplifier voltage controller shown in FIG. 1.

Next, referring to FIG. 7, a specific example of the operation by the amplifier voltage controller 15 shown in FIG. 1 will be described. Here, in the h-th frame F(h), the pixel value D2 of the second horizontal line L(2) represents "64," the pixel value D3 of the m-th horizontal line L(m) represents "128," and the other pixel values represent "0." In addition, it is also assumed that the voltage value of the amplifier voltage VAMP (voltage value indicated in the setting signal SET) is set to a voltage value of "11 V" corresponding to the maximum pixel value "256."

The amplifier voltage controller 15 starts to receive the pixel value D1 of the first horizontal line L(1) included in the frame F(h) in response to the h-th pulse of the vertical synchronization signal. Meanwhile, the buffer 16 starts to output the first pixel value D1 of the (h−1)-th frame F(h−1) in response to the h-th pulse of the vertical synchronization signal. Thus, the data line drivers 102, 102, . . . , and 102 start to receive the pixel values of the frame F(h−1).

The pixel values from the pixel value D1 of the horizontal line L(1) to the pixel value D1 of the horizontal line L(2) are all equal to the maximum pixel value DM (=0), and accordingly, the amplifier voltage controller 15 does not update the maximum pixel value DM when these pixel values are received. Next, when the amplifier voltage controller 15 receives the pixel value D2 (=64) of the horizontal line L(2), which is greater than the maximum pixel value DM (=0), the amplifier voltage controller 15 overwrites the maximum pixel value DM with the value "64." Thereafter, the pixel values from the pixel value D3 of the horizontal line L(2) to the pixel value D2 of the horizontal line L(m) are all less than the maximum pixel value DM (=64), and accordingly, the amplifier voltage controller 15 does not update the maximum pixel value DM when these pixel values are received. Then, when the amplifier voltage controller 15 receives the pixel value D3 (=128) of the horizontal line L(m), which is greater than the maximum pixel value DM (=64), the amplifier voltage controller 15 overwrites the maximum pixel value DM with the value "128."

Next, the amplifier voltage controller 15 changes the voltage value "11 V," which corresponds to the maximum pixel value "256" indicated in the setting signal SET, into a voltage value "6 V," which corresponds to the maximum pixel value "128," in response to the (h+1)-th pulse of the vertical synchronization signal. In response to this change in the setting signal SET, the amplifier voltage supply 14 changes the voltage value of the amplifier voltage VAMP from "11 V" to "6 V." In addition, in response to the (h+1)-th pulse of the vertical synchronization signal, the amplifier voltage controller 15 sets the maximum pixel value DM to an initial value (=0), and starts to perform the maximum value detection process on the pixel values of the (h+1)-th frame. Meanwhile, the buffer 16 starts to output the first pixel value D1 of the frame F(h) in response to the (h+1)-th pulse of the vertical synchronization signal. Thus, the data line drivers 102, 102, . . . , and 102 start to receive the pixel values of the frame F(h).

[Power Consumption]

Next, the power consumption of the amplifiers 103, 103, . . . , and 103 will be described. A current generated in an amplifier 103 can be broadly classified into a static current, which is generated in the amplifier 103 even when the voltage value of the drive voltage VD is constant, and a charging/discharging current, which is generated in the amplifier 103 for changing the voltage value of the drive voltage VD. Thus, the power consumption of an amplifier 103 can be classified into a power consumption attributed to the static current (power consumption (static)) and a power consumption attributed to the charging/discharging current (power consumption (charging/discharging)). In addition, the power consumption of an amplifier 103 can be expressed as Equation 1 below:

$$P=(I1+I2)\cdot Vamp \quad \text{(Eq. 1)}$$

where "P" denotes the power consumption of an amplifier 103, "I1" denotes the static current of an amplifier 103, "I2" denotes the charging/discharging current of an amplifier 103, and "Vamp" denotes the voltage value of the amplifier voltage VAMP. Moreover, "I1·Vamp" is equivalent to the power consumption (static), and "I2·Vamp" is equivalent to the power consumption (charging/discharging).

First, the static power consumption of an amplifier 103 will be described, providing an example in which an image whose pixels all have a same brightness is displayed on the OEL panel 10 (an example in which the pixel values of one frame are the same). In such a case, the voltage values of the drive voltages VD1, VD2, . . . , and VDn are the same, and no charging/discharging current is generated in each of the amplifiers 103, 103, . . . , and 103. In addition, the amplifier voltage VAMP is set to a voltage value the predetermined amount α higher than the voltage value of the drive voltage VD. For example, if the pixel value is "128," then the drive voltage VD is set to "5 V" (=VR128), and the amplifier voltage VAMP is set to "6 V" (=VR128+1 V). Here, the sum of the static power consumption (total power consumption (static)) of the amplifiers 103, 103, . . . , and 103 can be expressed as Equation 2 below:

$$P1=I1\cdot n\cdot Vamp=I1\cdot n\cdot(Vd+\alpha) \quad \text{(Eq. 2)}$$

where "P1" denotes the total power consumption (static), and "Vd" denotes the voltage value of the drive voltage VD.

Figure 8:
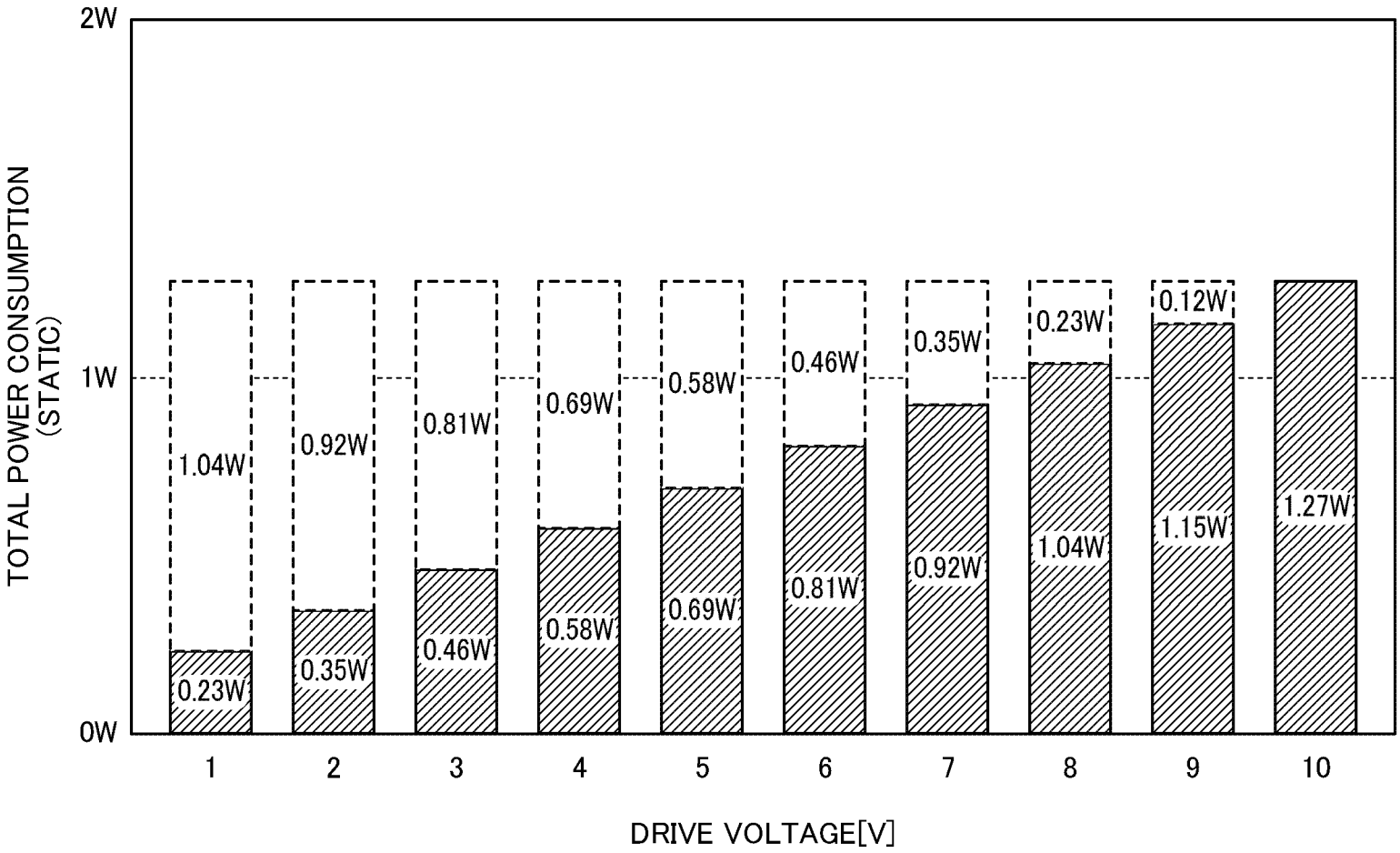
FIG. 8 is a diagram to explain the total power consumption (static).

Equation 2 shows that a lower drive voltage VD results in a lower total power consumption (static). For example, if $$I1=20\ \mu A,\ n=1920\cdot 3,\ \text{and}\ \alpha=1\ V,$$

then, as shown in FIG. 8, the drive voltages VD of 10 V, 9 V, . . . , and 1 V result in the total power consumption (static) of 1.27 W, 1.15 W, . . . , and 0.23 W. Meanwhile, if the voltage value of the amplifier voltage VAMP is fixed, the amplifier voltage VAMP would always be set to "11 V," which is the predetermined amount "1 V" higher than the maximum voltage value "10 V" of the drive voltage VD in order that the amplifiers 103 can correctly generate the drive voltage VD at any time. In such a case, the total power consumption (static) would always be 1.27 W regardless of the voltage values of the drive voltages VD. That is, setting the amplifier voltage VAMP depending on the maximum pixel value DM causes the amounts of reduction in the total power consumption (static) to be 0.12 W, 0.23 W, . . . , and 1.04 W when the drive voltages VD are 9 V, 8 V, . . . , and 1 V.

Figure 9:
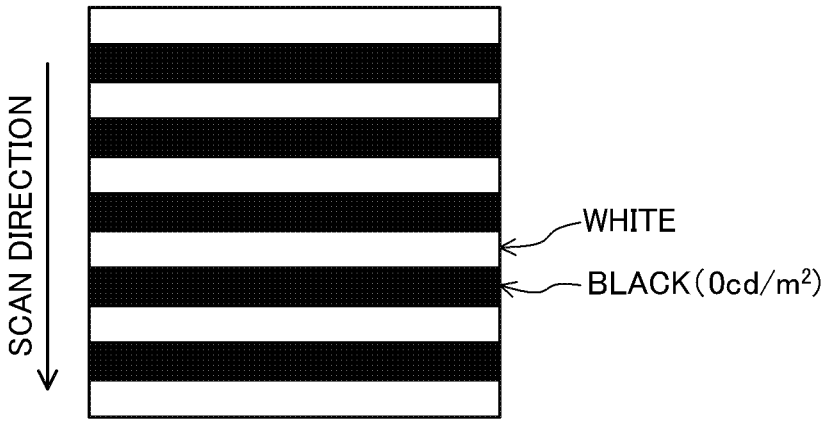
FIG. 9A is a diagram to explain an image having horizontal stripes.
FIG. 9B is a diagram to explain charging and discharging.
Figure 9:
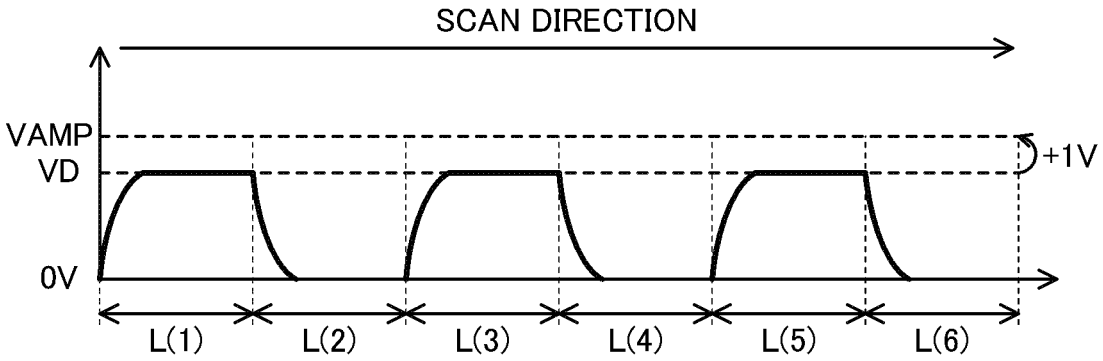

Next, the power consumption due to the charging and discharging of the amplifiers 103 will be described, providing an example in which an image having horizontal stripes as shown in FIG. 9A is displayed on the OEL panel 10 (an example in which the pixel values vary every horizontal line). In this case, the voltage values of the drive voltages VD1, VD2, . . . , and VDn vary every horizontal line. For example, the drive voltage VD is set to "5 V" during odd-numbered horizontal line periods, and is set to "0 V" during even-numbered horizontal line periods. Moreover, not only a static current but also a charging/discharging current is generated in each of the amplifiers 103, 103, . . . , and 103. That is, as shown in FIG. 9B, the data lines DL1, DL2, . . . , and DLn are repeatedly charged and discharged. Here, the charging and discharging can be expressed as Equation 3 below, and the sum of the power consumption of the charging and discharging (total power consumption (charging/discharging)) of the amplifiers 103, 103, . . . , and 103 can be expressed as Equation 4 below. In addition, the total power consumption (charging/discharging+static) can be expressed as Equation 5 below:

$$I2=(m/2)\cdot fr\cdot CL\cdot Vd \quad \text{(Eq. 3)}$$

$$\begin{aligned} P2 &= I2\cdot n\cdot Vamp \\ &= (m/2)\cdot fr\cdot CL\cdot Vd\cdot n\cdot(Vd+\alpha) \end{aligned} \quad \text{(Eq. 4)}$$

$$\begin{aligned} P3 &= P1+P2 \\ &= (I1+I2)\cdot n\cdot Vamp \\ &= \{I1+(m/2)\cdot fr\cdot CL\cdot Vd\}\cdot n\cdot(Vd+\alpha) \end{aligned} \quad \text{(Eq. 5)}$$

where "fr" denotes the frame rate, "CL" denotes the load capacitance per data line, "P2" denotes the total power consumption (charging/discharging), and "P3" denotes the total power consumption (charging/discharging+static).

Figure 10:
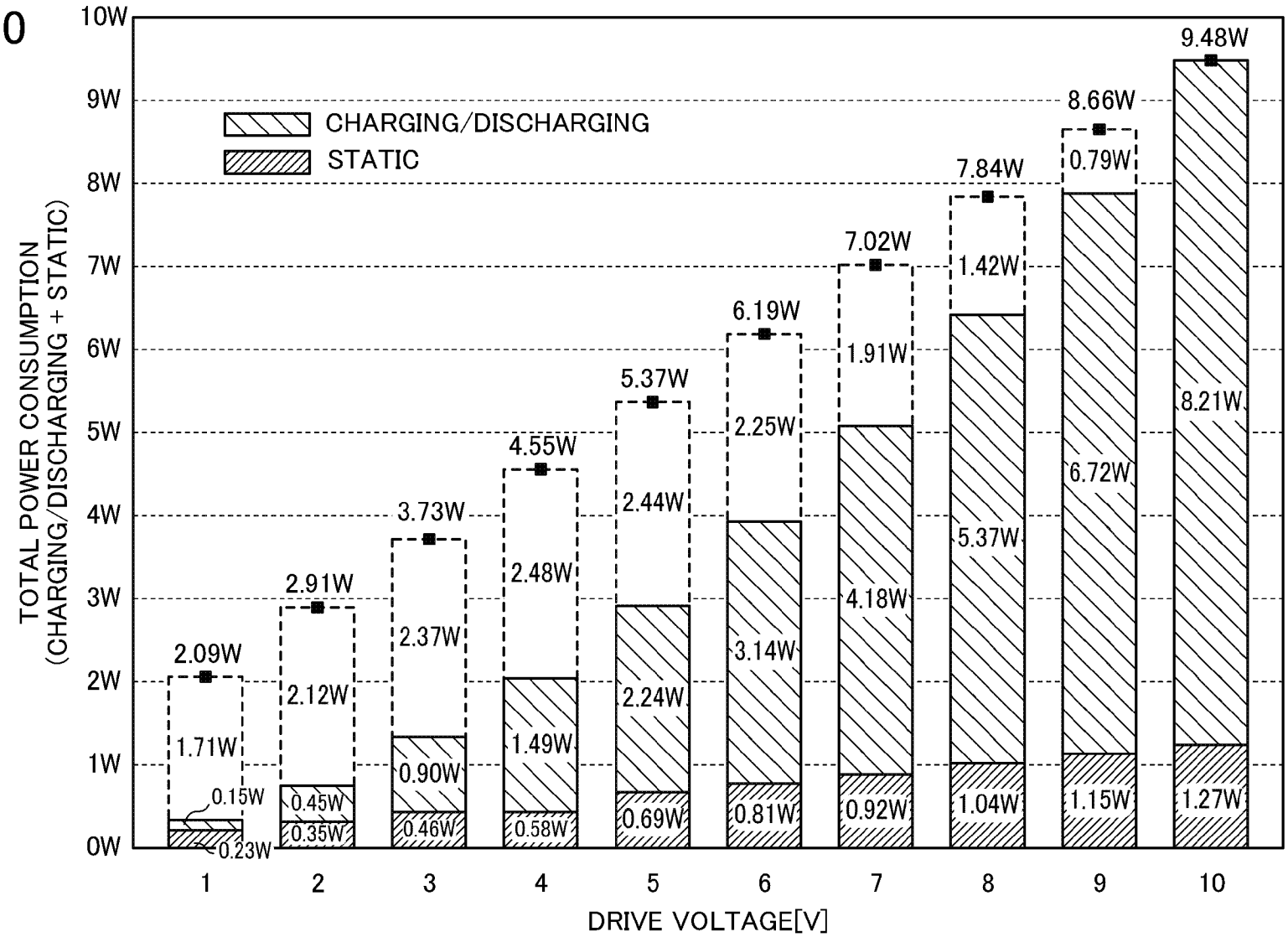
FIG. 10 is a diagram to explain the total power consumption (charging/discharging+static).

Equation 5 shows that a lower drive voltage VD results in a lower total power consumption (charging/discharging+static). For example, if $$I1=20\ \mu A,\ n=1920\cdot 3,\ \alpha=1\ V,$$

$$m=1080,\ fr=120\ Hz,\ \text{and}\ CL=200\ pF,$$

then, as shown in FIG. 10, the drive voltages VD of 10 V, 9 V, . . . , and 1 V result in the total power consumption (charging/discharging) of 8.21 W, 6.72 W, . . . , and 0.15 W, and the total power consumption (charging/discharging+static) of 9.48 W (=8.21 W+1.27 W), 7.87 W (=6.72 W+1.15 W), . . . , and 0.38 W (=0.15 W+0.23 W). Meanwhile, if the voltage value of the amplifier voltage VAMP is fixed, the amplifier voltage VAMP would always be set to "11 V," which is the predetermined amount "1 V" higher than the maximum voltage value "10 V" of the drive voltage VD in order that the amplifiers 103 can correctly generate the drive voltage VD at any time. In such a case, the total power consumption (charging/discharging+static) would be given as Equation 6 below:

$$P3=+\{I1+(m/2)\cdot fr\cdot CL\cdot Vd\}\cdot n\cdot V\max \quad \text{(Eq. 6)}$$

where "Vmax" denotes the maximum voltage value of the amplifier voltage VAMP.

If the amplifier voltage VAMP is always set to "11 V" (Vmax=11 V), then the drive voltages VD of 10 V, 9 V, . . . , and 1 V result in the total power consumption (charging/discharging+static) of 9.48 W, 8.66 W, . . . , and 2.09 W. That is, setting the amplifier voltage VAMP depending on the maximum pixel value DM causes the amounts of reduction in the total power consumption (charging/discharging+static) to be 0.79 W, 1.42 W, . . . , and 1.71 W when the drive voltages VD are 9 V, 8 V, . . . , and 1 V.

Thus, control of the amplifier voltage VAMP based on the maximum pixel value DM allows the power consumption of the amplifiers 103, 103, . . . , and 103 to be reduced as compared to when the amplifier voltage VAMP is fixed to a voltage the predetermined amount α higher than the maximum voltage value of the drive voltage VD. Accordingly, the power consumption of the drive voltage generator 1 can be reduced. In addition, reduction in the power consumption of the amplifiers 103, 103, . . . , and 103 allows the amount of heat generation of the amplifiers 103, 103, . . . , and 103 to be reduced.

Moreover, the display device of Patent Document 1 controls the cathode voltages of OEL elements EE, and thus the channel length modulation effect of drive transistors TD may cause the drive current ID to be unstable. Meanwhile, the OEL display device shown in FIG. 1 does not need to control the cathode voltages of OEL elements EE, thereby prevents an unstable drive current ID due to the channel length modulation effect, and allows the brightness values of the pixel regions 100, 100, . . . , and 100 to be stabilized.

First Variation of First Embodiment

The amplifier voltage controller 15 may perform the maximum value detection process (ST101-ST106) and the amplifier voltage setting process (ST107) based on the pixel values of g (where g≥2) frames (n·m·g pixel values) every g frames. In such a case, the buffer 16 may delay the pixel values Din, Din, . . . , and Din supplied to the drive voltage generator 1 for a delay time corresponding to g frames. In addition, the maximum pixel number Nmax may be set to "n·m·g," and the amplifier voltage controller 15 may start the maximum value detection process when the pixel values of the h-th frame start to be supplied to the drive voltage generator 1. For example, the amplifier voltage controller 15 may start the maximum value detection process in response to the h-th pulse of the vertical synchronization signal. Moreover, the amplifier voltage controller 15 may perform the amplifier voltage setting process during an interval from a completion of a display process of the (h−1)-th frame to a start of a display process of the h-th frame (e.g., in a vertical blanking interval of the (h−1)-th frame). For example, the amplifier voltage controller 15 may perform the amplifier voltage setting process in response to the (h+g)-th pulse of the vertical synchronization signal.

Furthermore, the amplifier voltage controller 15 may perform the maximum value detection process and the amplifier voltage setting process based on the pixel values of q horizontal lines (n·q pixel values) every q horizontal lines. In such a case, the buffer 16 may delay the pixel values Din, Din, . . . , and Din supplied to the drive voltage generator 1 for a delay time corresponding to (q−1) horizontal lines. In addition, the maximum pixel number Nmax may be set to "n·q," and the amplifier voltage controller 15 may start the maximum value detection process when the pixel values of the h-th horizontal line start to be supplied to the drive voltage generator 1. For example, the amplifier voltage controller 15 may start the maximum value detection process in response to the h-th pulse of the horizontal synchronization signal (or the (h−1)-th load pulse LD). Note that the h-th pulse of the horizontal synchronization signal defines a start timing to supply the pixel values of the h-th horizontal line, and the (h−1)-th load pulse LD defines a timing to convert the n pixel values D1, D2, . . . , and Dn contained in the (h−1)-th horizontal line into the n drive voltages VD1, VD2, . . . , and VDn. Moreover, the amplifier voltage controller 15 may perform the amplifier voltage setting process during an interval from a completion of a display process of the (h−1)-th horizontal line to a start of a display process of the h-th horizontal line (e.g., in a horizontal blanking interval of the (h−1)-th horizontal line). For example, the amplifier voltage controller 15 may perform the amplifier voltage setting process in response to the (h+q)-th pulse of the horizontal synchronization signal (or (h+q−1)-th load pulse LD). Note that, if q=1, the drive voltage generator 1 does not need to include the buffer 16.

Figure 11:
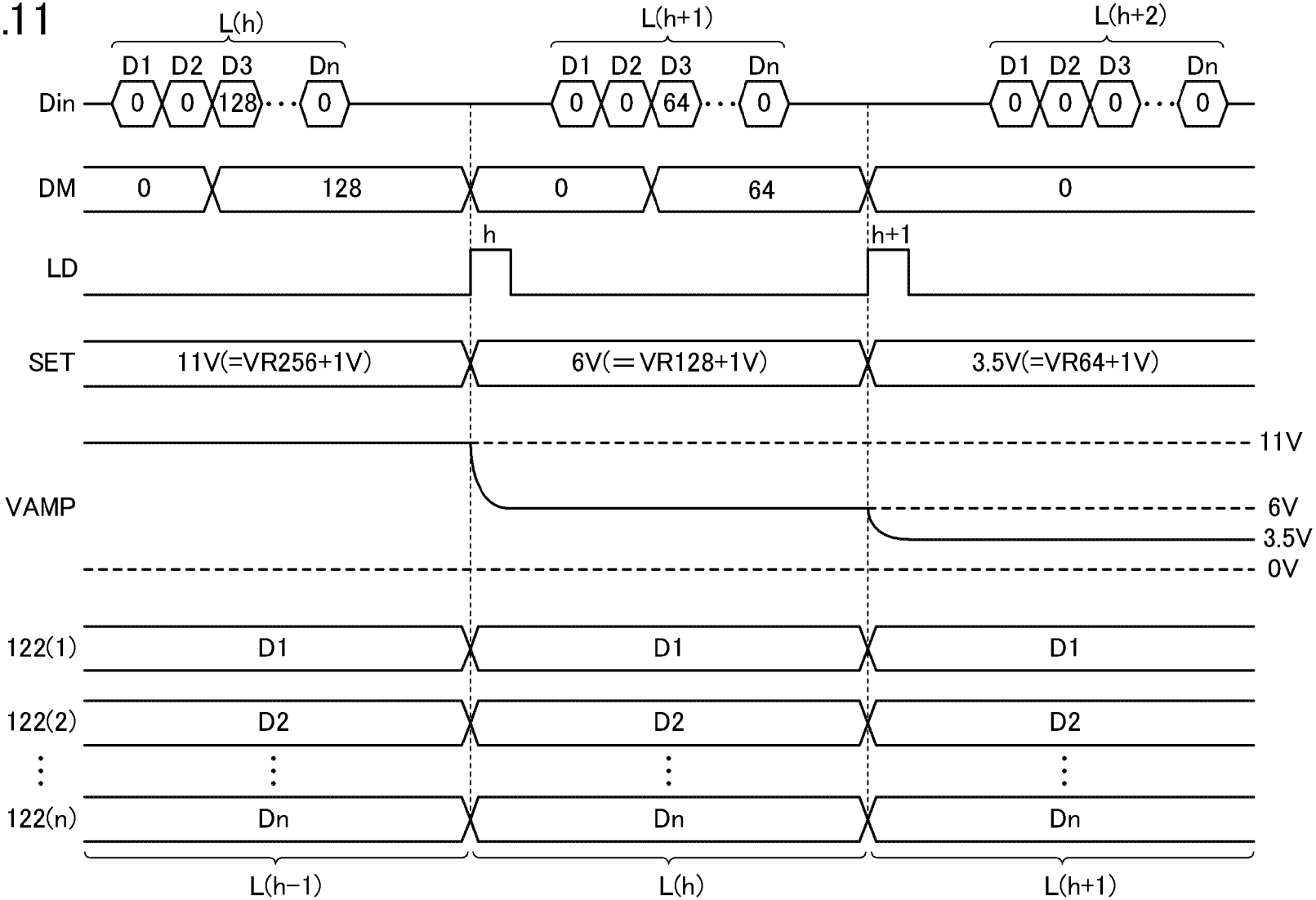
FIG. 11 is a diagram to explain another specific example of the operation by the amplifier voltage controller shown in FIG. 1.

Next, referring to FIG. 11, a case in which the maximum value detection process and the amplifier voltage setting process are performed based on the pixel values of one horizontal line every horizontal line (when q=1) will be described. In this case, the maximum pixel number Nmax is set to "n." Here, in the h-th horizontal line L(h), the pixel value D3 represents "128," and the pixel values other than the pixel value D3 represent "0." In addition, it is assumed that the voltage value of the amplifier voltage VAMP (voltage value indicated in the setting signal SET) is set to a voltage value "11 V" corresponding to the maximum pixel value "256."

The amplifier voltage controller 15 starts to receive the pixel value D1 of the horizontal line L(h) in response to the (h−1)-th load pulse LD (not shown). Upon receiving the pixel value D3 of the horizontal line L(h), which is greater than the maximum pixel value DM (=0), the amplifier voltage controller 15 overwrites the maximum pixel value DM with the value "128." Next, in response to the h-th load pulse LD, the amplifier voltage controller 15 changes the voltage value "11 V," which corresponds to the maximum pixel value "256" indicated in the setting signal SET, into a voltage value "6 V," which corresponds to the maximum pixel value "128." In addition, in response to the h-th load pulse LD, the amplifier voltage controller 15 sets the maximum pixel value DM to an initial value (=0), and starts to perform the maximum value detection process on the (h+1)-th horizontal line L(h+1). Meanwhile, the first latch 122(1), the second latch 122(2), . . . , and the n-th latch 122(*n*) output the pixel values D1, D2, . . . , and Dn of the horizontal line L(h) at one time in response to the h-th load pulse LD. Thus, the pixel values D1, D2, . . . , and Dn of the horizontal line L(h) are respectively converted into the drive voltages VD1, VD2, . . . , and VDn (that is, a display process of the horizontal line L(h) is started).

Second Variation of First Embodiment

Figure 12:
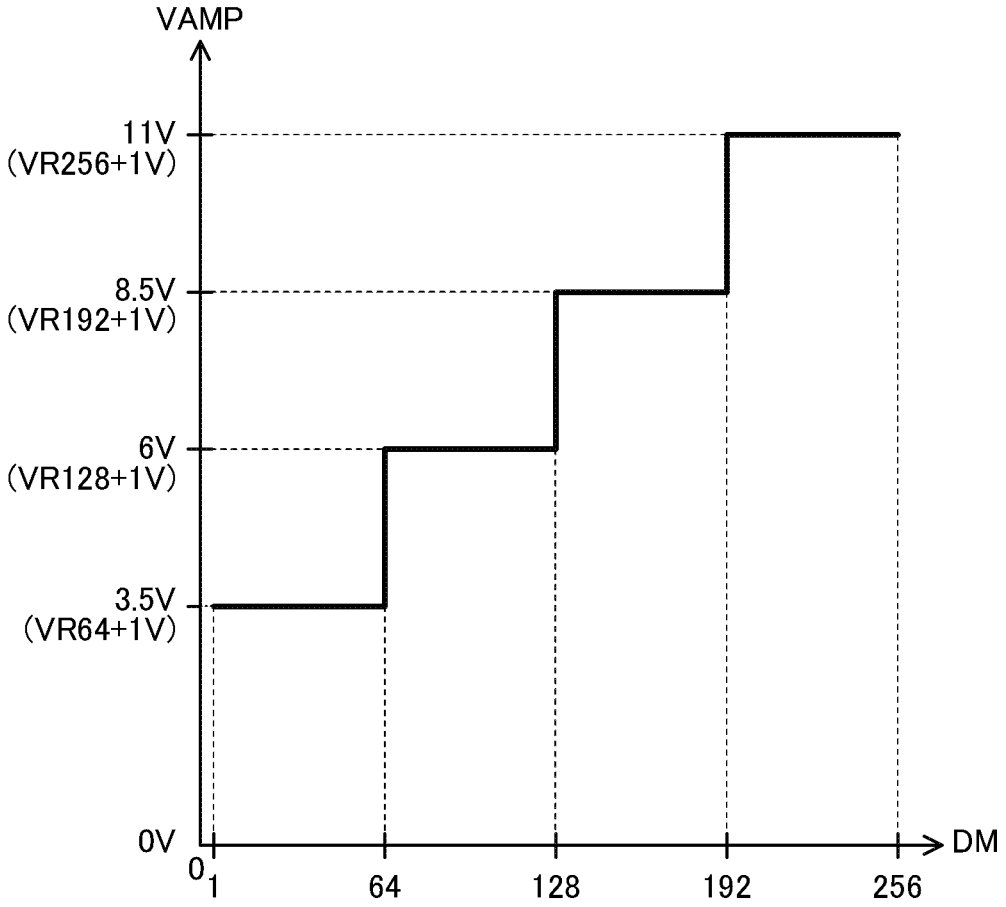
FIG. 12 is a diagram to explain another correspondence between the maximum pixel value and the voltage value of the amplifier voltage.

The number of switching steps of the voltage values of the amplifier voltage VAMP may be less than the number of the gradation voltages "k." In such a case, in the mapping table which shows a correspondence between the maximum pixel value DM and the voltage value of the amplifier voltage VAMP, each of the i (where i≥2) voltage values may be mapped to one or more maximum pixel values. Note that a Z-th (where 1≤Z≤i) voltage value is the predetermined amount α higher than the voltage value of the drive voltage (voltage value of the gradation voltage) corresponding to the highest maximum pixel value of the one or more maximum pixel values mapped to the Z-th voltage value. For example, if, under α=1 V, a correspondence as shown in FIG. 3A exists between the pixel value and the voltage value of the drive voltage, and the voltage value of the amplifier voltage VAMP can be switched in i steps (four steps), then four voltage values of 3.5 V, 6 V, 8.5 V, and 11 V may respectively correspond to the maximum pixel values of 1-64, 65-128, 129-192, and 193-256 as shown in FIG. 12. In FIG. 12, the voltage value 3.5 V is 1 V higher than the voltage value of the drive voltage corresponding to the pixel value 64 (the voltage value of the gradation voltage VR64), and the voltage values 6 V, 8.5 V, and 11 V are respectively 1 V higher than the voltage values of the drive voltage corresponding to the pixel value 128, 192, and 256 (the voltage values of the gradation voltages VR128, VR192, and VR256). The maximum pixel value "0" may be mapped to a voltage value of 0 V (=VR0).

Such a configuration also allows the amplifier voltage VAMP to be controlled depending on the maximum pixel value DM. Thus, the power consumption of the amplifiers 103, 103, . . . , and 103 can be reduced as compared to when the amplifier voltage VAMP is fixed to a voltage the predetermined amount α higher than the maximum voltage value of the drive voltage VD.

Second Embodiment

Figure 13:
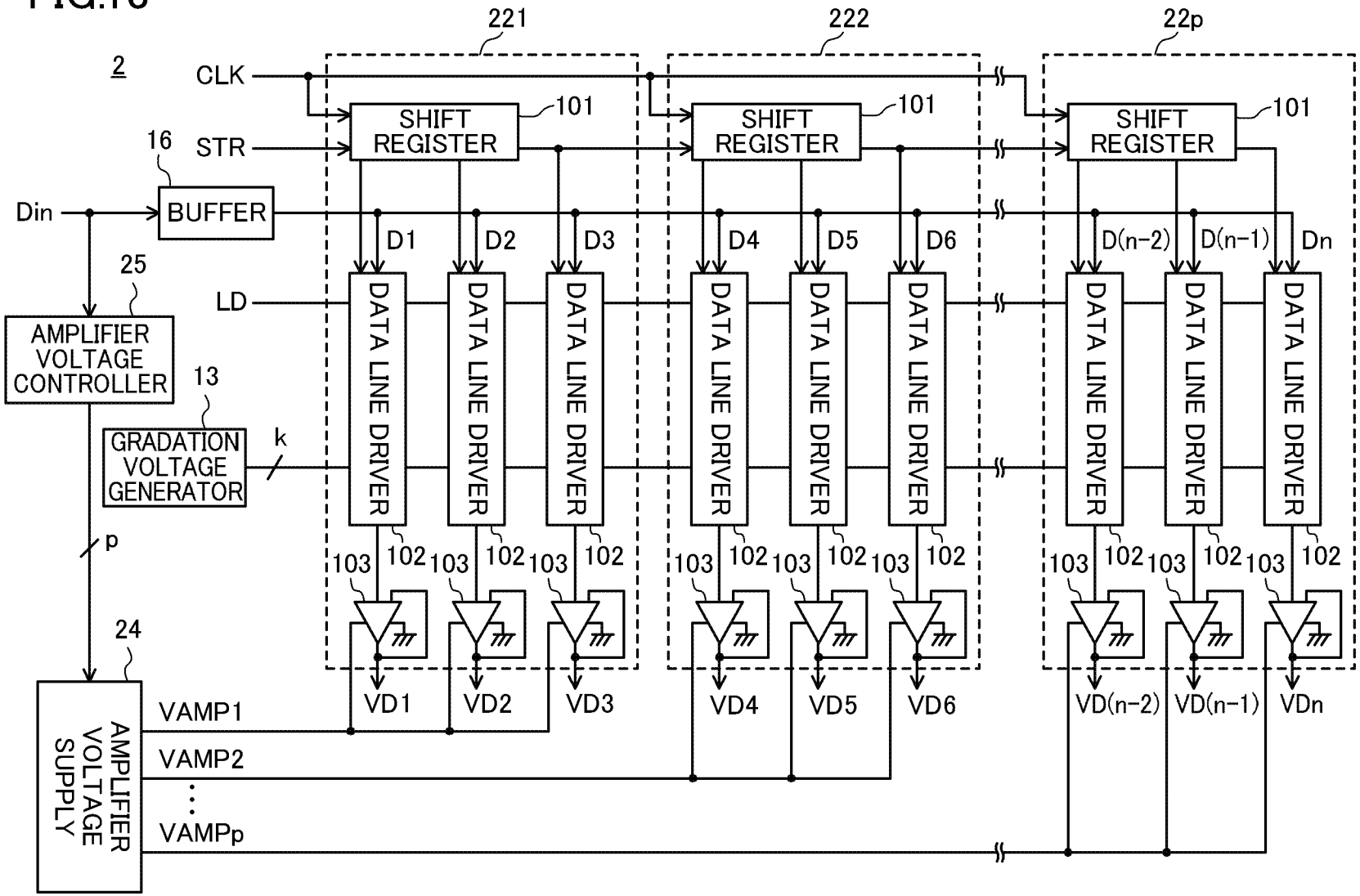
FIG. 13 is a diagram illustrating an example configuration of a drive voltage generator according to the second embodiment.

FIG. 13 illustrates an example configuration of a drive voltage generator 2 according to the second embodiment. The drive voltage generator 2 includes p (where 2≤p≤n) source drivers 221, 222, . . . , and 22*p*, a gradation voltage generator 13, a buffer 16, an amplifier voltage supply 24, and an amplifier voltage controller 25.

The source drivers 221, 222, . . . , and 22*p* each have a similar configuration to that of the source driver 12 shown in FIG. 1. Here, each of the source drivers 221, 222, . . . , and 22*p* includes three data line drivers 102, 102, and 102, and three amplifiers 103, 103, and 103. That is, each of n data line drivers 102, 102, . . . , and 102 belongs to one of the p groups (here, p source drivers 221, 222, . . . , and 22*p*), and each of n amplifiers 103, 103, . . . , and 103 belongs to a group to which the data line driver 102 corresponding to that amplifier belongs among the p groups.

[Amplifier Voltage Supply]

Figure 14:
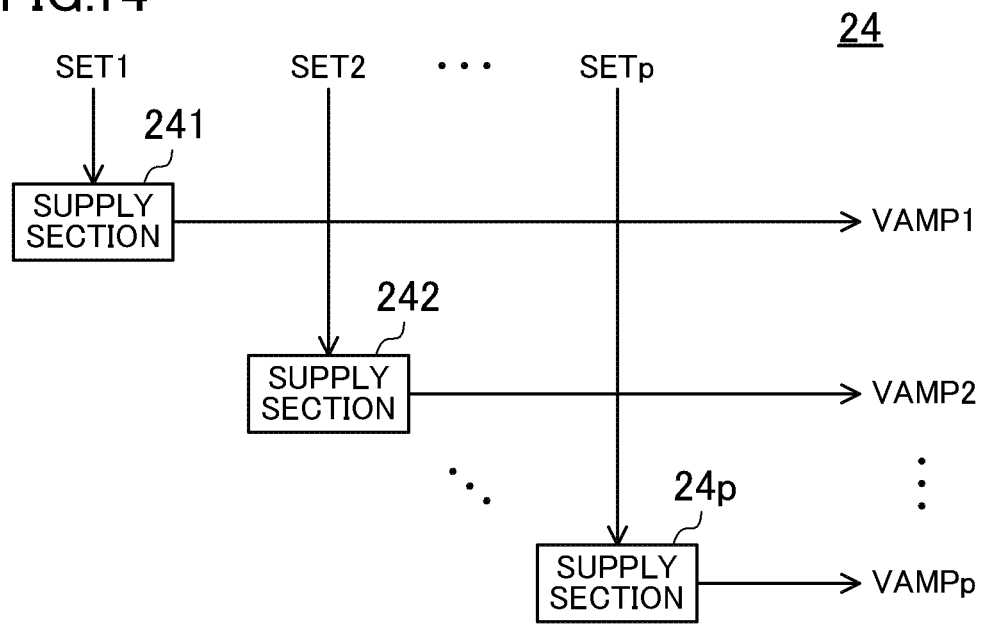
FIG. 14 is a diagram illustrating an example configuration of the amplifier voltage supply shown in FIG. 13.

The amplifier voltage supply 24 supplies p amplifier voltages VAMP1, VAMP2, . . . , and VAMPp respectively corresponding to the p groups (here, p source drivers 221, 222, . . . , and 22*p*). For example, as shown in FIG. 14, the amplifier voltage supply 24 includes p supply sections 241, 242, . . . , and 24*p*, which respectively supply the p amplifier voltages VAMP1, VAMP2, . . . , and VAMPp. The voltage values of the amplifier voltages VAMP1, VAMP2, . . . , and VAMPp generated by the supply sections 241, 242, . . . , and 24*p* can be respectively changed by p setting signals SET1, SET2, . . . , and SETp from the amplifier voltage controller 25. Of the p amplifier voltages VAMP1, VAMP2, . . . , and VAMPp, an X-th amplifier voltage (hereinafter denoted as "amplifier voltage VAMPx") is a voltage for driving the amplifiers 103, 103, and 103 included in the X-th source driver (hereinafter denoted as "source driver 22*x*") among the p source drivers 221, 222, . . . , and 22*p*. Note that 1≤X≤p and 1≤x≤p.

[Amplifier Voltage Controller]

The amplifier voltage controller 25 detects an X-th maximum pixel value (hereinafter denoted as "maximum pixel value DMx") among one or more pixel values corresponding to an X-th group (here, source driver 22*x*), of n·q pixel values supplied to the drive voltage generator 2. For example, the amplifier voltage controller 25 detects the second maximum pixel value DM2 among the pixel values D4, D5, and D6 corresponding to the second group (pixel values D4, D5, and D6 corresponding to the three data line driver 102, 102, and 102 included in the source driver 222), of the pixel values of one horizontal line (n pixel values) every horizontal line. In addition, the amplifier voltage controller 25 includes a mapping table which shows a correspondence between the maximum pixel value and the voltage value of the amplifier voltage (e.g., those shown in FIGS. 4 and 12, etc.), and detects a voltage value mapped to the maximum pixel value DMx from the mapping table. Moreover, the amplifier voltage controller 25 controls the amplifier voltage supply 24 by the setting signals SET1, SET2, . . . , and SETp so that the amplifier voltage VAMPx supplied by the amplifier voltage supply 24 is set to a voltage value dependent on the maximum pixel value DMx. A control instruction is written into an X-th setting signal (hereinafter denoted as "setting signal SETx") of the setting signals SET1, SET2, . . . , and SETp to set the amplifier voltage VAMPx to a voltage value dependent on the maximum pixel value DMx.

[Example Configuration of Supply Section]

Figure 15:
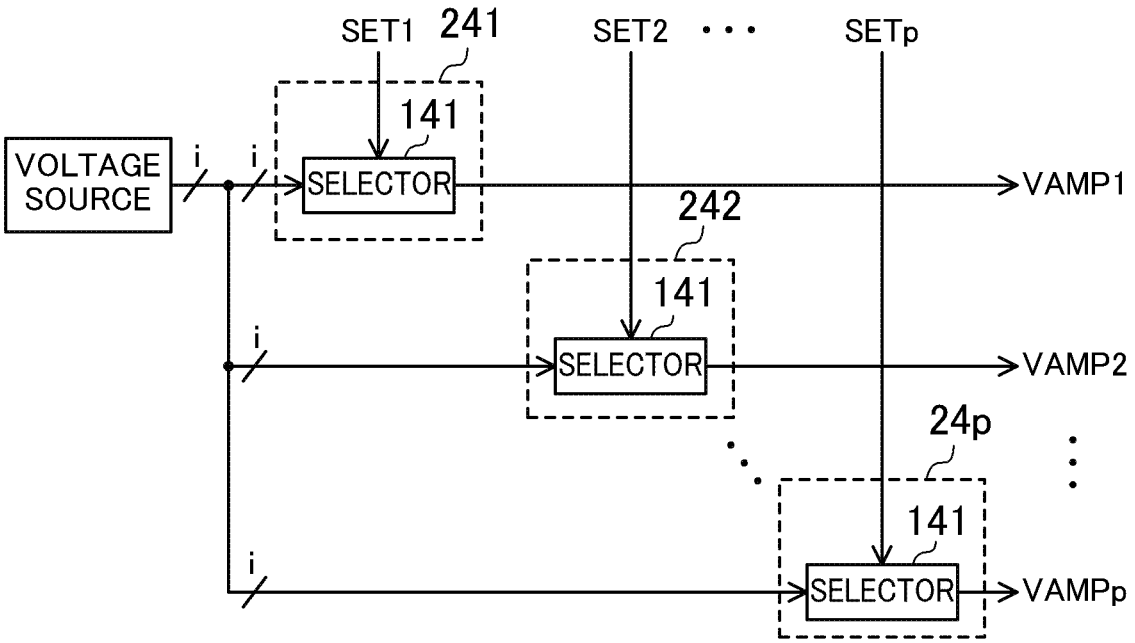
FIG. 15 is a diagram illustrating a first example configuration of the supply section shown in FIG. 14.
Figure 16:
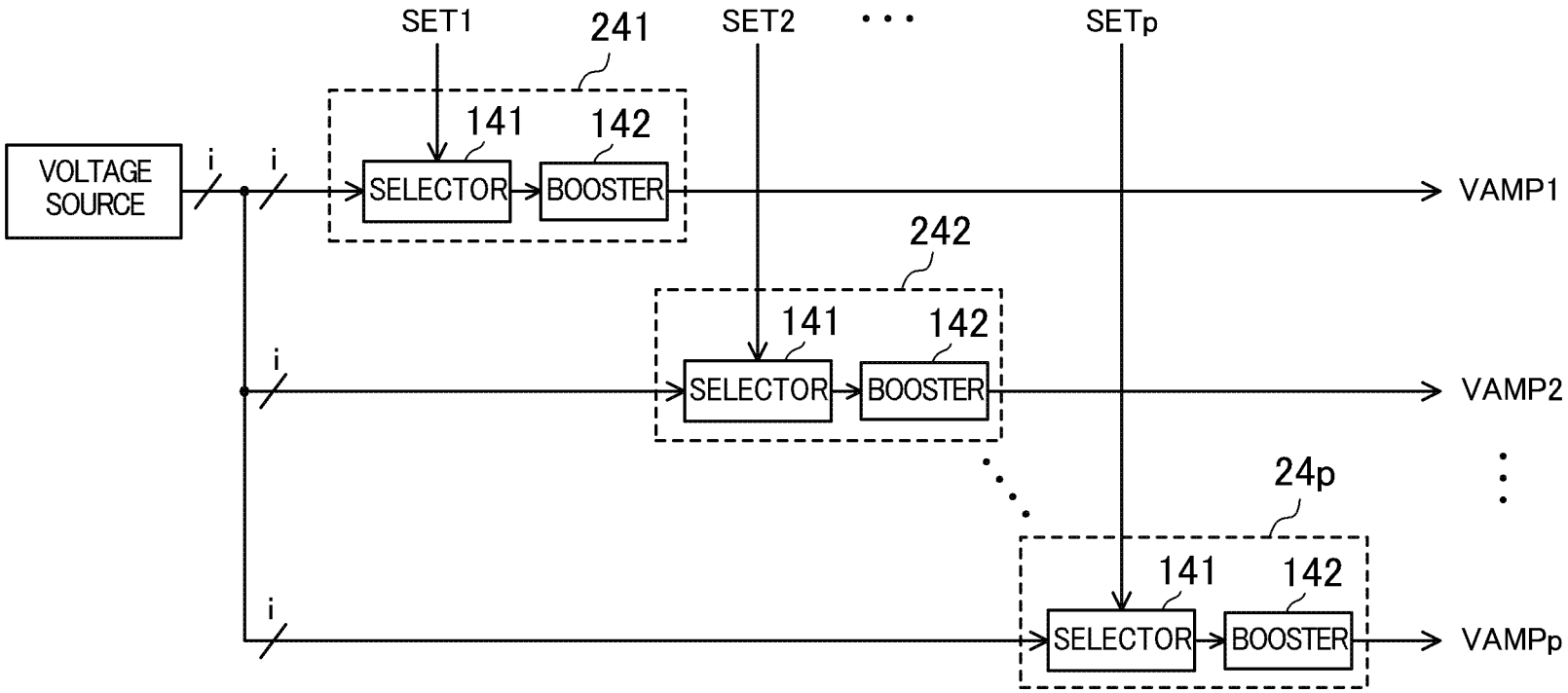
FIG. 16 is a diagram illustrating a second example configuration of the supply section shown in FIG. 14.
Figure 17:
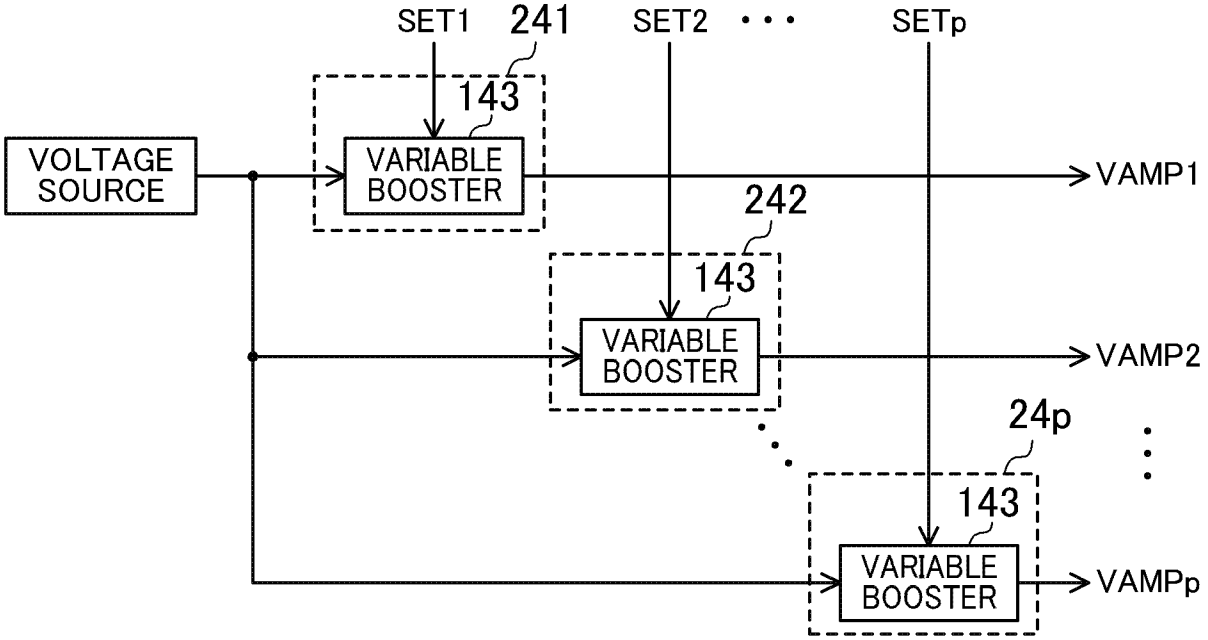
FIG. 17 is a diagram illustrating a third example configuration of the supply section shown in FIG. 14.

For example, as shown in FIG. 15, an X-th supply section (hereinafter denoted as "supply section 24*x*") of the p supply sections 241, 242, . . . , and 24*p* may include a selector 141, which selects an analog voltage corresponding to the maximum pixel value DMx from i analog voltages from a voltage source as the amplifier voltage VAMPx based on the setting signal SETx. Alternatively, as shown in FIG. 16, the supply section 24*x* may include a selector 141 and a booster 142, which generates the amplifier voltage VAMPx by raising the analog voltage selected by the selector 141. Further alternatively, as shown in FIG. 17, the supply section 24*x* may include a variable booster 143, which generates the amplifier voltage VAMPx by raising the analog voltage from the voltage source at a rate of voltage increase corresponding to the maximum pixel value DMx based on the setting signal SETx.

[Operation]

Figure 18:
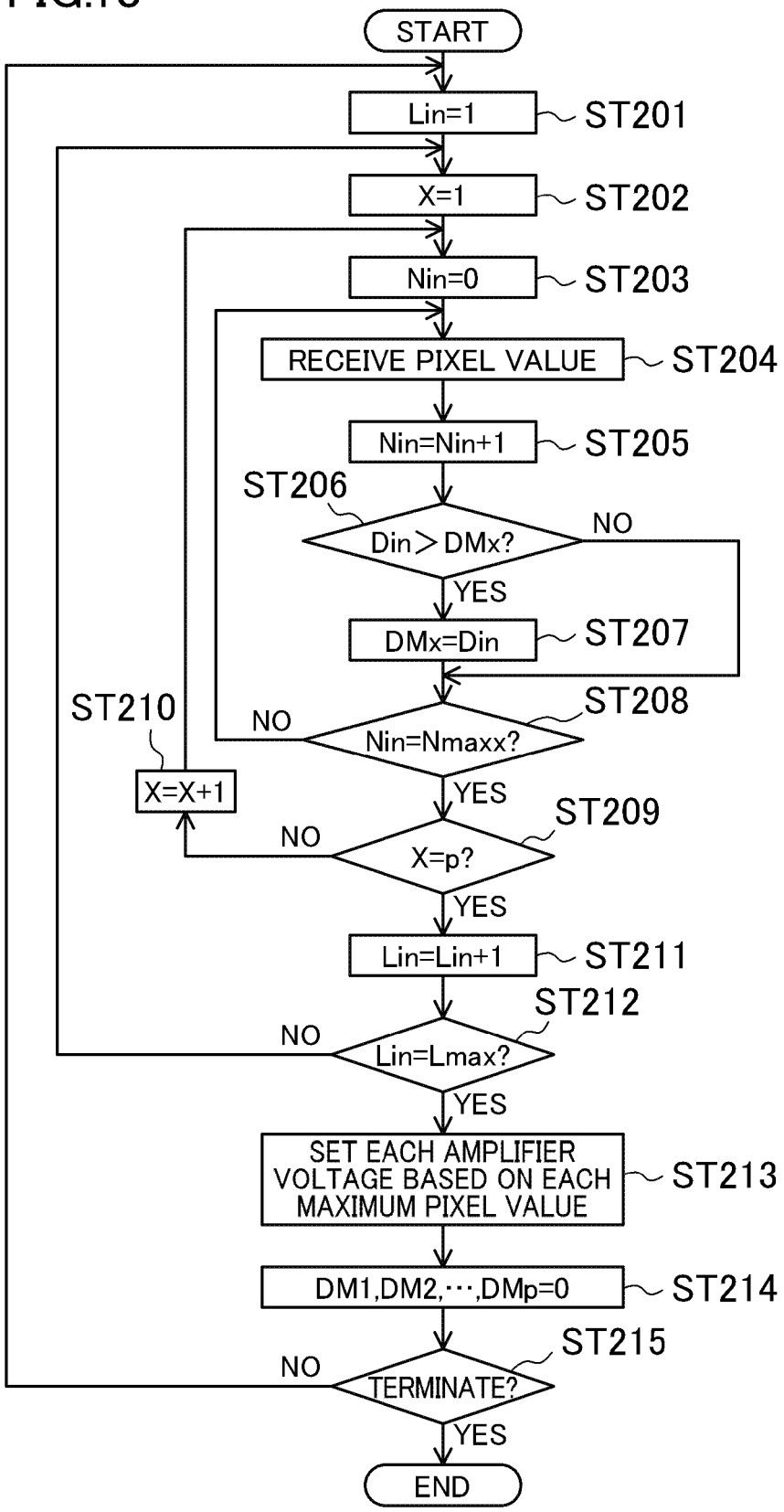
FIG. 18 is a diagram to explain an operation by the amplifier voltage controller shown in FIG. 13.

Next, referring to FIG. 18, the operation by the amplifier voltage controller 25 shown in FIG. 13 will be described. Here, the maximum line number Lmax is set to "q." The sum of p maximum pixel numbers Nmax1, Nmax2, . . . , and Nmaxp respectively corresponding to the p groups is equivalent to "n," and an X-th maximum pixel number (hereinafter denoted as "Nmaxx") is equivalent to the number of pixel values corresponding to the X-th group. It is assumed that the p maximum pixel values DM1, DM2, . . . , and DMp are each set to an initial value (=0). In addition, it is also assumed that the buffer 16 delays the pixel values Din, Din, . . . , and Din supplied to the drive voltage generator 2 for a delay time corresponding to (q−1) horizontal lines.

First, when pixel values of the h-th horizontal line start to be supplied to the drive voltage generator 2, the amplifier voltage controller 25 sets the input line number Lin to an initial value (=1) (ST201), sets the variable X to an initial value (=1) (ST202), and sets the input pixel number Nin to an initial value (=0) (ST203). Then, the amplifier voltage controller 25 receives the pixel value Din (ST204), and adds "1" to the input pixel number Nin (ST205).

Next, the amplifier voltage controller 25 determines whether the pixel value Din received at step ST204 is greater than the maximum pixel value DMx or not (ST206). If the pixel value Din is greater than the maximum pixel value DMx, the amplifier voltage controller 25 overwrites the maximum pixel value DMx with the pixel value Din (ST207). Meanwhile, if the pixel value Din is less than or equal to the maximum pixel value DMx, the amplifier voltage controller 25 does not overwrite the maximum pixel value DMx.

Next, the amplifier voltage controller 25 determines whether the input pixel number Nin has reached the maximum pixel number Nmaxx or not (ST208). If the input pixel number Nin has not yet reached the maximum pixel number Nmaxx, the amplifier voltage controller 25 receives the next pixel value Din (ST204).

If the input pixel number Nin has reached the maximum pixel number Nmaxx, the amplifier voltage controller 25 determines whether the variable X has reached the value "p" or not (ST209). If the variable X has not yet reached the value "p," the amplifier voltage controller 25 adds "1" to the variable X (ST210), sets the input pixel number Nin to the initial value (=0) (ST203), and receives the next pixel value Din (ST204).

If the variable X has reached the value "p," the amplifier voltage controller 25 adds "1" to the input line number Lin (ST211), and determines whether the input line number Lin has reached the maximum line number Lmax (ST212). If the input line number Lin has not yet reached the maximum line number Lmax, the amplifier voltage controller 25 sets the variable X to the initial value (=1) (ST202), sets the input pixel number Nin to the initial value (=0) (ST203), and receives the next pixel value Din (ST204). In this way, the p maximum pixel values DM1, DM2, . . . , and DMp are detected.

If the input line number Lin has reached the maximum line number Lmax, the amplifier voltage controller 25 sets the amplifier voltage VAMPx to a voltage value dependent on the maximum pixel value DMx during an interval from a completion of a display process of the (h−1)-th horizontal line to a start of a display process of the h-th horizontal line (e.g., in a horizontal blanking interval of the (h−1)-th horizontal line) (ST213). Thus, the amplifier voltages VAMP1, VAMP2, . . . , and VAMPp are respectively set to the voltage values dependent on the maximum pixel values DM1, DM2, . . . , and DMp.

Next, the amplifier voltage controller 25 sets the p maximum pixel values DM1, DM2, . . . , and DMp to an initial value (=0) (ST214), and determines whether to terminate the process or not (ST215). If there still remain unprocessed pixel values, then the amplifier voltage controller 25 continues the maximum value detection process (ST201-ST212) and the amplifier voltage setting process (ST213). Meanwhile, if unprocessed pixel values no longer exist, then the amplifier voltage controller 25 terminates the process.

The amplifier voltage controller 25 may start the maximum value detection process (ST201-ST212) in response to the h-th pulse of the horizontal synchronization signal (or the (h−1)-th load pulse LD), and may perform steps ST204 and ST205 in synchronism with the clock CLK. Moreover, the amplifier voltage controller 25 may perform the amplifier voltage setting process (ST213) and steps ST214 and ST215 in response to the (h+q)-th pulse of the horizontal synchronization signal (or the (h+q−1)-th load pulse LD).

Specific Example

Figure 19:
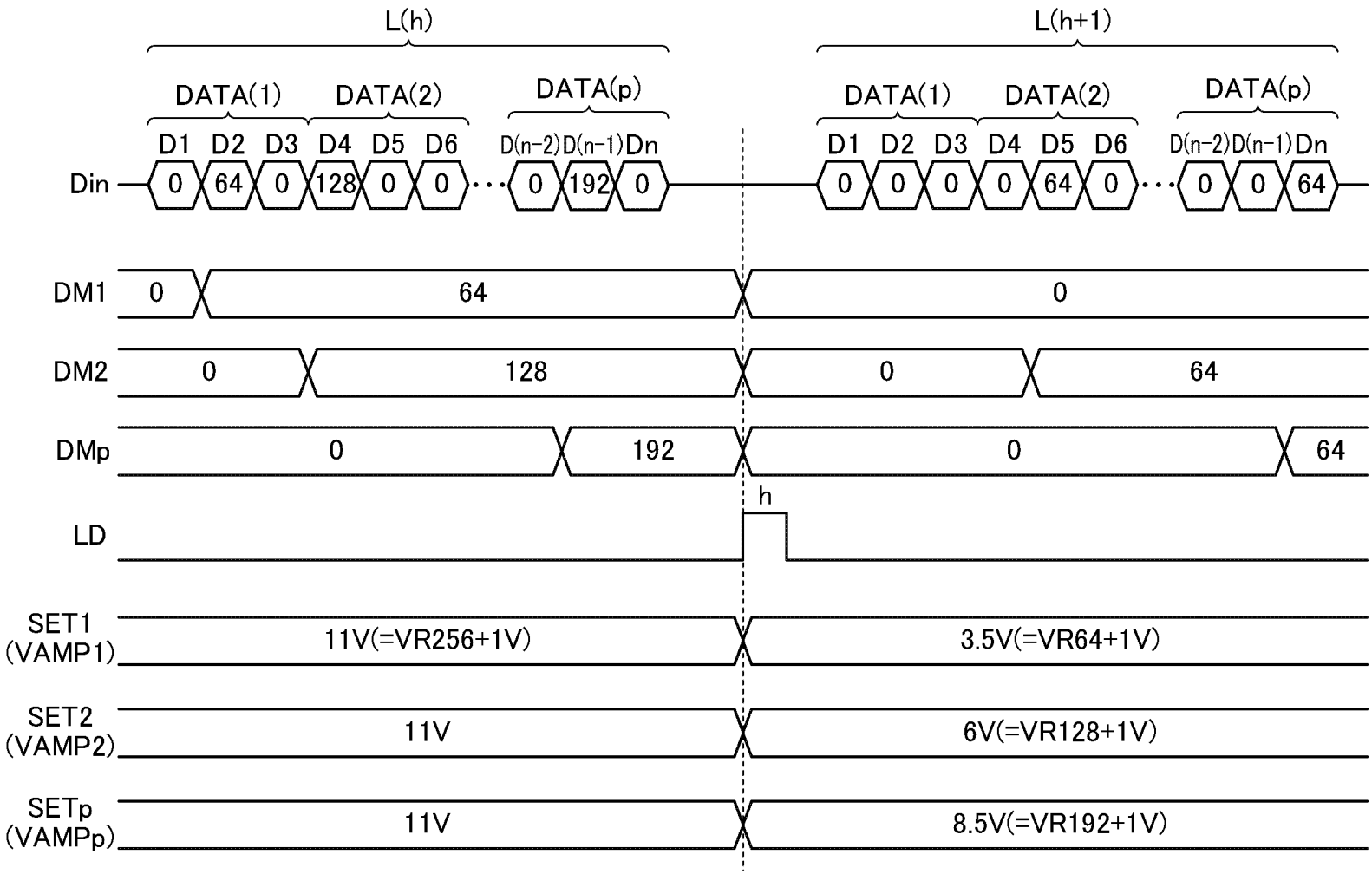
FIG. 19 is a diagram to explain a specific example of the operation by the amplifier voltage controller shown in FIG. 13.

Next, referring to FIG. 19, a specific example of the operation by the amplifier voltage controller 25 shown in FIG. 13 will be described. Here, the amplifier voltage controller 25 performs the maximum value detection process and the amplifier voltage setting process based on the pixel values of one horizontal line every horizontal line. In this case (when q=1), the drive voltage generator 2 does not need to include the buffer 16. The p groups (source drivers 221, 222, . . . , and 22*p*) respectively correspond to p pixel value sets DATA(1), DATA(2), . . . , and DATA(p) each including three pixel values. That is, the maximum line number Lmax is set to "1," and the p maximum pixel numbers Nmax1, Nmax2, . . . , and Nmaxp are each set to "3." Here, in the h-th horizontal line L(h), the pixel value D2 represents "64," the pixel value D4 represents "128," the pixel value D(n−1) represents "192," and the pixel values other than these pixel values represent "0." In addition, it is assumed that the voltage values of the amplifier voltages VAMP1, VAMP2, . . . , and VAMPp (voltage values indicated in the setting signals SET1, SET2, . . . , and SETp) are each set to a voltage value "11 V" corresponding to the maximum pixel value "256."

Upon receiving the pixel value D2 of the horizontal line L(h), the amplifier voltage controller 25 overwrites the first maximum pixel value DM1 with the value "64." Upon receiving the pixel value D4, the amplifier voltage controller 25 overwrites the second maximum pixel value DM2 with the value "128." Upon receiving the pixel value D(n−1), the amplifier voltage controller 25 overwrites the p-th maximum pixel value DMp with the value "192." Next, in response to the h-th load pulse LD, the amplifier voltage controller 25 changes the amplifier voltages VAMP1, VAMP2, . . . , and VAMPp from the voltage value "11 V," which corresponds to the maximum pixel value "256," respectively to voltage values "3.5 V," "6 V," . . . , and "8.5 V," which correspond to the maximum pixel values "64," "128," . . . , and "192."

Thus, individually controlling the p amplifier voltages VAMP1, VAMP2, . . . , and VAMPp allows the power consumption of the amplifiers 103, 103, . . . , and 103 to be reduced on a per group basis. As a result, the power consumption of the drive voltage generator 2 can be further reduced.

The amplifier voltage controller 25 may perform the maximum value detection process (ST201-ST212) and the amplifier voltage setting process (ST213) based on the pixel values of g (where g≥1) frames (n·m·g pixel values) every g frames. In such a case, the buffer 16 may delay the pixel values Din, Din, . . . , and Din supplied to the drive voltage generator 2 for a delay time corresponding to g frames. In addition, the maximum line number Lmax may be set to "m·g," and the amplifier voltage controller 25 may start the maximum value detection process when the pixel values of the h-th frame start to be supplied to the drive voltage generator 2. For example, the amplifier voltage controller 25 may start the maximum value detection process in response to the h-th pulse of the vertical synchronization signal. Moreover, the amplifier voltage controller 25 may perform the amplifier voltage setting process during an interval from a completion of a display process of the (h−1)-th frame to a start of a display process of the h-th frame. For example, the amplifier voltage controller 25 may perform the amplifier voltage setting process in response to the (h+g)-th pulse of the vertical synchronization signal.

Moreover, the n data line drivers 102, 102, . . . , and 102, and the n amplifiers 103, 103, . . . , and 103 do not necessarily need to be grouped on the basis of source drivers. For example, n data line drivers and n amplifiers included in one source driver may be grouped into p groups. Furthermore, the numbers of the data line drivers and the numbers of the amplifiers belonging to the respective groups may be different in the p groups. For example, grouping may be such that the first group includes one data line driver 102 and one amplifier 103, and the second group includes two data line drivers 102 and 102 and two amplifiers 103 and 103. Note that if an X-th group includes only a single data line driver 102, and the maximum value detection process and the amplifier voltage setting process are performed based on the pixel values of one horizontal line every horizontal line (when q=1), then the amplifier voltage controller 25 detects the pixel value supplied to the data line driver 102 belonging to the X-th group among the n pixel values supplied to the drive voltage generator 2, as the X-th maximum pixel value DMx.

The p supply sections 241, 242, . . . , and 24*p* may be included respectively in the p source drivers 221, 222, . . . , and 22*p*.

Variation of Second Embodiment

Figure 20:
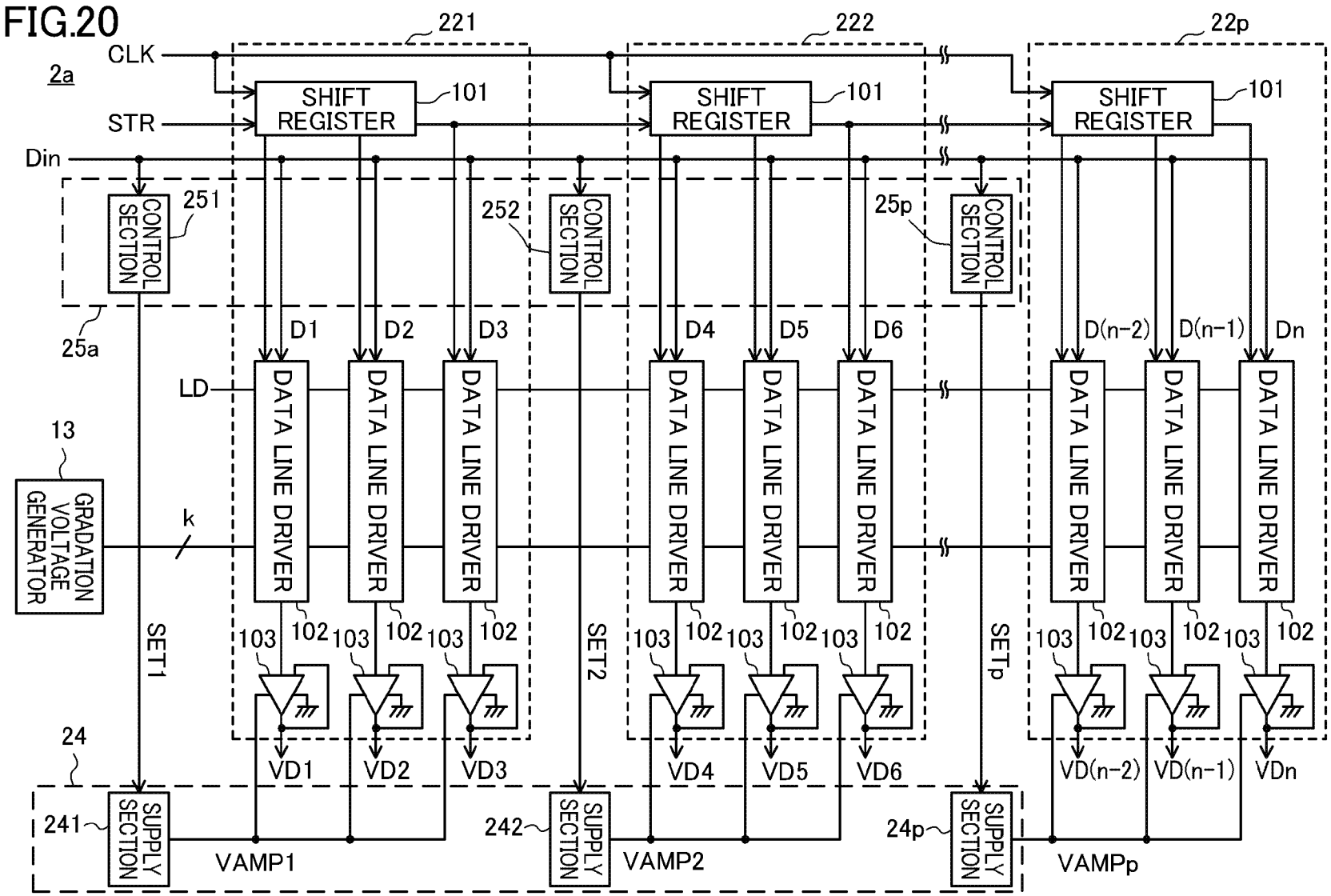
FIG. 20 is a diagram to explain a variation of the drive voltage generator shown in FIG. 13.

The amplifier voltage controller 25 shown in FIG. 13 may be replaced with an amplifier voltage controller 25*a* shown in FIG. 20. In a drive voltage generator 2*a* shown in FIG. 20, the amplifier voltage controller 25*a* includes p control sections 251, 252, . . . , and 25*p* respectively corresponding to the p groups (here, p source drivers 221, 222, . . . , and 22*p*). Note that the drive voltage generator 2*a* does not need to include the buffer 16.

Each of the control sections 251, 252, . . . , and 25*p* performs the maximum value detection process and the amplifier voltage setting process based on the pixel values of one horizontal line every horizontal line. That is, an X-th control section (hereinafter denoted as "control section 25*x*") of the control sections 251, 252, . . . , and 25*p* detects an X-th maximum pixel value DMx among one or more pixel values corresponding to the X-th group, of n pixel values supplied to the drive voltage generator 2*a*. More specifically, if the X-th group includes two or more data line drivers, the control section 25*x* detects the maximum pixel value DMx in two or more pixel values supplied to the two or more data line drivers belonging to the X-th group, of n pixel values supplied to the drive voltage generator 2*a*. Meanwhile, if the X-th group includes only a single data line driver, the control section 25*x* detects the pixel value supplied to the data line driver belonging to the X-th group as the maximum pixel value DMx.

In addition, each of the control sections 251, 252, . . . , and 25*p* includes a mapping table which shows a correspondence between the maximum pixel value and the voltage value of the amplifier voltage (e.g., those shown in FIGS. 4 and 12, etc.), and the control section 25*x* detects a voltage value mapped to the maximum pixel value DMx from the mapping table. Moreover, the control section 25*x* controls the supply section 24*x* by an X-th setting signal SETx so that the X-th amplifier voltage VAMPx supplied by the X-th supply section 24*x* is set to a voltage value dependent on the maximum pixel value DMx.

[Operation]

Next, referring to FIG. 18, the operation by each of the control sections 251, 252, . . . , and 25*p* shown in FIG. 20 will be described. Here, each of the control sections 251, 252, . . . , and 25*p* skips steps ST201, ST202, and ST209-ST212 shown in FIG. 18, and performs steps ST203-ST208 and ST213-ST215. The maximum pixel numbers Nmax1, Nmax2, . . . , and Nmaxp are respectively set in the control sections 251, 252, . . . , and 25*p*, and the sum thereof is equivalent to "n." The control sections 251, 252, . . . , and 25*p* respectively detect the maximum pixel values DM1, DM2, . . . , and DMp, and it is assumed that the maximum pixel values DM1, DM2, . . . , and DMp are each set to an initial value (=0).

First, when pixel values of the h-th horizontal line start to be supplied to the drive voltage generator 2*a*, the control section 25*x* sets the input pixel number Nin to an initial value (=0) (ST203), receives the pixel value Din corresponding to the X-th group (ST204), and adds "1" to the input pixel number Nin (ST205).

Next, the control section 25*x* determines whether the pixel value Din received at step ST204 is greater than the maximum pixel value DMx or not (ST206). If the pixel value Din is greater than the maximum pixel value DMx, the control section 25*x* overwrites the maximum pixel value DMx with the pixel value Din (ST207). Meanwhile, if the pixel value Din is less than or equal to the maximum pixel value DMx, the control section 25*x* does not overwrite the maximum pixel value DMx.

Next, the control section 25*x* determines whether the input pixel number Nin has reached the maximum pixel number Nmaxx or not (ST208). If the input pixel number Nin has not yet reached the maximum pixel number Nmaxx, the control section 25*x* receives the next pixel value Din (ST204).

If the input pixel number Nin has reached the maximum pixel number Nmaxx, the control section 25*x* sets the amplifier voltage VAMPx to the voltage value dependent on the maximum pixel value DMx during an interval from a completion of a display process of the (h−1)-th horizontal line to a start of a display process of the h-th horizontal line (ST213).

Next, the control section 25*x* sets the maximum pixel value DMx to an initial value (=0) (ST214), and determines whether to terminate the process or not (ST215). If there still remain unprocessed pixel values, then the control section 25*x* continues the maximum value detection process (ST203-ST208) and the amplifier voltage setting process (ST213). Meanwhile, if unprocessed pixel values no longer exist, then the control section 25*x* terminates the process.

The control section 25*x* may start the maximum value detection process (ST203-ST208) in response to a start pulse STR supplied to the X-th source driver 22*x* (start pulse STR transferred from the (X−1)-th source driver), and may perform steps ST204 and ST205 in synchronism with the clock CLK. Moreover, the control section 25*x* may perform the amplifier voltage setting process (ST213) and steps ST214 and ST215 in response to the (h+1)-th pulse of the horizontal synchronization signal (or the h-th load pulse LD).

Such a configuration also allows the p amplifier voltages VAMP1, VAMP2, . . . , and VAMPp to be controlled individually, thereby allowing the power consumption of the amplifiers 103, 103, . . . , and 103 to be reduced on a per group basis. As such, the power consumption of the drive voltage generator 2*a* can be reduced. Moreover, the p supply sections 241, 242, . . . , and 24*p*, and the p control sections 251, 252, . . . , and 25*p* may be included respectively in the p source drivers 221, 222, . . . , and 22*p*.

Third Embodiment

Figure 21:
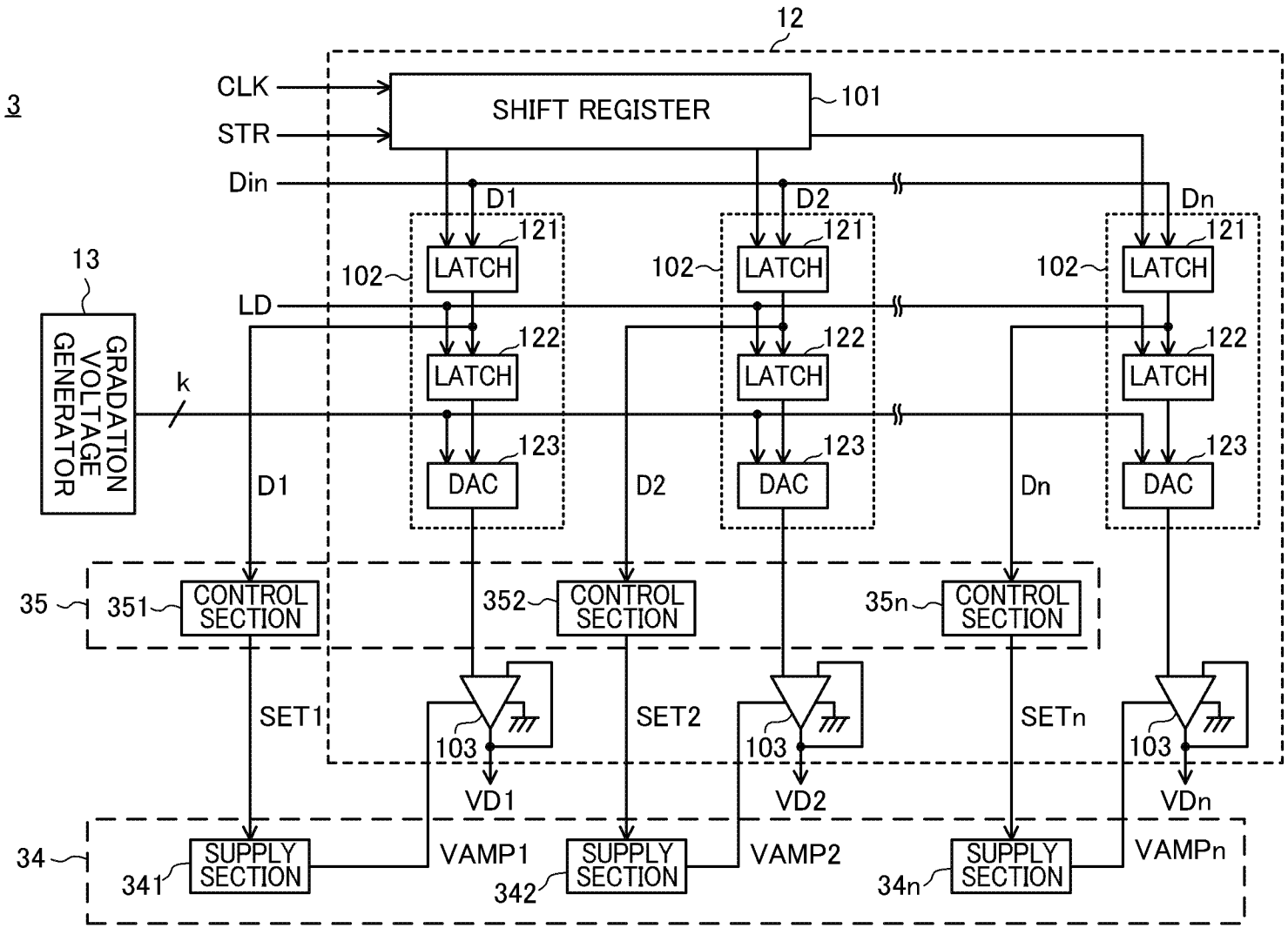
FIG. 21 is a diagram illustrating an example configuration of a drive voltage generator according to the third embodiment.

FIG. 21 illustrates an example configuration of a drive voltage generator 3 according to the third embodiment. The drive voltage generator 3 includes a source driver 12, a gradation voltage generator 13, an amplifier voltage supply 34, and an amplifier voltage controller 35. The amplifier voltage supply 34 includes n supply sections 341, 342, . . . , and 34*n* corresponding to the n amplifiers 103, 103, . . . , and 103. The amplifier voltage controller 35 includes n control sections 351, 352, . . . , and 35*n* corresponding to the n data line drivers 102, 102, . . . , and 102.

[Supply Section]

The n supply sections 341, 342, . . . , and 34*n* respectively supply n amplifier voltages VAMP1, VAMP2, . . . , and VAMPn. The voltage values of the amplifier voltages VAMP1, VAMP2, . . . , and VAMPn generated by the supply sections 341, 342, . . . , and 34*n* can be respectively changed by setting signals SET1, SET2, . . . , and SETn from the control sections 351, 352, . . . , and 35*n*. Of the amplifier voltages VAMP1, VAMP2, . . . , and VAMPn, an X-th amplifier voltage (hereinafter denoted as "amplifier voltage VAMPx") is a voltage for driving an X-th amplifier 103 corresponding to an X-th supply section (hereinafter denoted as "supply section 34*x*") of the supply sections 341, 342, . . . , and 34*n*. Note that 1≤X≤n and 1≤x≤n.

[Control Section]

The n control sections 351, 352, . . . , and 35*n* respectively correspond to the n supply sections 341, 342, . . . , and 34*n*. Each of the control sections 351, 352, . . . , and 35*n* performs the maximum value detection process and the amplifier voltage setting process based on the pixel values of one horizontal line every horizontal line. That is, an X-th control section (hereinafter denoted as "control section 35*x*") of the control sections 351, 352, . . . , and 35*n* detects the pixel value supplied to an X-th data line driver 102 (pixel value received by the latch 121 of the X-th data line driver 102), among the n pixel values supplied to the drive voltage generator 3, as the X-th maximum pixel value DMx. In addition, each of the control sections 351, 352, . . . , and 35*n* includes a mapping table which shows a correspondence between the maximum pixel value DM and the voltage value of the amplifier voltage (e.g., those shown in FIGS. 4 and 12, etc.), and the control section 35*x* detects a voltage value mapped to the maximum pixel value DMx from the mapping table. Moreover, the control section 35*x* controls the supply section 34*x* by an X-th setting signal SETx so that the X-th amplifier voltage VAMPx supplied by the X-th supply section 34*x* is set to a voltage value dependent on the maximum pixel value DMx (i.e., pixel value supplied to the X-th data line driver 102).

[Example Configuration of Supply Section]

Figure 22:
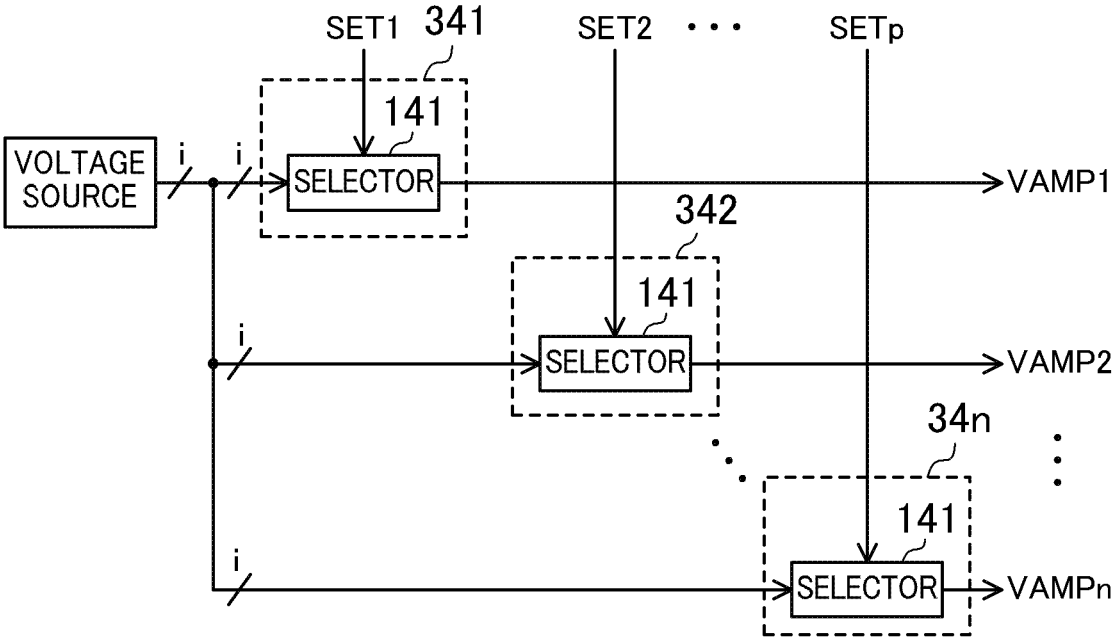
FIG. 22 is a diagram illustrating an example configuration of the supply section shown in FIG. 21.

For example, as shown in FIG. 22, the supply section 34*x* may include a selector 141, which selects an analog voltage corresponding to the X-th maximum pixel value DMx (i.e., the pixel value supplied to the X-th data line driver 102) from i analog voltages from a voltage source as the amplifier voltage VAMPx based on the setting signal SETx from the control section 35*x*.

[Operation]

Figure 23:
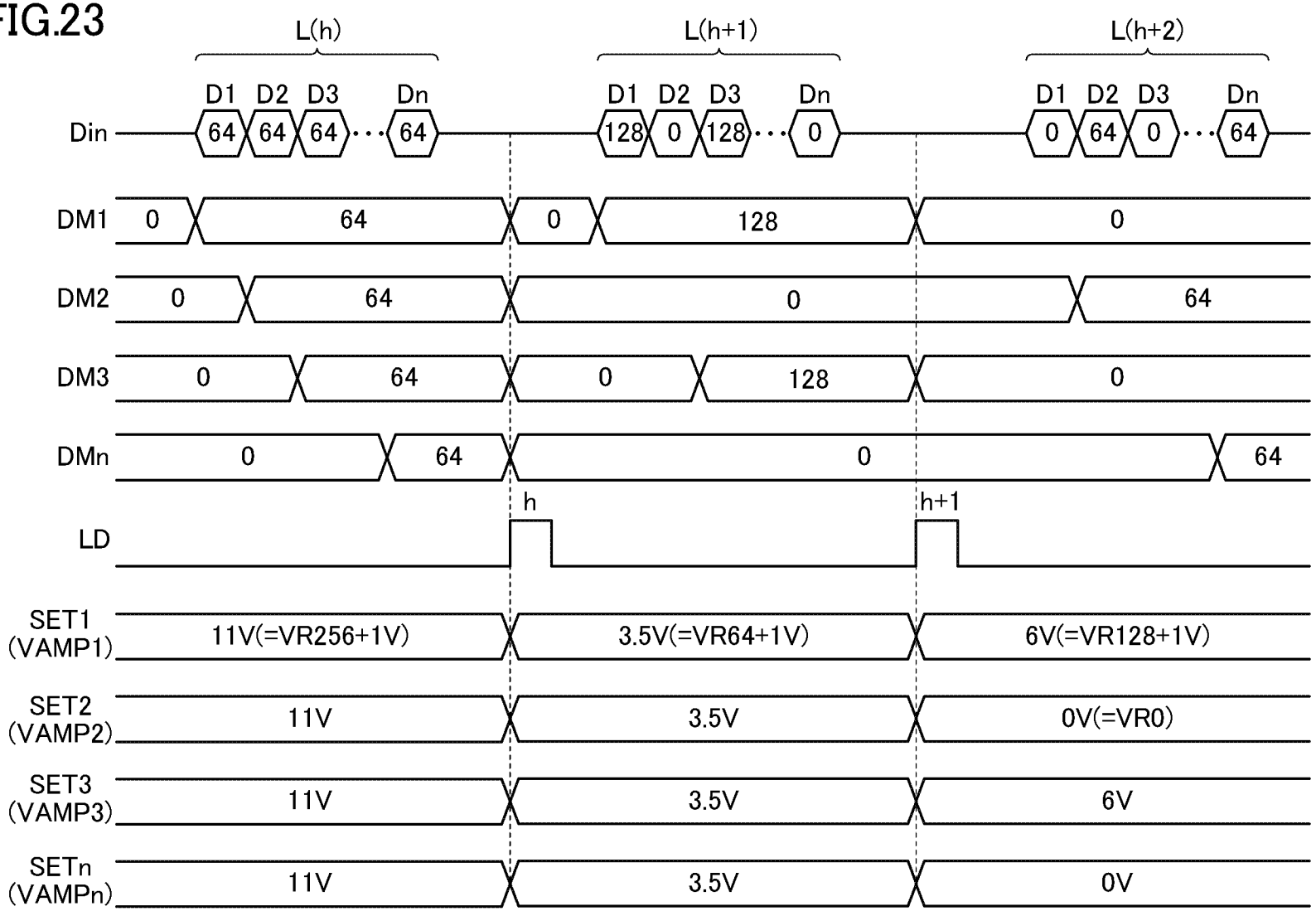
FIG. 23 is a diagram to explain an operation by the amplifier voltage controller shown in FIG. 21.

Next, referring to FIG. 23, the operation by each of the control sections 351, 352, . . . , and 35*n* shown in FIG. 21 will be specifically described. Here, the pixel values D1, D2, . . . , and Dn of the h-th horizontal line L(h) each represent "64." In addition, it is assumed that the voltage values of the amplifier voltages VAMP1, VAMP2, . . . , and VAMPn (voltage values indicated in the setting signals SET1, SET2, . . . , and SETn) are each set to a voltage value "11 V" corresponding to the maximum pixel value "256."

When the n data line drivers 102, 102, . . . , and 102 respectively receive the pixel values D1, D2, . . . , and Dn of the horizontal line L(h), the control sections 351, 352, . . . , and 35*n* respectively set the maximum pixel values DM1, DM2, . . . , and DMn to the value "64." Next, the control sections 351, 352, . . . , and 35*n* respectively set the amplifier voltages VAMP1, VAMP2, . . . , and VAMPn to a voltage value "3.5 V" corresponding to the maximum pixel value "64" during an interval from a completion of a display process of the (h−1)-th horizontal line to a start of a display process of the h-th horizontal line. In addition, the control sections 351, 352, . . . , and 35*n* respectively set the maximum pixel values DM1, DM2, . . . , and DMn to an initial value (=0). For example, the control sections 351, 352, . . . , and 35*n* may respectively perform setting processes of the amplifier voltages VAMP1, VAMP2, . . . , and VAMPn, and initialization processes of the maximum pixel values DM1, DM2, . . . , and DMn in response to the h-th load pulse LD (or the (h+1)-th pulse of the horizontal synchronization signal).

Figure 24:
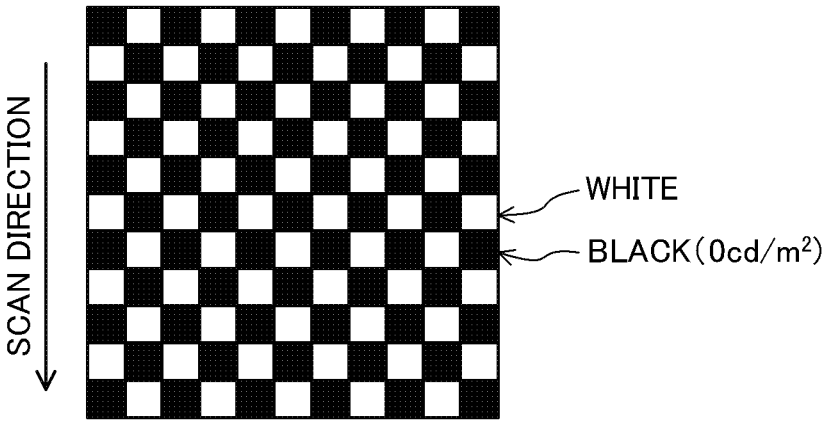
FIG. 24 is a diagram to explain an image having a checkered pattern.

Thus, individually controlling the n amplifier voltages VAMP1, VAMP2, . . . , and VAMPn allows the power consumption of the amplifiers 103, 103, . . . , and 103 to be reduced on a per amplifier basis. As a result, the power consumption of the drive voltage generator 3 can be further reduced. In particular, this configuration is advantageous in a case in which an image having a checkered pattern as shown in FIG. 24 is displayed on the OEL panel 10 (a case in which pixel values are different in adjacent pixels). Note that the supply sections 341, 342, . . . , and 34*n* and the control sections 351, 352, . . . , and 35*n* may be included in the source driver 12.

Fourth Embodiment

Figure 25:
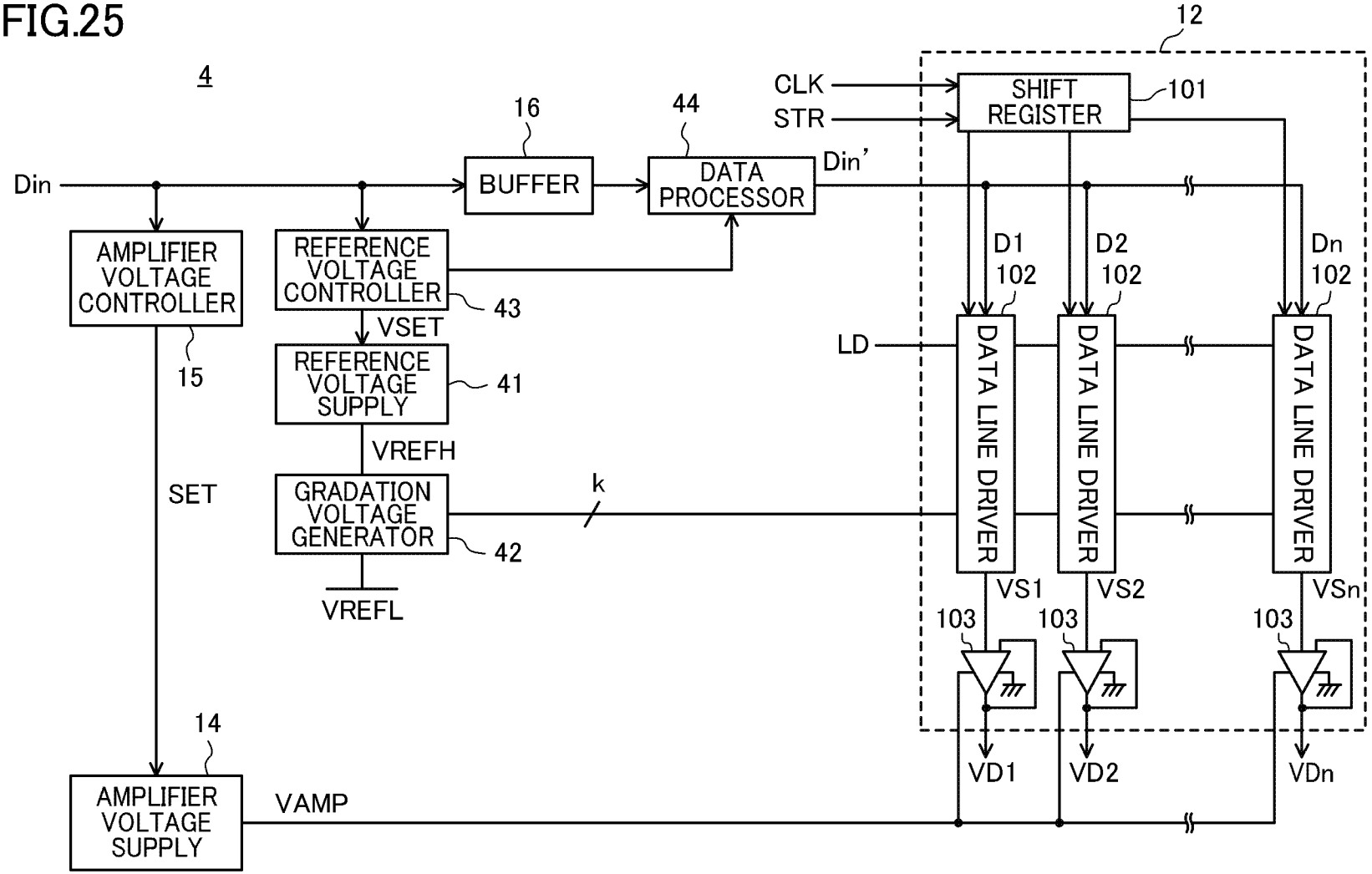
FIG. 25 is a diagram illustrating an example configuration of a drive voltage generator according to the fourth embodiment.

FIG. 25 illustrates an example configuration of a drive voltage generator 4 according to the fourth embodiment. The drive voltage generator 4 includes, instead of the gradation voltage generator 13 shown in FIG. 1, a reference voltage supply 41, a gradation voltage generator 42, a reference voltage controller 43, and a data processor 44. The other part of the configuration is similar to that of the drive voltage generator 1 shown in FIG. 1.

[Reference Voltage Supply]

The reference voltage supply 41 supplies a reference voltage VREFH. The voltage value of the reference voltage VREFH supplied by the reference voltage supply 41 can be changed by a setting signal VSET from the reference voltage controller 43.

[Gradation Voltage Generator]

The gradation voltage generator 42 generates k gradation voltages based on the reference voltage VREFH. For example, the gradation voltage generator 42 includes a resistor ladder, which subjects the reference voltage VREFH and a reference voltage VREFL (e.g., 0 V) to resistance division. Here, if the reference voltage VREFH is set to a predetermined reference voltage value VHR, a predetermined reference correspondence is established between the pixel value and the voltage value of the drive voltage VD (voltage value of the gradation voltage). For example, if the reference voltage VREFH is set to "10 V," a reference correspondence as shown in FIG. 3A is established between the pixel value and the voltage value of the drive voltage VD. In such a case, the reference voltage VREFH corresponds to the gradation voltage VR256 (=10 V), and the reference voltage VREFL corresponds to the gradation voltage VR0 (=0 V).

[Reference Voltage Controller]

Figure 26:
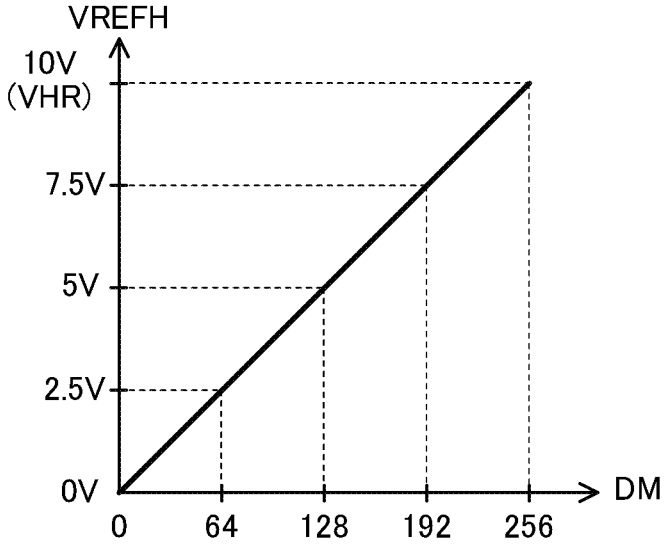
FIG. 26 is a diagram to explain a correspondence between the maximum pixel value and the voltage value of the reference voltage.

The reference voltage controller 43 detects the maximum pixel value DM among n·r (where r≥1) pixel values Din, Din, . . . , and Din supplied to the drive voltage generator 4. The maximum value detection process by the reference voltage controller 43 is similar to the maximum value detection process (ST101-ST106) by the amplifier voltage controller 15. In addition, the reference voltage controller 43 includes a mapping table which shows a correspondence between the maximum pixel value DM and the voltage value of the reference voltage VREFH, and detects a voltage value mapped to the maximum pixel value DM from the mapping table. For example, if the reference voltage VREFH is set to the reference voltage value VHR (=10 V), a reference correspondence as shown in FIG. 3A is established between the pixel value and the voltage value of the drive voltage VD; and if the voltage value of the reference voltage VREFH can be switched in k steps (257 steps), then the reference voltage controller 43 may include a mapping table which shows a correspondence as shown in FIG. 26. In FIG. 26, 257 voltage values correspond on a one-to-one basis to the 257 maximum pixel values, and a t-th (where 0≤t≤k−1) voltage value corresponds to "10 V·t/256" (=VHR·t/256). For example, the zeroth maximum pixel value "0" is mapped to a voltage value "0 V," and the 256th maximum pixel value "256" is mapped to the reference voltage value VHR (=10 V).

Moreover, the reference voltage controller 43 controls the reference voltage supply 41 by the setting signal VSET so that the reference voltage VREFH supplied by the reference voltage supply 41 is set to a voltage value dependent on the maximum pixel value DM (maximum pixel value detected by the reference voltage controller 43). A control instruction is written into the setting signal VSET to set the reference voltage VREFH to a voltage value dependent on the maximum pixel value DM. Note that the reference voltage setting process by the reference voltage controller 43 is similar to the amplifier voltage setting process (ST107) by the amplifier voltage controller 15.

[Example Configuration of Reference Voltage Supply]

Figure 27:
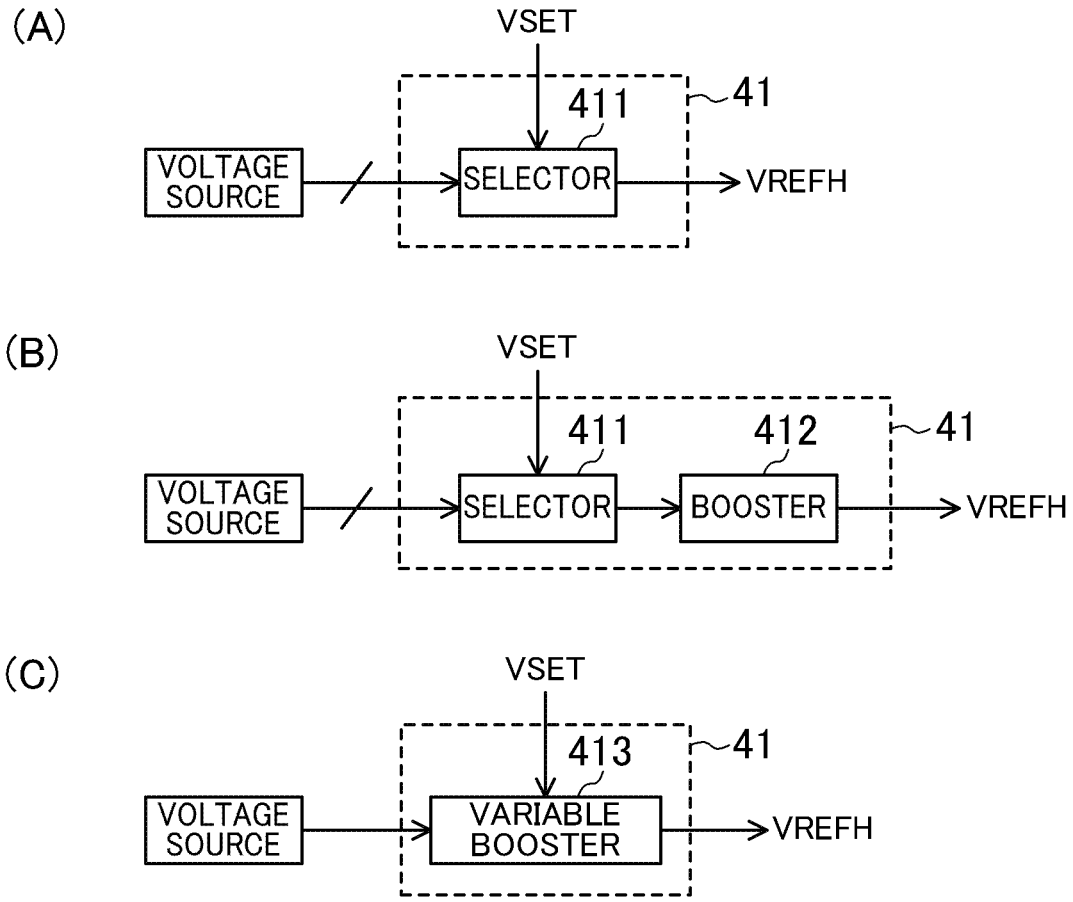
FIGS. 27A-27C are diagrams each illustrating an example configuration of the reference voltage supply shown in FIG. 25.

For example, as shown in FIG. 27A, the reference voltage supply 41 may include a selector 411, which selects a voltage corresponding to the maximum pixel value DM from a plurality of analog voltages from a voltage source as the reference voltage VREFH based on the setting signal VSET. In such a case, a control instruction is written into the setting signal VSET to select an analog voltage having a voltage value dependent on the maximum pixel value DM. Alternatively, as shown in FIG. 27B, the reference voltage supply 41 may include a selector 411 and a booster 412, which generates the reference voltage VREFH by raising the analog voltage selected by the selector 411. Further alternatively, as shown in FIG. 27C, the reference voltage supply 41 may include a variable booster 413 (e.g., switching regulator, etc.), which generates the reference voltage VREFH by raising the analog voltage from a voltage source at a rate of voltage increase corresponding to the maximum pixel value DM. In such a case, a control instruction is written into the setting signal VSET to set the rate of voltage increase of the variable booster 413 to a ratio of the voltage value dependent on the maximum pixel value DM with respect to the voltage value of the analog voltage.

[Data Processor]

The data processor 44 processes the n·r pixel values Din, Din, . . . , and Din (here, the n·r pixel values Din, Din, . . . , and Din from the buffer 16) supplied to the drive voltage generator 4 depending on a ratio between a voltage value (setting voltage value) of the reference voltage VREFH set by the reference voltage controller 43 and the predetermined reference voltage value VHR, and supplies the processed n·r pixel values Din', Din', . . . , and Din' to the n data line drivers 102, 102, . . . , and 102. For example, the data processor 44 multiplies the n·r pixel values Din, Din, . . . , and Din each by a ratio of the reference voltage value VHR to the setting voltage value (reference voltage value VHR/setting voltage value), thereby generates the processed n·r pixel values Din', Din', . . . , and Din'.

[Operation]

Figure 28:
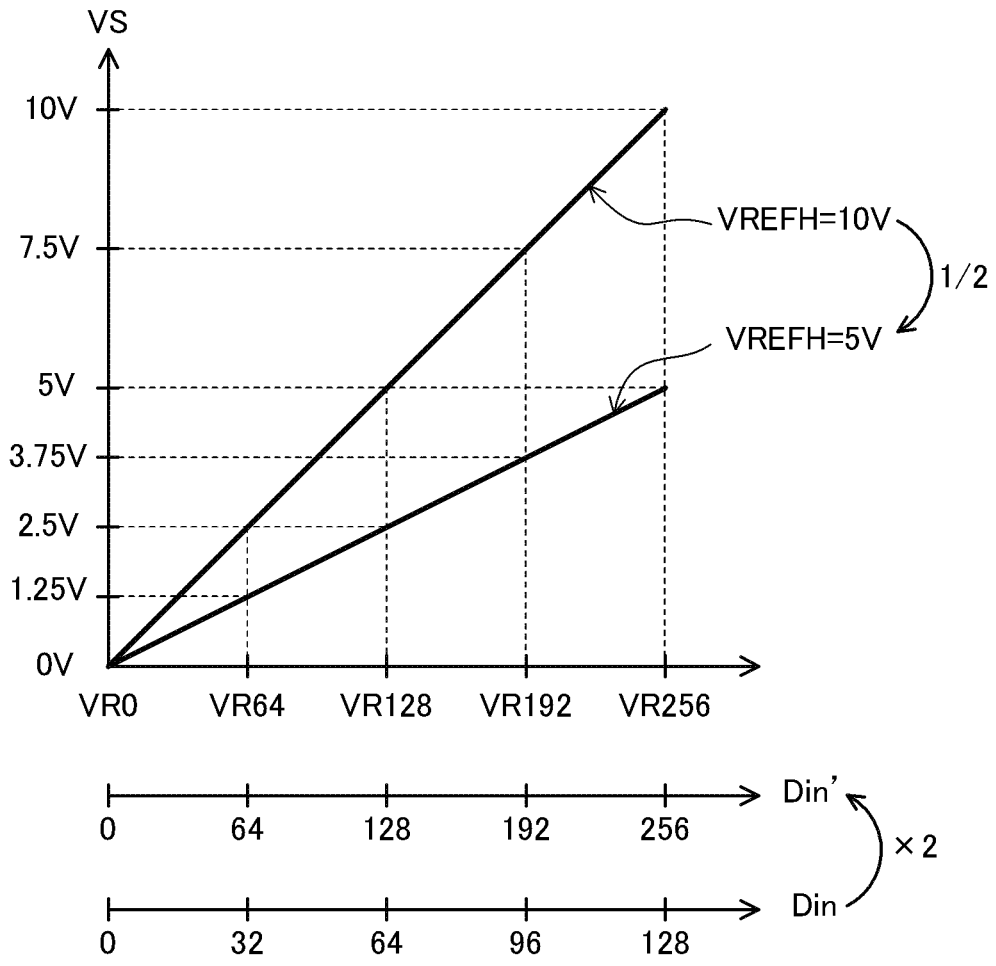
FIG. 28 is a diagram to explain an operation by the drive voltage generator shown in FIG. 25.

Next, referring to FIG. 28, the operation by the drive voltage generator 4 shown in FIG. 25 will be described. Here, it is assumed that k=257 and VHR=10 V, and that if the reference voltage VREFH is set to the reference voltage value VHR, a reference correspondence as shown in FIG. 3A is established between the pixel value and the voltage value of the drive voltage VD (voltage value of the selection voltage VS).

If the reference voltage VREFH is set to "10 V" (=VHR), the gradation voltages VR0, VR64, VR128, VR192, and VR256 are respectively 0 V, 2.5 V, 5 V, 7.5 V, and 10 V. In such a case, "reference voltage value VHR/setting voltage value"=1, and therefore the data processor 44 directly outputs the n·r pixel values Din, Din, . . . , and Din as the processed n·r pixel values Din', Din', . . . , and Din'. Accordingly, if the pixel values Din are 0, 64, and 128, then the data line drivers 102 respectively select the gradation voltages VR0, VR64, and VR128 as the selection voltages VS, and thus the drive voltages VD generated by the amplifiers 103 are respectively 0 V (=VR0), 2.5 V (=VR64), and 5 V (=VR128).

Meanwhile, if the reference voltage VREFH is set to "5 V" (=VHR/2), the gradation voltages VR0, VR64, VR128, VR192, and VR256 are respectively 0 V, 1.25 V, 2.5 V, 3.75 V, and 5 V. In such a case, "reference voltage value VHR/setting voltage value"=2, and therefore the data processor 44 multiplies the n·r pixel values Din, Din, . . . , and Din each by "2," thereby generates the processed n·r pixel values Din', Din', . . . , and Din'. Accordingly, if the pixel values Din are 0, 64, and 128, then the data line drivers 102 respectively select the gradation voltages VR0, VR128, and VR256 as the selection voltages VS, and thus the drive voltages VD generated by the amplifiers 103 are respectively 0 V (=VR0), 2.5 V (=VR128), and 5 V (=VR256). Thus, processing the pixel values Din by the data processor 44 allows the correspondence between the pixel value and the voltage value of the drive voltage VD to match (or approach) the reference correspondence.

Thus, setting the reference voltage VREFH to a voltage value dependent on the maximum pixel value DM allows the reference voltage VREFH to be reduced, thereby allowing the power consumption of the gradation voltage generator 42 to be reduced. As a result, the power consumption of the drive voltage generator 4 can be reduced.

The number of switching steps of the voltage values of the reference voltage VREFH may be less than the number of the gradation voltages "k." In such a case, in the mapping table which shows a correspondence between the maximum pixel value DM and the voltage value of the reference voltage VREFH, each of the i (where i<k) voltage values may be mapped to one or more maximum pixel values.

Moreover, the data processor 44 may perform an operation, such as rounding the fractional part up or down, after multiplying the pixel values Din by the value of "reference voltage value VHR/setting voltage value" so that the processed pixel values Din' will be integers. For example, the data processor 44 may multiply a pixel value Din representing "63" by "1.25," round up the fractional part of the value "78.75" obtained by the multiplication, and then output a processed pixel value Din' representing "79."

Furthermore, the reference voltage supply 41, the gradation voltage generator 42, the reference voltage controller 43, and the data processor 44 may also be applied to any of the drive voltage generators 2, 2*a*, and 3. That is, the drive voltage generators 2, 2*a*, and 3 may include, instead of the gradation voltage generator 13, the reference voltage supply 41, the gradation voltage generator 42, the reference voltage controller 43, and the data processor 44 shown in FIG. 25.

Fifth Embodiment

Figure 29:
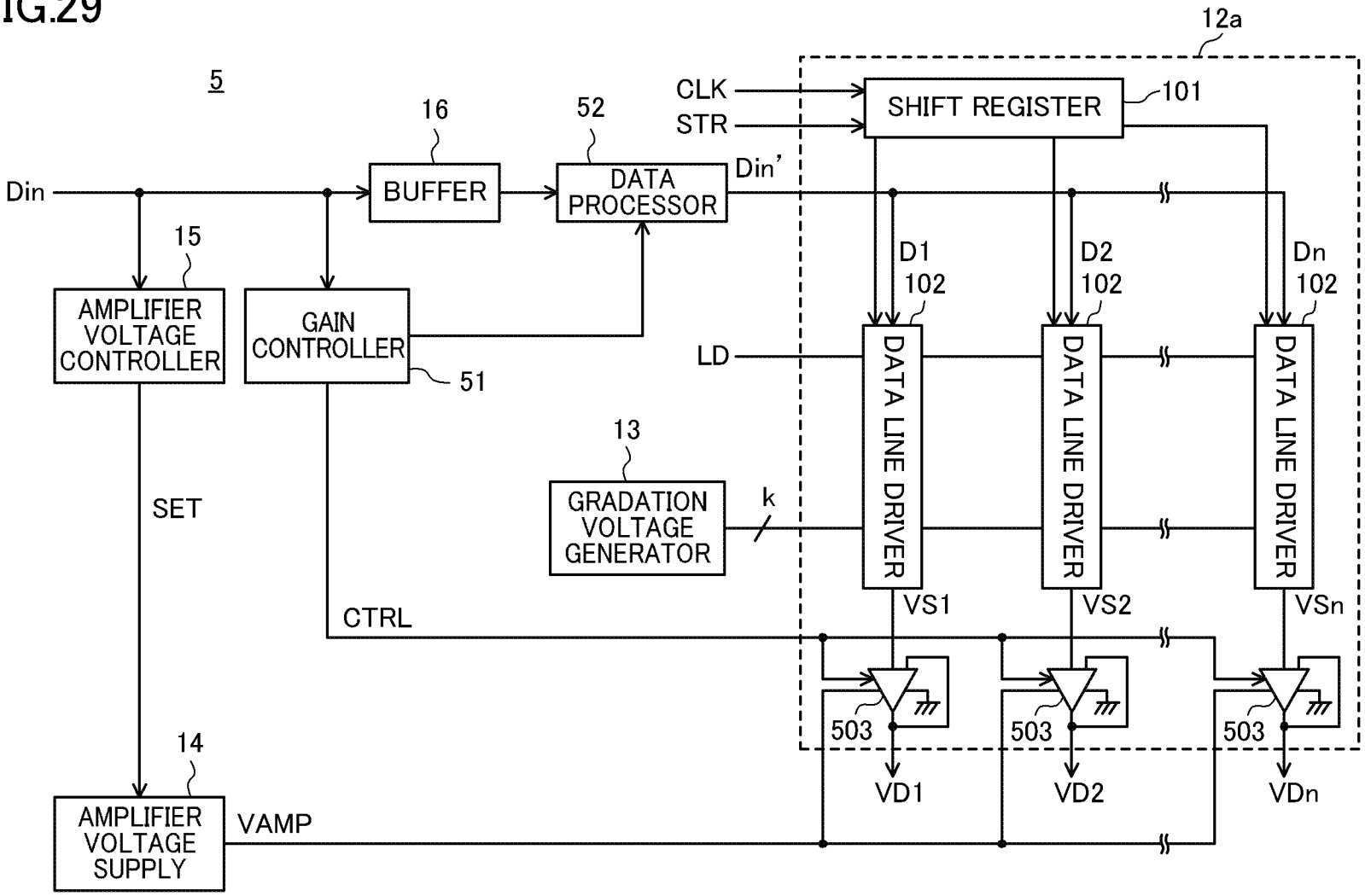
FIG. 29 is a diagram illustrating an example configuration of a drive voltage generator according to the fifth embodiment.

FIG. 29 illustrates an example configuration of a drive voltage generator 5 according to the fifth embodiment. The drive voltage generator 5 includes a source driver 12*a*, a gain controller 51, and a data processor 52, instead of the source driver 12 of FIG. 1.

[Source Driver]

Figure 30:
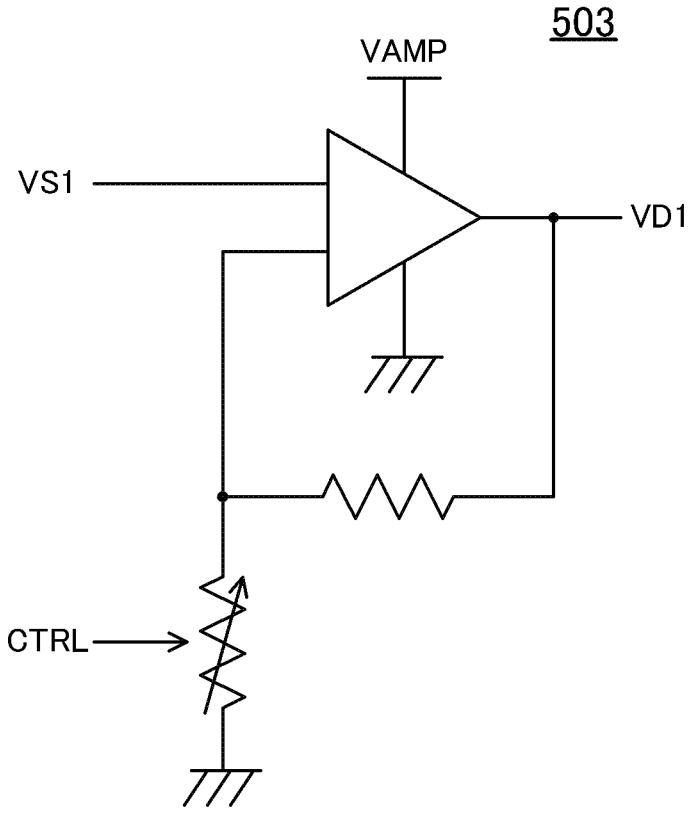
FIG. 30 is a diagram illustrating an example configuration of the variable amplifier shown in FIG. 29.

The source driver 12*a* includes n variable amplifiers 503, 503, . . . , and 503 instead of the n amplifiers 103, 103, . . . , and 103 shown in FIG. 1. The other part of the configuration is similar to that of the source driver 12 shown in FIG. 1. The gain value G of the variable amplifiers 503, 503, . . . , and 503 can be changed by a control signal CTRL from the gain controller 51. For example, as shown in FIG. 30, the variable amplifier 503 includes an operational amplifier, a resistive element, and a variable resistive element whose resistance value can be changed by the control signal CTRL. Here, if the gain value G of the variable amplifiers 503 is set to a predetermined reference gain value GR, a predetermined reference correspondence is established between the pixel value and the voltage value of the drive voltage VD. For example, if the gain value G of the variable amplifiers 503 is set to "10," a reference correspondence as shown in FIG. 3A is established between the pixel value and the voltage value of the drive voltage VD. In such a case, the 256th gradation voltage VR256 is set to 1 V, and the voltage difference between a t-th gradation voltage and a (t+1)-th gradation voltage is set to approximately 0.004 V.

[Gain Controller]

Figure 31:
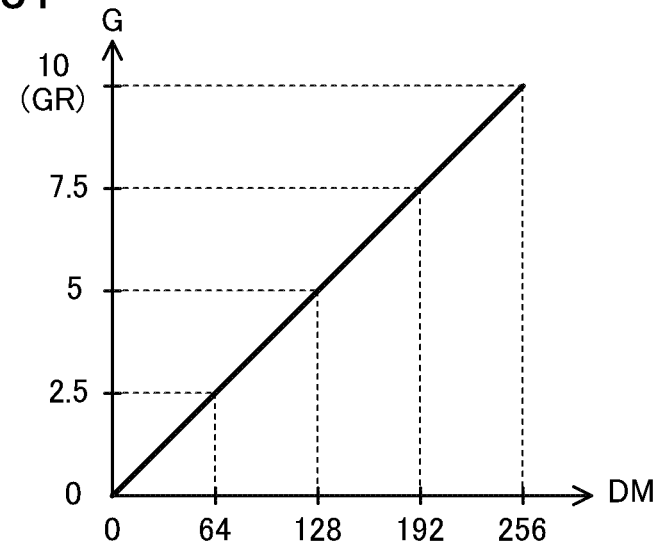
FIG. 31 is a diagram to explain a correspondence between the maximum pixel value and the gain value.

The gain controller 51 detects the maximum pixel value DM among n·s (where s≥1) pixel values Din, Din, . . . , and Din supplied to the drive voltage generator 5. The maximum value detection process by the gain controller 51 is similar to the maximum value detection process (ST101-ST106) by the amplifier voltage controller 15. In addition, the gain controller 51 includes a mapping table which shows a correspondence between the maximum pixel value DM and the gain value of the variable amplifiers 503, and detects a gain value mapped to the maximum pixel value DM from the mapping table. For example, if the gain value G of the variable amplifiers 503 is set to the reference gain value GR (=10), a reference correspondence as shown in FIG. 3A is established between the pixel value and the voltage value of the drive voltage VD; and if the gain value of the variable amplifiers 503 can be switched in k steps (257 steps), then the gain controller 51 may include a mapping table which shows a correspondence as shown in FIG. 31. In FIG. 31, 257 gain values correspond on a one-to-one basis to the 257 maximum pixel values, and a t-th (where $0 \leq t \leq k-1$) gain value corresponds to "10·t/256" (=GR·t/256). For example, the zeroth maximum pixel value "0" is mapped to a gain value "0," and the 256th maximum pixel value "256" is mapped to the reference gain value GR (=10).

Moreover, the gain controller 51 controls the variable amplifiers 503, 503, . . . , and 503 by the control signal CTRL so that the gain value G of the variable amplifiers 503, 503, . . . , and 503 is set to a gain value dependent on the maximum pixel value DM (maximum pixel value detected by the gain controller 51). Note that the gain setting process by the gain controller 51 is similar to the amplifier voltage setting process (ST107) by the amplifier voltage controller 15.

[Data Processor]

The data processor 52 processes the n·s pixel values Din, Din, . . . , and Din (here, the n·s pixel values Din, Din, . . . , and Din from the buffer 16) supplied to the drive voltage generator 5 based on a ratio between a gain value (setting gain value) of the variable amplifiers 503 set by the gain controller 51 and the predetermined reference gain value GR, and supplies processed n·s pixel values Din', Din', . . . , and Din' to the n data line drivers 102, 102, . . . , and 102. For example, the data processor 52 multiplies the n·s pixel values Din, Din, . . . , and Din each by a ratio of the reference gain value GR to the setting gain value (reference gain value GR/setting gain value), thereby generates the processed n·s pixel values Din', Din', . . . , and Din'.

[Operation]

Figure 32:
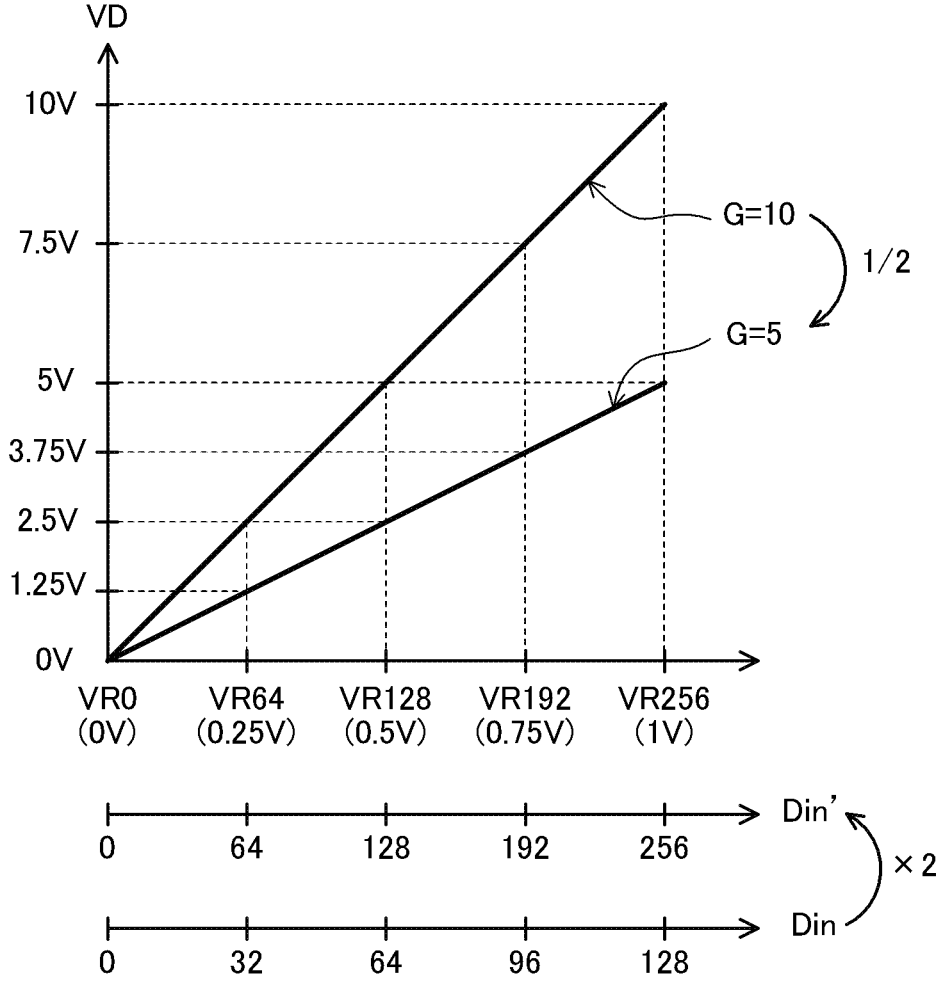
FIG. 32 is a diagram to explain an operation by the drive voltage generator shown in FIG. 29.

Next, referring to FIG. 32, the operation by the drive voltage generator 5 shown in FIG. 29 will be described. Here, it is assumed that k=257 and GR=10, and that the 256th gradation voltage VR256 is set to 1 V, and the voltage difference between a t-th gradation voltage and a (t+1)-th gradation voltage is set to approximately 0.004 V. More specifically, it is assumed that the gradation voltages VR0, VR64, VR128, VR192, and VR256 are respectively 0 V, 0.25 V, 0.5 V, 0.75 V, and 1 V. It is also assumed that if the gain value G of the variable amplifiers 503 is set to the predetermined gain value GR, a reference correspondence as shown in FIG. 3A is established between the pixel value and the voltage value of the drive voltage VD.

If the gain value of the variable amplifiers 503 is set to "10" (=GR), the variable amplifiers 503 respectively multiply the selection voltages VS obtained by the data line drivers 102 by "10," thereby generate the drive voltages VD. In addition, "reference gain value GR/setting gain value"=1, and therefore the data processor 52 directly outputs the n·s pixel values Din, Din, . . . , and Din as the processed n·s pixel values Din', Din', . . . , and Din'. Accordingly, if the pixel values Din are 0, 64, and 128, then the data line drivers 102 respectively select the gradation voltages VR0 (=0 V), VR64 (=0.25 V), and VR128 (=0.5 V) as the selection voltages VS, and thus the drive voltages VD generated by the amplifiers 103 are respectively 0 V, 2.5 V (=VR64·10), and 5 V (=VR128·10).

Meanwhile, if the gain value of the variable amplifiers 503 is set to "5" (=GR/2), the variable amplifiers 503 respectively multiply the selection voltages VS obtained by the data line drivers 102 by "5," thereby generate the drive voltages VD. In addition, "reference gain value GR/setting gain value"=2, and therefore the data processor 52 multiplies the n·s pixel values Din, Din, . . . , and Din each by "2," thereby generates the processed n·s pixel values Din', Din', . . . , and Din'. Accordingly, if the pixel values Din are 0, 64, and 128, then the data line drivers 102 respectively select the gradation voltages VR0 (=0 V), VR128 (=0.5 V), and VR256 (=1 V) as the selection voltages VS, and thus the drive voltages VD generated by the amplifiers 103 are respectively 0 V, 2.5 V (=VR128·5), and 5 V (=VR256·5). Thus, processing the pixel values Din by the data processor 52 allows the correspondence between the pixel value and the voltage value of the drive voltage VD to match (or approach) the reference correspondence.

Thus, setting the gain value of the variable amplifiers 503, 503, . . . , and 503 to a gain value dependent on the maximum pixel value DM allows the power consumption of the variable amplifiers 503, 503, . . . , and 503 to be reduced as compared to when the gain value of each of the variable amplifiers 503, 503, . . . , and 503 is fixed. As a result, the power consumption of the drive voltage generator 5 can be reduced.

Moreover, setting the gain value of the variable amplifiers 503, 503, . . . , and 503 to a value greater than "1" allows the power consumption of the gradation voltage generator 13 to be reduced, and allows the voltage resistance of each of the DACs 123, 123, . . . , and 123 to be reduced. Thus, the circuit sizes of the gradation voltage generator 13 and of the DACs 123, 123, . . . , and 123 can be reduced. As a result, the circuit size of the drive voltage generator 5 can be reduced.

The number of switching steps of the gain value of the variable amplifiers 503 may be less than the number of the gradation voltages "k." In such a case, in the mapping table which shows a correspondence between the maximum pixel value DM and the gain value of the variable amplifiers 503, each of the i (where i<k) gain values may be mapped to one or more maximum pixel values. Moreover, the data processor 52 may perform an operation, such as rounding the fractional part up or down, after multiplying the pixel values Din by the value of "reference gain value GR/setting vain value" so that the processed pixel values Din' will be integers.

Furthermore, the gain controller 51 and the data processor 52 may also be applied to any of the drive voltage generators 2, 2*a*, 3, and 4. That is, the drive voltage generators 2, 2*a*, 3, and 4 may include the n variable amplifiers 503, 503, . . . , and 503, the gain controller 51, and the data processor 52 shown in FIG. 29, instead of the n amplifiers 103, 103, . . . , and 103.

First Variation of Fifth Embodiment

Figure 33:
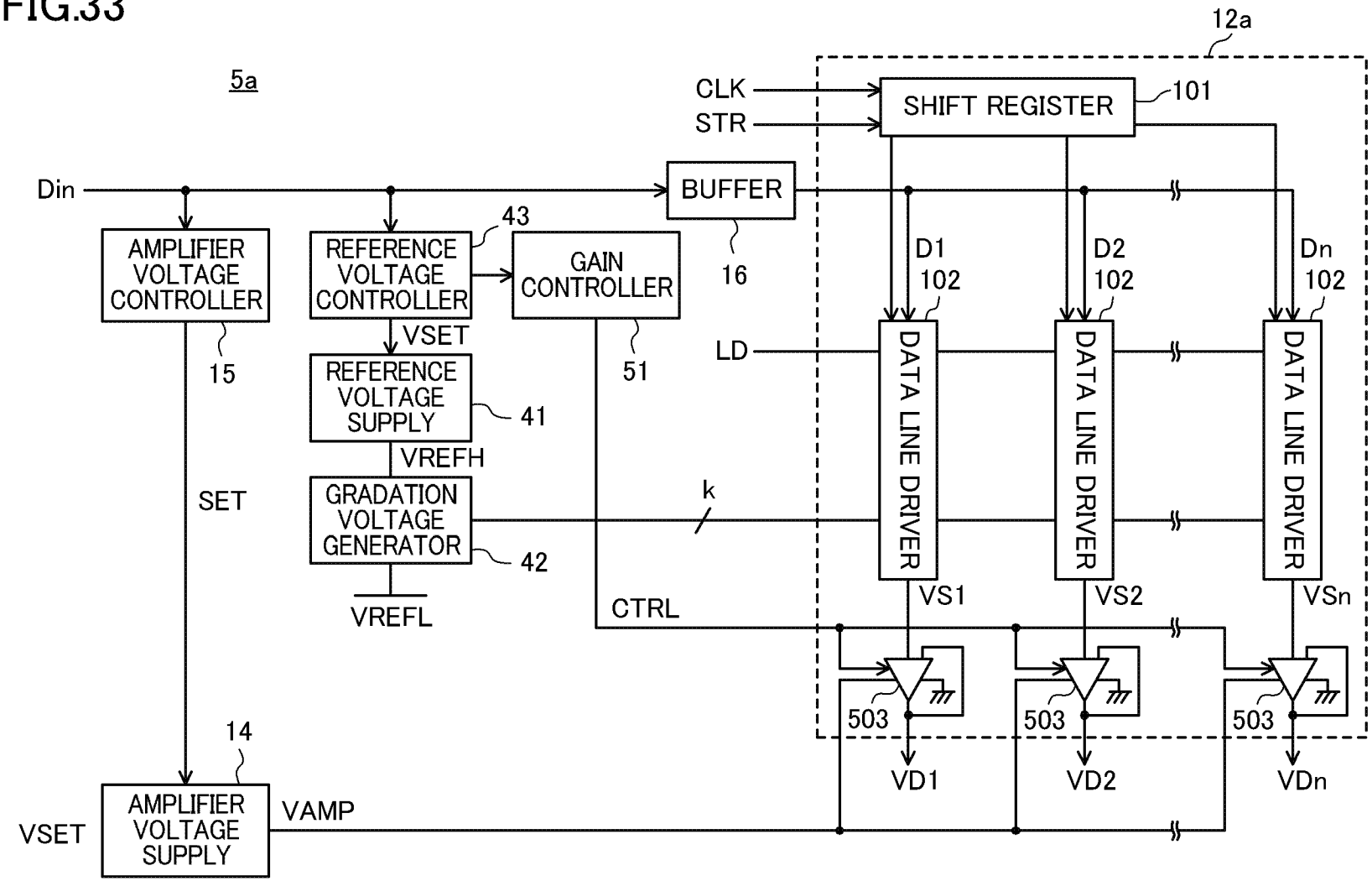
FIG. 33 is a diagram to explain a variation of the drive voltage generator shown in FIG. 29.

Alternatively, as shown in FIG. 33, the data processor 44 shown in FIG. 25 may be replaced with the gain controller 51 shown in FIG. 29. In a drive voltage generator 5*a* shown in FIG. 33, the gain controller 51 sets the gain value of the variable amplifiers 503, 503, . . . , and 503 depending on a ratio between a voltage value (setting voltage value) of the reference voltage VREFH set by the reference voltage controller 43 and the reference voltage value VHR. For example, the gain controller 51 controls the gain value of the variable amplifiers 503, 503, . . . , and 503 so that the gain value of the variable amplifiers 503, 503, . . . , and 503 is set to a value of "(reference voltage value VHR)·(reference gain value GR)/(setting voltage value)."

[Operation]

Next, the operation by the drive voltage generator 5*a* shown in FIG. 33 will be described. Here, it is assumed that k=257, GR=10, and VHR=1 V, and that if the reference voltage VREFH is set to the reference voltage value VHR, the gradation voltages VR0, VR64, VR128, VR192, and VR256 are respectively 0 V, 0.25 V, 0.5 V, 0.75 V, and 1 V. It is also assumed that if the reference voltage VREFH is set to the reference voltage value VHR, and the gain value G of the variable amplifiers 503 is set to the reference gain value GR, a reference correspondence as shown in FIG. 3A is established between the pixel value and the voltage value of the drive voltage VD.

If the reference voltage VREFH is set to "10 V" (=VHR), the gradation voltages VR0, VR64, VR128, VR192, and VR256 are respectively 0 V, 0.25 V, 0.5 V, 0.75 V, and 1 V. In such a case, "reference voltage value VHR/setting voltage value"=1, and therefore the gain controller 51 sets the gain value G of the variable amplifiers 503 to "10" (=GR). Accordingly, if the pixel values Din are 0, 64, and 128, then the drive voltages VD generated by the amplifiers 103 are respectively 0 V (=VR0·10), 2.5 V (=VR64·10), and 5 V (=VR128·10).

Meanwhile, if the reference voltage VREFH is set to "5 V" (=VHR/2), the gradation voltages VR0, VR64, VR128, VR192, and VR256 are respectively 0 V, 0.125 V, 0.25 V, 0.375 V, and 0.5 V. In such a case, "reference voltage value VHR/setting voltage value"=2, and therefore the gain controller 51 sets the gain value G of the variable amplifiers 503 to "20" (=GR·2). Accordingly, if the pixel values Din are 0, 64, and 128, then the drive voltages VD generated by the amplifiers 103 are respectively 0 V (=VR0·20), 2.5 V (=VR64·20), and 5 V (=VR128·20).

Such a configuration also allows the power consumption of the gradation voltage generator 42 to be reduced, and allows the voltage resistance of each of the DACs 123, 123, . . . , and 123 to be reduced. In addition, the correspondence between the pixel value and the voltage value of the drive voltage VD to match (or approach) the reference correspondence without processing the pixel values Din.

Sixth Embodiment

Figure 34:
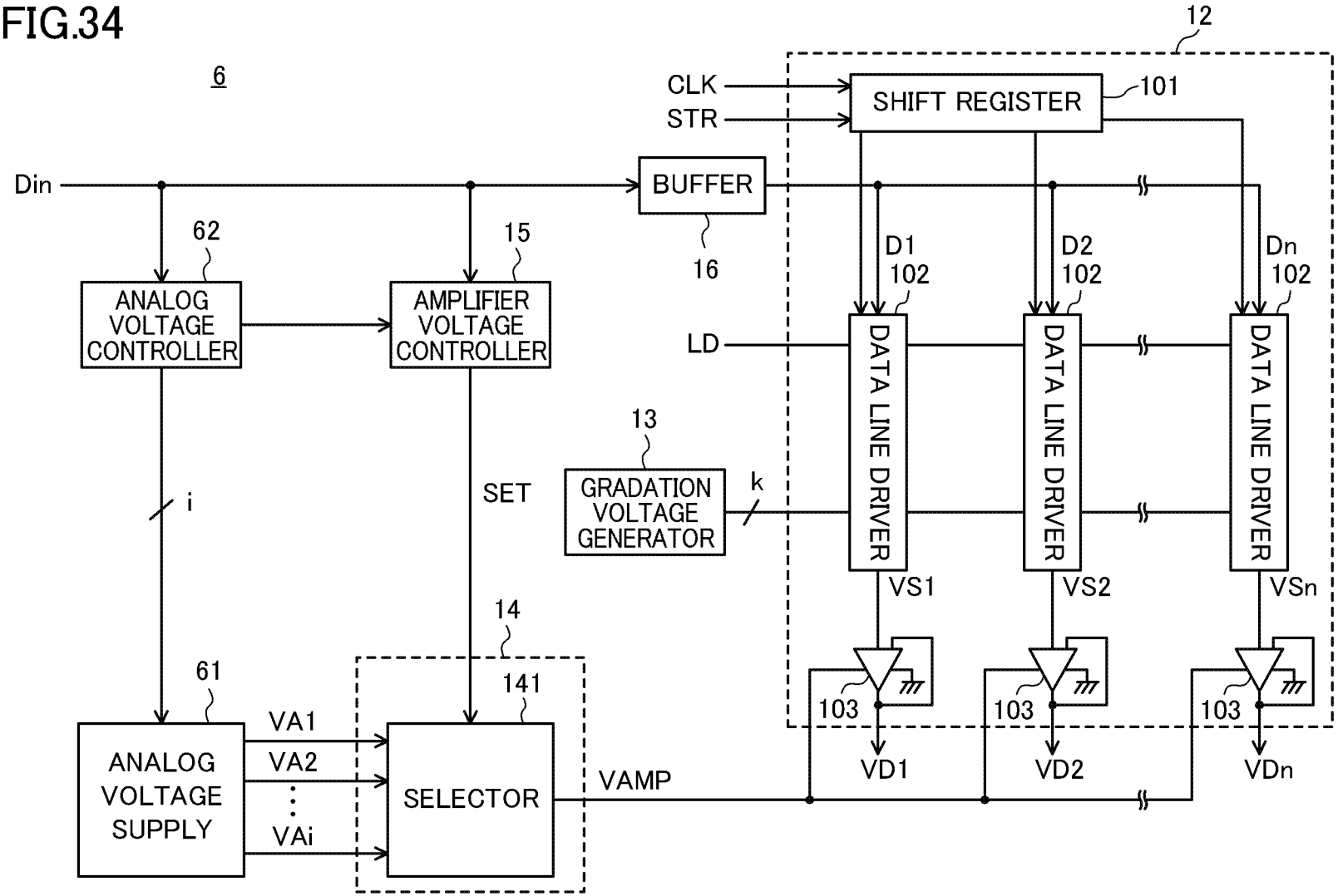
FIG. 34 is a diagram illustrating an example configuration of a drive voltage generator according to the sixth embodiment.

FIG. 34 illustrates an example configuration of a drive voltage generator 6 according to the sixth embodiment. The drive voltage generator 6 includes an analog voltage supply 61 and an analog voltage controller 62 in addition to the components in the drive voltage generator 1 shown in FIG. 1. Here, the amplifier voltage supply 14 includes a selector 141, which selects an analog voltage corresponding to the maximum pixel value DM from i (where 2≤i<k) analog voltages VA1, VA2, . . . , and VAi based on the setting signal SET (see FIG. 5A). That is, the voltage value of the amplifier voltage VAMP can be switched in i steps.

[Analog Voltage Supply]

Figure 35:
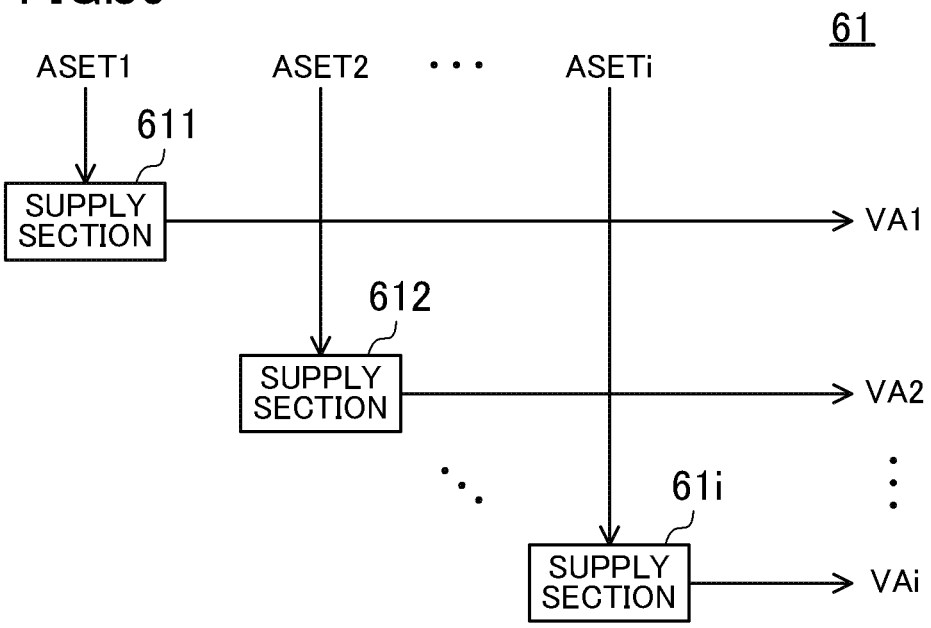
FIG. 35 is a diagram illustrating an example configuration of the analog voltage supply shown in FIG. 34

The analog voltage supply 61 supplies i analog voltages VA1, VA2, . . . , and VAi to the amplifier voltage supply 14 (selector 141). For example, as shown in FIG. 35, the analog voltage supply 61 includes i supply sections 611, 612, . . . , and 61*i*, which respectively supply the i analog voltages VA1, VA2, . . . , and VAi. The voltage values of the analog voltages VA1, VA2, . . . , and VAi generated by the supply sections 611, 612, . . . , and 61*i* can be respectively changed by i setting signals ASET1, ASET2, . . . , and ASETi from the analog voltage controller 62.

[Analog Voltage Controller]

Figure 36:
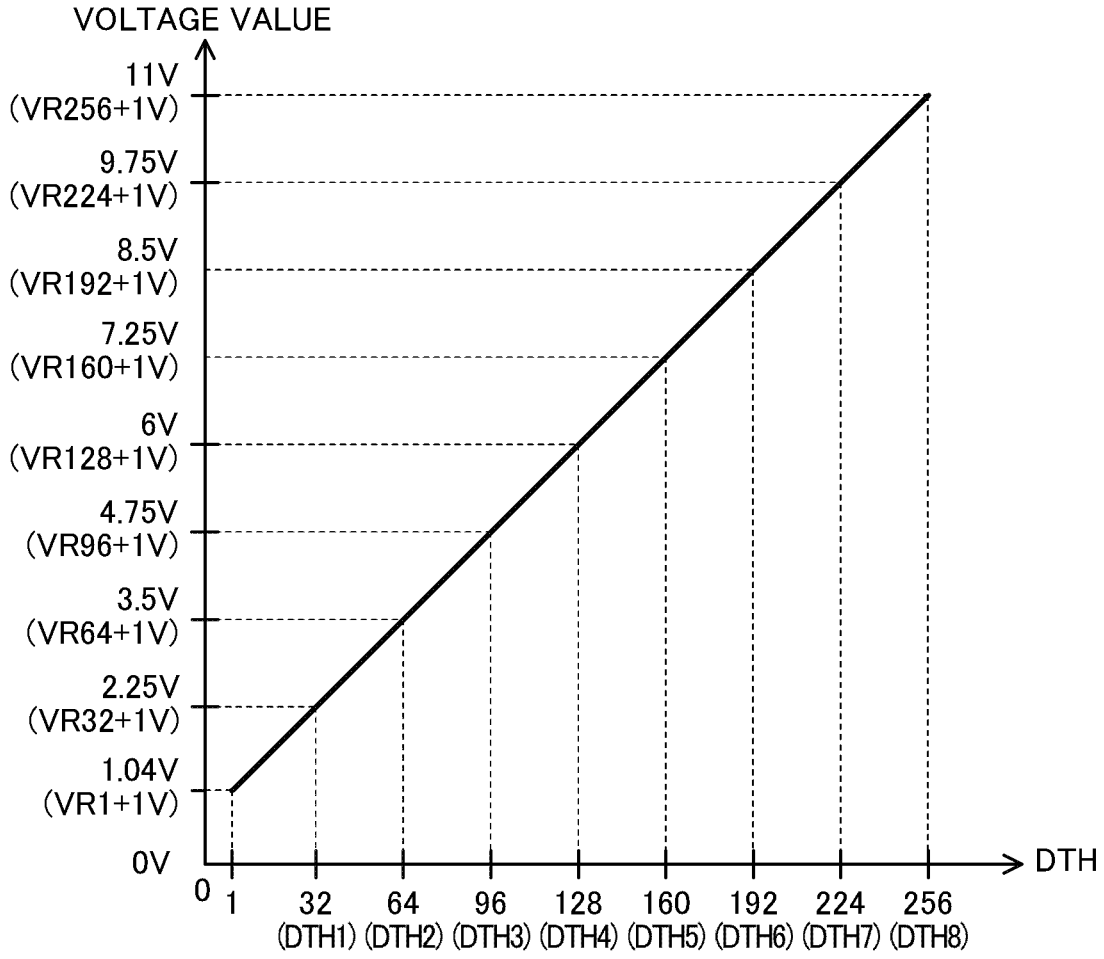
FIG. 36 is a diagram to explain a correspondence between the threshold and the voltage value of the analog voltage.

The analog voltage controller 62 selects i thresholds so that if n·v (where v≤1) pixel values Din, Din, . . . , and Din supplied to the drive voltage generator 6 are distributed to regions defined by the i thresholds, the numbers of pixel values which fall within the respective i regions approach a same value, and assigns the i thresholds respectively to the i analog voltages VA1, VA2, . . . , and VAi. In addition, the analog voltage controller 62 includes a mapping table which shows a correspondence between the threshold and the voltage value of the analog voltage, and detects i voltage values mapped to the i thresholds respectively assigned to the i analog voltages from the mapping table. For example, if, under α=1 V, a correspondence as shown in FIG. 3A exists between the pixel value and the voltage value of the drive voltage VD (voltage value of the gradation voltage), and the voltage values of the i analog voltages can be each set to any one of j (where j>i) voltage values of the i analog voltages, then the analog voltage controller 62 may include a mapping table which shows a correspondence as shown in FIG. 36. FIG. 36 shows that eight (i.e., j=8) thresholds DTH1 (=32), DTH2 (=64), . . . , and DTH8 (=256) correspond on a one-to-one basis to eight voltage values 2.25 V (=VR32+1 V), 3.5 V (=VR64+1 V), . . . , and 11V (=VR256+1 V), and that a Y-th voltage value is higher than the voltage value of the drive voltage VD corresponding to a Y-th threshold (hereinafter denoted as "threshold DTHy") by the predetermined amount α (=1 V). Note that 1≤Y≤j and 1≤y≤j. For example, the second voltage value "3.5 V" (=VR64+1 V) is 1 V higher than the voltage value (=VR64) of the drive voltage VD corresponding to the second threshold DTH2 (=64). FIG. 36 also shows that the eight thresholds define eight regions. For example, the first threshold DTH1 defines the region within which pixel values 1-32 fall, and the first and the second thresholds DTH1 and DTH2 define the region within which pixel values 33-64 fall.

In addition, the analog voltage controller 62 controls the analog voltage supply 61 by the i setting signals ASET1, ASET2, . . . , and ASETi so that the Z-th analog voltage (hereinafter denoted as "analog voltage VAz") of the analog voltages VA1, VA2, . . . , and VAi is set to a voltage value dependent on the threshold assigned to the analog voltage VAz. A control instruction is written into the Z-th setting signal (hereinafter denoted as "setting signal ASETz") of the setting signals ASET1, ASET2, . . . , and ASETi to set the Z-th analog voltage VAz to a voltage value dependent on the threshold assigned to the analog voltage VAz. Note that 1≤Z≤i and 1≤z≤i.

Moreover, the analog voltage controller 62 overwrites the correspondence (mapping table) between the maximum pixel value DM and the voltage value of the amplifier voltage VAMP in the amplifier voltage controller 15 based on the correspondence between the i analog voltages and the i thresholds. For example, the analog voltage controller 62 writes the i voltage values respectively corresponding to the i thresholds into the mapping table as "i voltage values of the amplifier voltage VAMP," and writes the pixel values which fall within the region defined by the (Z−1)-th threshold and the Z-th threshold into the mapping table as "the maximum pixel values corresponding to the Z-th voltage value of the amplifier voltage VAMP." As an example, FIG. 36 will be described below. If the threshold DTH2 (=64) is assigned to the first analog voltage VA1, and the threshold DTH3 (=96) is assigned to the second analog voltage VA2, then the analog voltage controller 62 writes the voltage value "3.5 V" (=VR64+1 V) corresponding to the threshold DTH2 and the voltage value "4.75 V" (=VR96+1 V) corresponding to the threshold DTH3 into the mapping table in the amplifier voltage controller 15, and writes pixel values "65-96" which fall within the region defined by the thresholds DTH2 and DTH3 into the mapping table as the maximum pixel values corresponding to the voltage value "4.75 V" (=VR96+1 V).

[Example Configuration of Supply Section]

Figure 37:
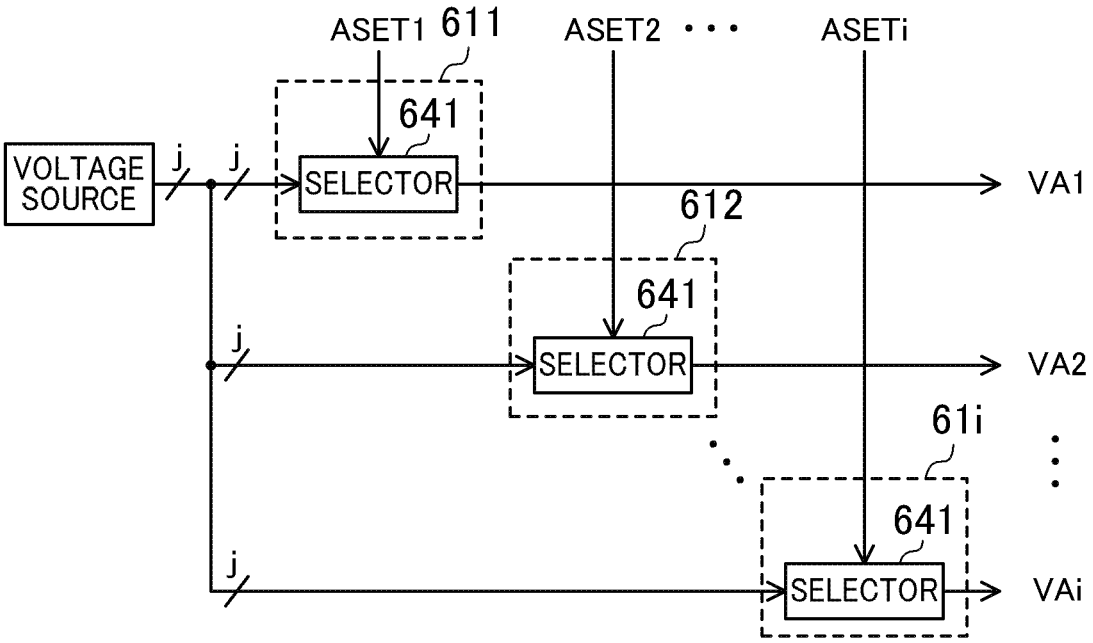
FIG. 37 is a diagram illustrating a first example configuration of the supply section shown in FIG. 35.
Figure 38:
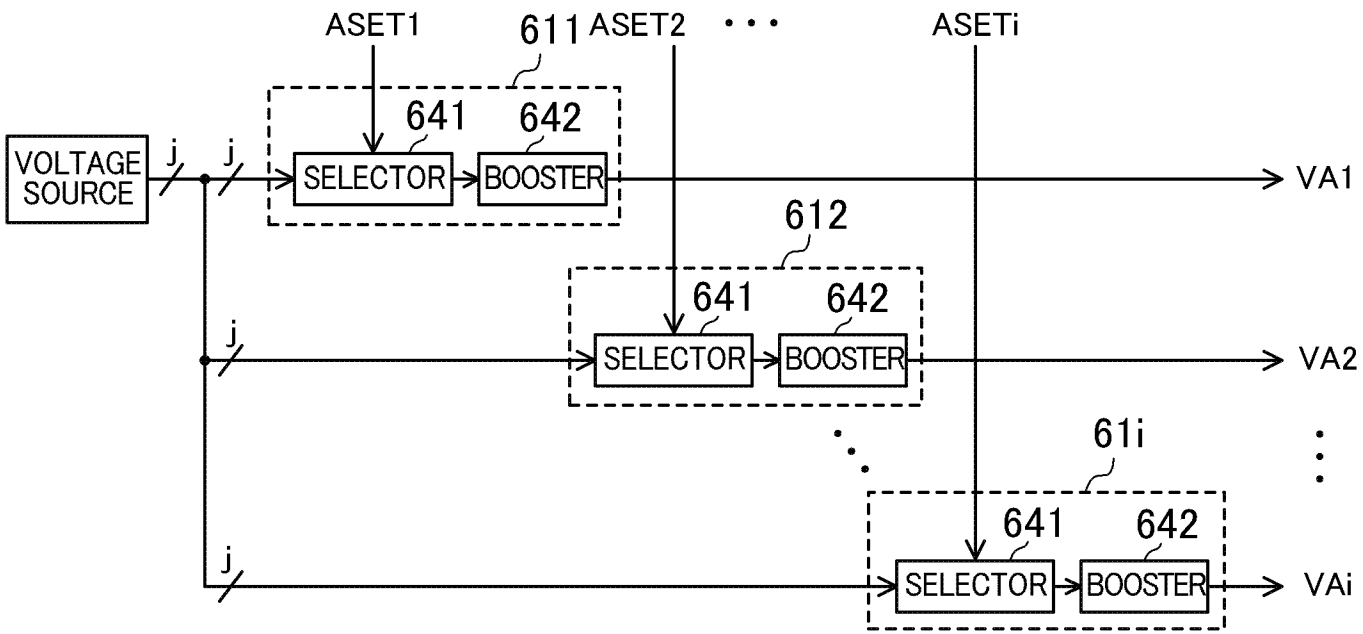
FIG. 38 is a diagram illustrating a second example configuration of the supply section shown in FIG. 35.
Figure 39:
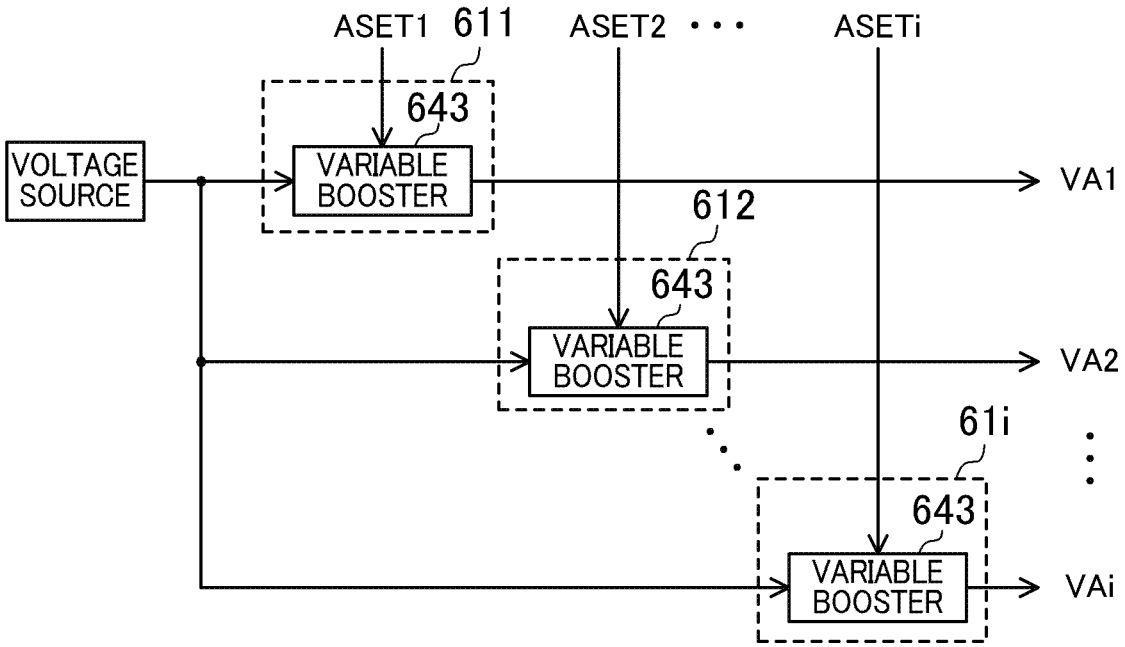
FIG. 39 is a diagram illustrating a third example configuration of the supply section shown in FIG. 35.

For example, as shown in FIG. 37, a Z-th supply section (hereinafter denoted as "supply section 61*z*") of the supply sections 611, 612, . . . , and 61*i* may include a selector 641, which selects a voltage corresponding to the threshold assigned to the Z-th analog voltage VAz from j (where j>i) voltages from a voltage source as the Z-th analog voltage VAz based on the Z-th setting signal ASETz. Alternatively, as shown in FIG. 38, the supply section 61*z* may include a selector 641 and a booster 642, which generates the analog voltage VAz by raising the voltage selected by the selector 641. Further alternatively, as shown in FIG. 39, the supply section 61*z* may include a variable booster 643, which generates the analog voltage VAz by raising the voltage from the voltage source at a rate of voltage increase corresponding to the threshold assigned to the analog voltage VAz.

[Operation]

Figure 40:
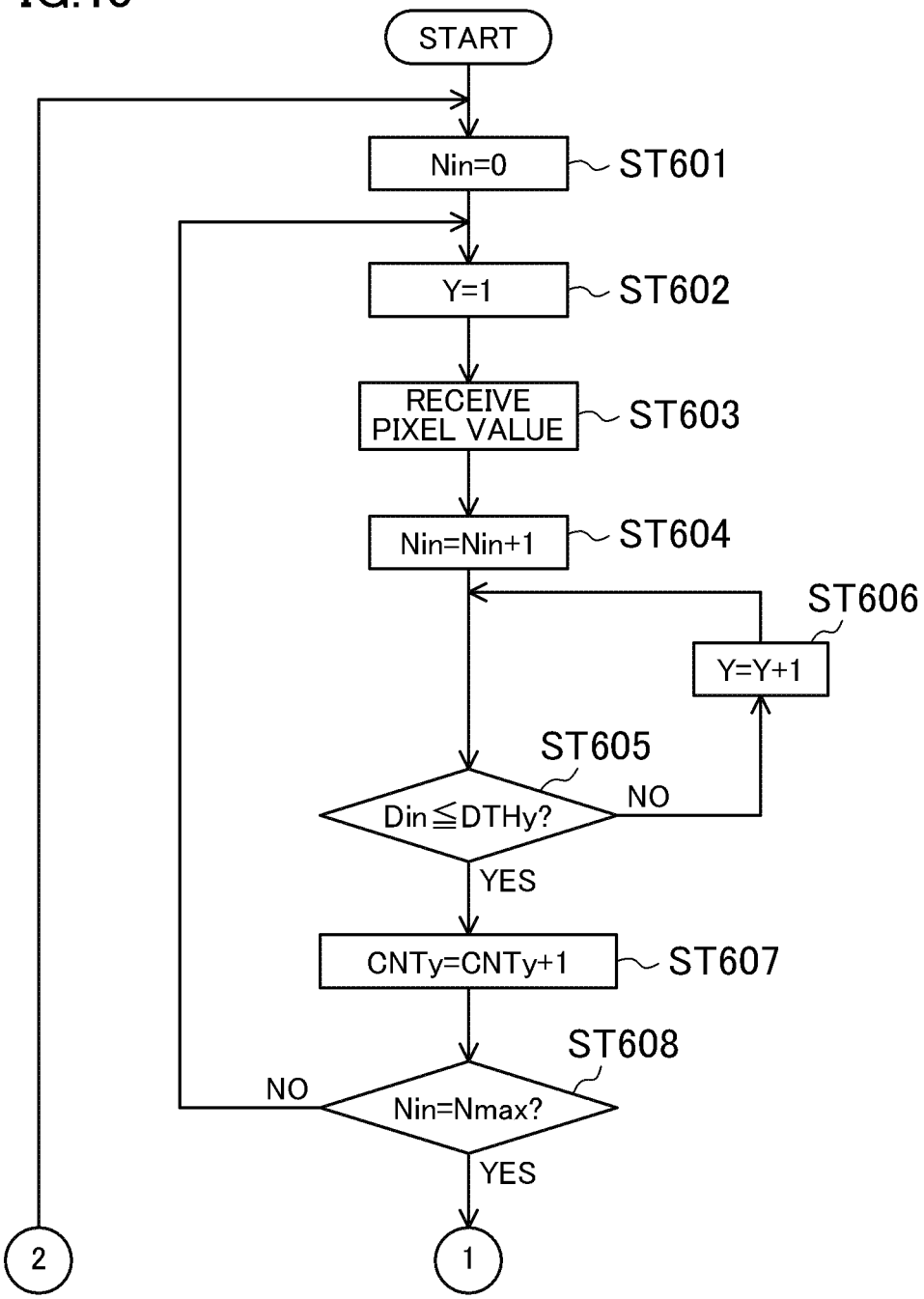
FIG. 40 is a diagram to explain an operation of the analog voltage controller shown in FIG. 34.
Figure 41:
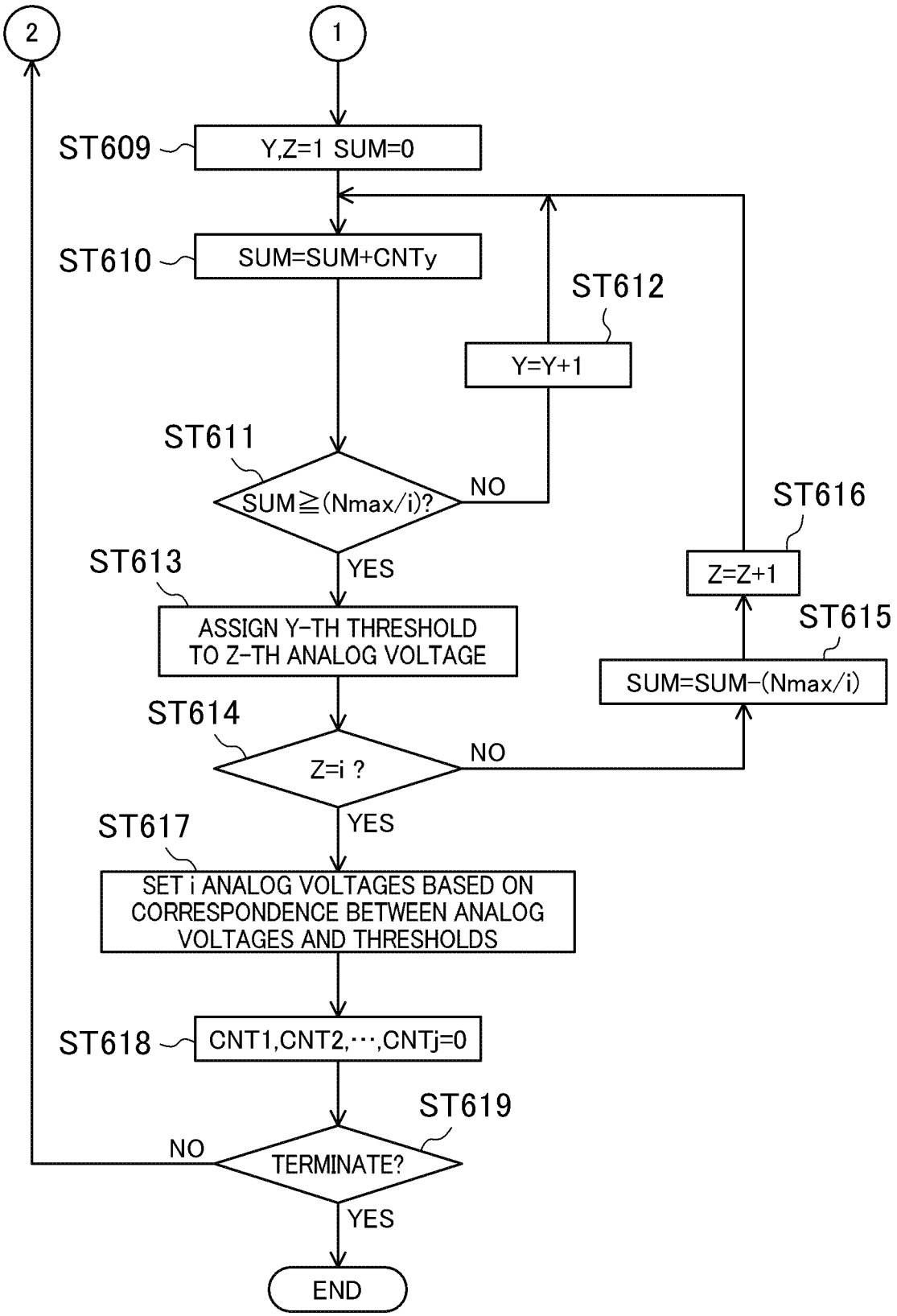
FIG. 41 is a diagram to explain an operation of the analog voltage controller shown in FIG. 34.

Next, referring to FIGS. 40 and 41, the operation by the analog voltage controller 62 shown in FIG. 34 will be described. It is assumed that the analog voltage controller 62 selects the i thresholds from j thresholds DTH1, DTH2, . . . , and DTHj based on the n·v pixel values, and assigns the i thresholds respectively to the i analog voltages VA1, VA2, . . . , and VAi. That is, the maximum pixel number Nmax is set to "n·v." It is also assumed that j count values CNT1, CNT2, . . . , and CNTj have each been set to an initial value (=0).

First, when pixel values of the h-th horizontal line start to be supplied, the analog voltage controller 62 sets the input pixel number Nin to an initial value (=0) (ST601), and sets the variable Y to an initial value (=1) (ST602). Then, the analog voltage controller 62 receives the pixel value Din (ST603), and adds "1" to the input pixel number Nin (ST604).

Next, the analog voltage controller 62 determines whether the pixel value Din received at step ST603 is less than or equal to the Y-th threshold DTHy or not (ST605). If the pixel value Din is greater than the threshold DTHy, the analog voltage controller 62 adds "1" to the variable Y (ST606), and compares the pixel value Din with the Y-th threshold DTHy (ST605). Meanwhile, if the pixel value Din is less than or equal to the threshold DTHy, the analog voltage controller 62 adds "1" to the Y-th count value (hereinafter denoted as "count value CNTy") (ST607).

Next, the analog voltage controller 62 determines whether the input pixel number Nin has reached the maximum pixel number Nmax or not (ST608). If the input pixel number Nin has not yet reached the maximum pixel number Nmax, the analog voltage controller 62 sets the variable Y to the initial value (=1) (ST602), and receives the next pixel value Din (ST603). Thus, the number of pixel values which falls within each of the j regions defined by the j thresholds is counted.

If the input pixel number Nin has reached the maximum pixel number Nmax, the analog voltage controller 62 sets each of the variables Y and Z to an initial value (=1), and sets a sum value SUM to an initial value (=0) (ST609). Next, the analog voltage controller 62 adds the Y-th count value CNTy to the sum value SUM (ST610), and determines whether the sum value SUM is greater than or equal to a predetermined value "Nmax/i" or not (ST611). If the sum value SUM is less than the predetermined value "Nmax/i," the analog voltage controller 62 adds "1" to the variable Y (ST612), and adds the Y-th count value CNTy to the sum value SUM (ST610).

If the sum value SUM is greater than or equal to the predetermined value "Nmax/i," the analog voltage controller 62 assigns the Y-th threshold DTHy to the Z-th analog voltage VAz (ST613). Next, the analog voltage controller 62 determines whether the variable Z has reached the value "i" or not (ST614). If the variable Z has not yet reached the value "i," the analog voltage controller 62 subtracts the predetermined value "Nmax/i" from the sum value SUM (ST615), adds "1" to the variable Z (ST616), and adds the Y-th count value CNTy to the sum value SUM (ST610). Thus, the i thresholds are respectively assigned to the i analog voltages VA1, VA2, . . . , and VAi.

If the variable Z has reached the value "i," the analog voltage controller 62 sets the Z-th analog voltage VAz to a voltage value dependent on the threshold assigned to the analog voltage VAz based on the correspondence between the i analog voltages VA1, VA2, . . . , and VAi and the i thresholds during an interval from a completion of a display process of the (h−1)-th horizontal line to a start of a display process of the h-th horizontal line (ST617). In addition, the analog voltage controller 62 overwrites the correspondence (mapping table) between the maximum pixel value DM and the voltage value of the amplifier voltage VAMP in the amplifier voltage controller 15 based on the correspondence between the i analog voltages VA1, VA2, . . . , and VAi and the i thresholds.

Next, the analog voltage controller 62 sets each of the j count values CNT1, CNT2, . . . , and CNTj to an initial value (=0) (ST618), and determines whether to terminate the process or not (ST619). If there still remain unprocessed pixel values, then the analog voltage controller 62 continues the distribution check process (ST601-ST608), the analog voltage assignment process (ST609-ST616), and the analog voltage setting process (ST617). Meanwhile, if unprocessed pixel values no longer exist, then the analog voltage controller 62 terminates the process.

The analog voltage controller 62 may start the distribution check process (ST601-ST608) in response to the h-th pulse of the horizontal synchronization signal (or the (h−1)-th load pulse LD), and may perform steps ST603 and ST604 in synchronism with the clock CLK. Moreover, the analog voltage controller 62 may perform the analog voltage setting process (ST617) and steps ST618 and ST619 in response to the (h+v)-th pulse of the horizontal synchronization signal (or the (h+v−1)-th load pulse LD).

Specific Example

Figure 42:
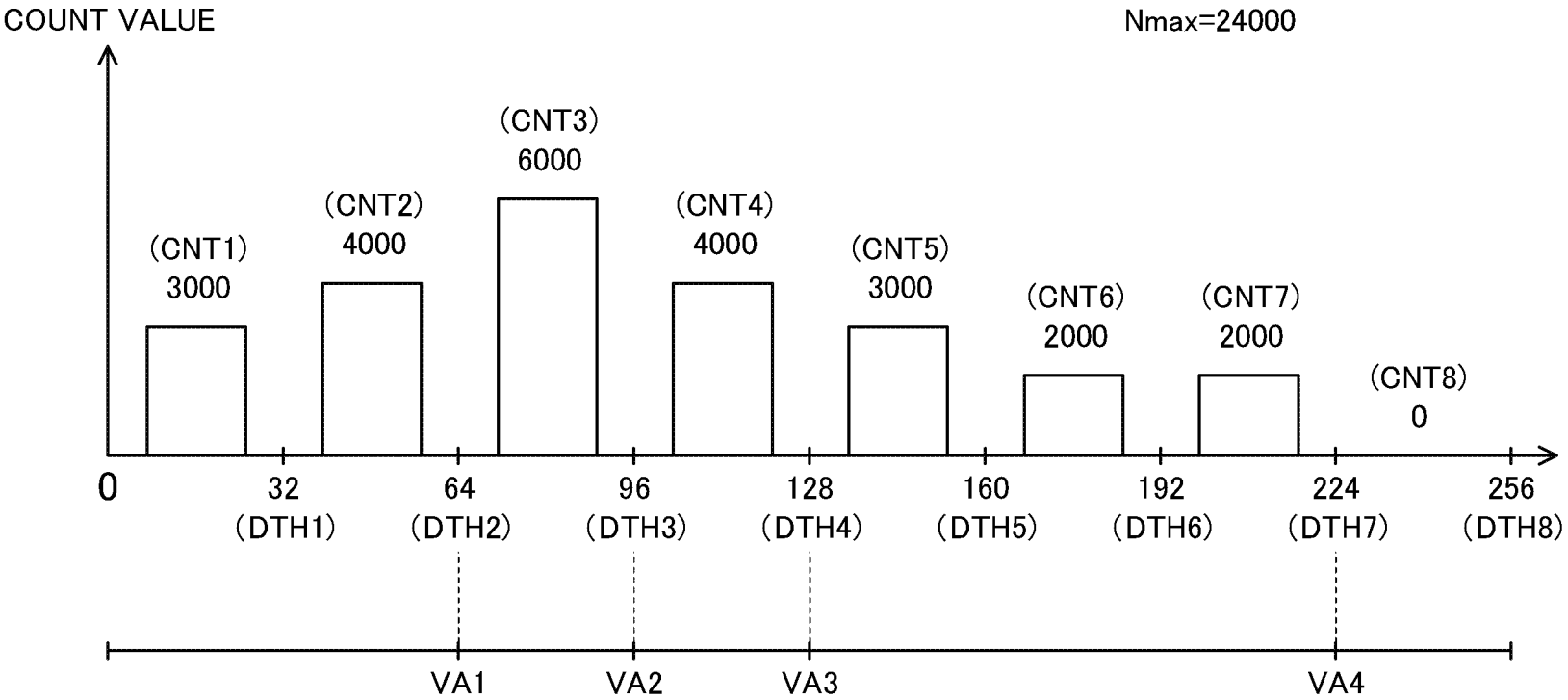
FIG. 42 is a diagram to explain a specific example of the operation of the analog voltage controller shown in FIG. 34.

Next, referring to FIG. 42, a specific example of the analog voltage assignment process and the analog voltage setting process performed by the analog voltage controller 62 shown in FIG. 34 will be described. Here, it is assumed that Nmax=24000, i=4, and j=8, and that the thresholds DTH1, DTH2, DTH3, DTH4, DTH5, DTH6, DTH7, and DTH8 respectively represent 32, 64, 96, 128, 160, 192, 224, and 256.

First, the analog voltage controller 62 adds the first count value CNT1 (=3000) to the sum value SUM (=0). Since the sum value SUM (=3000) is less than the predetermined value (Nmax/i=6000), the analog voltage controller 62 adds the second count value CNT2 (=4000) to the sum value SUM (=3000). At this point, the sum value SUM (=7000) exceeds the predetermined value (Nmax/i=6000), and thus the analog voltage controller 62 assigns the second threshold DTH2 (=64) to the first analog voltage VA1. Next, the analog voltage controller 62 subtracts the predetermined value (=6000) from the sum value SUM (=7000), and adds the third count value CNT3 (=6000) to the sum value SUM (=1000) after the subtraction. At this point, the sum value SUM (=7000) exceeds the predetermined value (=6000), and thus the analog voltage controller 62 assigns the third threshold DTH3 (=96)

to the second analog voltage VA2. In this way, the analog voltage controller 62 assigns the thresholds DTH2, DTH3, DTH4, and DTH7 respectively to the analog voltages VA1, VA2, VA3, and VA4.

Next, the analog voltage controller 62 sets the four analog voltages VA1, VA2, VA3, and VA4 supplied by the analog voltage supply 61 to voltage values (3.5 V, 4.75 V, 6 V, and 9.75 V) dependent on the four thresholds DTH2, DTH3, DTH4, and DTH7 based on the mapping table which shows the correspondence as shown in FIG. 36. In addition, the analog voltage controller 62 overwrites the correspondence (mapping table) between the maximum pixel value DM and the voltage value of the amplifier voltage VAMP in the amplifier voltage controller 15 with the correspondence shown in FIG. 43. Thus, the maximum pixel values 1-64, 65-96, 97-128, and 129-224 are respectively mapped to the voltage value 3.5 V (=VR64+1 V) corresponding to the threshold DTH2, the voltage value 4.75 V (=VR96+1 V) corresponding to the threshold DTH3, the voltage value 6 V (=VR128+1 V) corresponding to the threshold DTH4, and the voltage value 9.75 V (=VR224+1 V) corresponding to the threshold DTH7.

Figure 43:
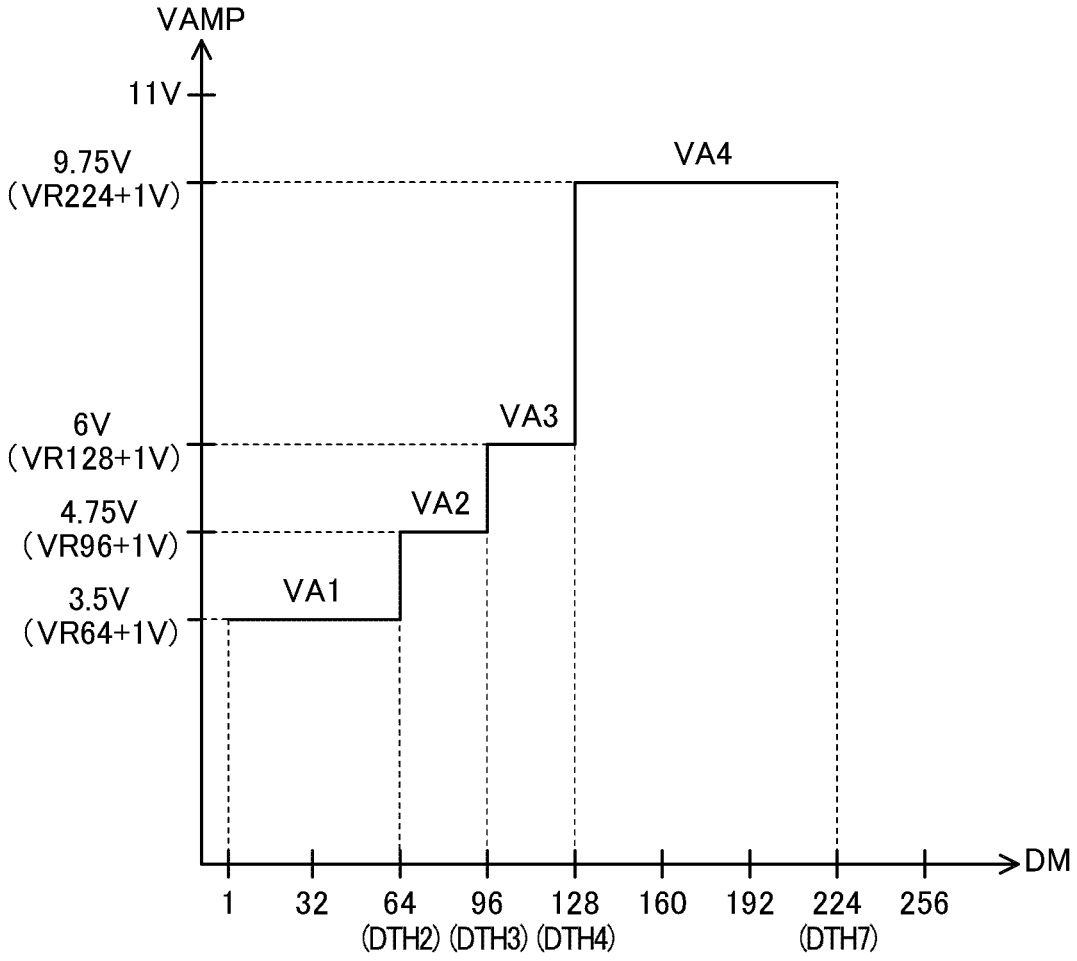
FIG. 43 is a diagram to explain a correspondence between the maximum pixel value and the voltage value of the amplifier voltage in the amplifier voltage controller shown in FIG. 34.

Thus, setting the analog voltages VA1, VA2, . . . , and VAi, which lead to the amplifier voltage VAMP based on the distribution of the n·v pixel values, allows the voltage differences between the drive voltages VD1, VD2, . . . , and VDn and the amplifier voltage VAMP to be reduced, thereby allows the power consumption of the amplifiers 103, 103, . . . , and 103 to be further reduced. For example, assume that a correspondence as shown in FIG. 3A exists between the pixel value and the voltage value of the drive voltage VD, that the amplifier voltage controller 15 performs the amplifier voltage setting process every horizontal line, that the analog voltage controller 62 performs the analog voltage setting process every frame, that 3000·800 pixel values for one frame have a distribution as shown in FIG. 42, and that the pixel values of the h-th horizontal line (3000 pixel values) represent "96." Here, if a correspondence as shown in FIG. 12 exists between the maximum pixel value and the voltage value of the amplifier voltage VAMP, the drive voltage VD is "3.75 V" (=VR96), and the amplifier voltage VAMP is "6 V" (=VR128+1 V) in the h-th horizontal line. Meanwhile, if a correspondence as shown in FIG. 43 exists between the maximum pixel value and the voltage value of the amplifier voltage VAMP, the amplifier voltage VAMP is "4.75 V" (=VR96+1 V), thereby allowing the amplifier voltage VAMP to be reduced.

Variation of Sixth Embodiment

The analog voltage supply 61 and the analog voltage controller 62 may also be applied to any of the drive voltage generators 2, 2*a*, 3, 4, 5, and 5*a*. That is, the drive voltage generators 2, 2*a*, 3, 4, 5, and 5*a* may further include the analog voltage supply 61 and the analog voltage controller 62 shown in FIG. 34. If such a configuration is used, it is preferable that the amplifier voltage supply (or each of the supply sections) include a selector which selects an amplifier voltage from i analog voltages VA1, VA2, . . . , and VAi.

Other Embodiments

In the embodiments described above, the amplifier voltage controllers 15, 25, 25*a*, and 35, the reference voltage controller 43 and the gain controller 51 may perform the maximum value detection process and the amplifier voltage setting process (or the reference voltage setting process or the gain setting process) continuously or intermittently. For example, the amplifier voltage controllers 15, 25, 25*a*, and 35, the reference voltage controller 43 and the gain controller 51 may perform these processes based only on pixel values of even-numbered horizontal lines. Similarly, the analog voltage controller 62 may also perform the distribution check process, the analog voltage assignment process, and the analog voltage setting process continuously or intermittently.

In addition, although, in each of the above embodiments, the number of gradation voltages k has been described as "257" for purposes of illustration, the number of gradation voltages k may be any value other than "257."

Note that the drive voltage generator according to each embodiment may be applied not only to OEL display devices but also to other display devices (e.g., LCD devices), etc.

As described above, the above-described drive voltage generators can reduce the power consumption of amplifiers, and thus are each useful as a circuit for driving display panels such as OEL panels or LCD panels.

It is to be understood that the foregoing embodiments are illustrative in nature, and are not intended to limit the scope of the invention, application of the invention, or use of the invention.

What is claimed is:

1. A drive voltage generator which periodically receives n (where n≥2) digital values, and generates n drive voltages corresponding to the n digital values, comprising:

n drivers corresponding to the n digital values;

n amplifiers corresponding to the n drivers;

an amplifier voltage supply; and an amplifier voltage controller, wherein each of the n drivers converts a digital value corresponding to that driver into a voltage, each of the n amplifiers amplifies a voltage obtained by a driver corresponding to that amplifier, thereby generates one of the drive voltages, the amplifier voltage supply supplies an amplifier voltage for driving the n amplifiers, and the amplifier voltage controller detects a maximum digital value among n·q (where q≥1) digital values supplied to the drive voltage generator, and sets the amplifier voltage supplied by the amplifier voltage supply to a voltage value dependent on the maximum digital value, the drive voltage generator further comprising:

a reference voltage supply configured to supply a reference voltage;

a gradation voltage generator configured to generate a plurality of gradation voltages different from one another based on the reference voltage supplied by the reference voltage supply;

a reference voltage controller configured to detect a maximum digital value among n·r (where r≥1) digital values supplied to the drive voltage generator, and to set the reference voltage supplied by the reference voltage supply to a voltage value dependent on the maximum digital value; and a data processor configured to process the n·r digital values based on a ratio between a voltage value of the reference voltage set by the reference voltage controller and a predetermined reference voltage value, and to supply processed n·r digital values to the n drivers, wherein each of the n drivers selects one gradation voltage from the plurality of gradation voltages based on a digital value corresponding to that driver.

2. A drive voltage generator which periodically receives n (where n≥2) digital values, and generates n drive voltages corresponding to the n digital values, comprising:

n drivers corresponding to the n digital values;

n amplifiers corresponding to the n drivers;

an amplifier voltage supply; and an amplifier voltage controller, wherein each of the n drivers converts a digital value corresponding to that driver into a voltage, each of the n amplifiers amplifies a voltage obtained by a driver corresponding to that amplifier, thereby generates one of the drive voltages, the amplifier voltage supply supplies an amplifier voltage for driving the n amplifiers, and the amplifier voltage controller detects a maximum digital value among n·q (where q≥1) digital values supplied to the drive voltage generator, and sets the amplifier voltage supplied by the amplifier voltage supply to a voltage value dependent on the maximum digital value, the drive voltage generator further comprising:

a gain controller configured to detect a maximum digital value among n·s (where s≥1) digital values supplied to the drive voltage generator, and to set a gain value of each of the n amplifiers to a gain value dependent on the maximum digital value; and a data processor configured to process the n·s digital values based on a ratio between the gain value set by the gain controller and a predetermined reference gain value, and to supply processed n·s digital values to the n drivers.

3. A drive voltage generator which periodically receives n (where n≥2) digital values, and generates n drive voltages corresponding to the n digital values, comprising:

n drivers corresponding to the n digital values;

n amplifiers corresponding to the n drivers;

an amplifier voltage supply; and an amplifier voltage controller, wherein each of the n drivers converts a digital value corresponding to that driver into a voltage, each of the n amplifiers amplifies a voltage obtained by a driver corresponding to that amplifier, thereby generates one of the drive voltages, the amplifier voltage supply supplies an amplifier voltage for driving the n amplifiers, the amplifier voltage controller detects a maximum digital value among n·q (where q≥1) digital values supplied to the drive voltage generator, and sets the amplifier voltage supplied by the amplifier voltage supply to a voltage value dependent on the maximum digital value, and the amplifier voltage supply selects, as controlled by the amplifier voltage controller, an analog voltage corresponding to the maximum digital value from i (where i≥2) analog voltages different from one another as the amplifier voltage, the drive voltage generator further comprising:

an analog voltage supply configured to supply the i analog voltages; and an analog voltage controller configured to select i thresholds so that if n·v (where v≥1) digital values supplied to the drive voltage generator are distributed to i regions defined by the i thresholds, the numbers of digital values which fall within the respective i regions approach a same value, and to set the i analog voltages supplied by the analog voltage supply respectively to voltage values dependent on the i thresholds.

* * * * *